US007654765B2

(12) United States Patent
Cheng

(10) Patent No.: US 7,654,765 B2
(45) Date of Patent: Feb. 2, 2010

(54) RING BINDER HAVING A CLIP

(75) Inventor: Hung Yu Cheng, Hong Kong (CN)

(73) Assignee: World Wide Stationary Mfg. Co., Ltd., Kwai Chung, N.T. (HK)

( * ) Notice: Subject to any disclaimer, the term of this patent is extended or adjusted under 35 U.S.C. 154(b) by 55 days.

(21) Appl. No.: 11/423,077

(22) Filed: Jun. 8, 2006

(65) Prior Publication Data

US 2007/0048080 A1 Mar. 1, 2007

Related U.S. Application Data

(63) Continuation-in-part of application No. 11/316,500, filed on Dec. 22, 2005, which is a continuation-in-part of application No. 11/215,948, filed on Aug. 31, 2005.

(51) Int. Cl.

| | |
|---|---|
| ***B42F 13/00*** | (2006.01) |
| ***B42F 13/12*** | (2006.01) |
| ***B42F 13/40*** | (2006.01) |
| ***B42F 13/20*** | (2006.01) |
| ***B42F 3/04*** | (2006.01) |

(52) U.S. Cl. ..... 402/75; 402/70; 402/36; 402/37; 402/38; 402/80 R

(58) Field of Classification Search ..... 402/19, 402/20, 23, 26, 31, 35–39, 41, 42, 45, 70, 402/73, 76, 77, 80 R, 4; 24/67.3, 66.11
See application file for complete search history.

(56) References Cited

U.S. PATENT DOCUMENTS

| | | | | |
|---|---|---|---|---|
| 324,212 A | | 8/1885 | Baker | |
| 330,833 A | * | 11/1885 | Harger, Jr. | 24/555 |
| 446,139 A | | 2/1891 | Richardson | |
| 1,456,036 A | | 5/1923 | Nissen | |
| 1,639,361 A | | 8/1927 | Adams | |
| 1,670,130 A | * | 5/1928 | Watson | 402/37 |
| 1,673,670 A | * | 6/1928 | Finley | 402/37 |
| 1,709,955 A | | 4/1929 | Schade | |

(Continued)

FOREIGN PATENT DOCUMENTS

DE 196 02 813 A1 8/1996

(Continued)

OTHER PUBLICATIONS

Dictionary.com. 'Wire' definition.*

(Continued)

*Primary Examiner*—Dana Ross
*Assistant Examiner*—Kyle Grabowski
(74) *Attorney, Agent, or Firm*—Senniger Powers LLP

(57) ABSTRACT

A ring binder has a substrate and a ring binder mechanism including a housing and at least one ring supported by the housing for mounting loose leaf paper. At least one clip is adapted to secure the clip to a substrate and thereby mount the ring binder mechanism on the substrate. The clip has a first portion, a second portion spaced from the first portion, and an intermediate portion connecting the first and second portions. The first portion has an attachment member for attaching the clip to the housing. At least one of the portions is a wire.

24 Claims, 72 Drawing Sheets

U.S. PATENT DOCUMENTS

| | | | | | |
|---|---|---|---|---|---|
| 1,769,120 | A | * | 7/1930 | Dawson | 402/39 |
| 1,841,793 | A | * | 1/1932 | Dawson | 402/38 |
| 1,895,972 | A | | 1/1933 | Childs | |
| 1,972,452 | A | * | 9/1934 | Lingo | 24/547 |
| 2,005,573 | A | | 6/1935 | Watson | |
| 2,093,041 | A | * | 9/1937 | Emery | 402/45 |
| 2,111,845 | A | * | 3/1938 | Dunham | 402/4 |
| 2,243,535 | A | | 5/1941 | Newman | |
| 2,311,090 | A | | 2/1943 | Schade | |
| 2,321,157 | A | | 6/1943 | Rees | |
| 2,374,803 | A | | 5/1945 | Broadwell | |
| 2,451,694 | A | * | 10/1948 | Schade | 281/33 |
| 2,512,415 | A | | 6/1950 | Buenger et al. | |
| 2,562,518 | A | | 7/1951 | Abrams | |
| 2,568,131 | A | * | 9/1951 | Segal | 402/70 |
| 2,778,153 | A | * | 1/1957 | Raby | 248/452 |
| 2,888,934 | A | | 6/1959 | Segal | |
| 2,986,060 | A | | 5/1961 | Lifka | |
| 3,159,411 | A | | 12/1964 | McKowen | |
| 3,175,847 | A | | 3/1965 | McKowen | |
| 3,252,461 | A | | 5/1966 | Schade | |
| 3,262,454 | A | | 7/1966 | Shillinger | |
| 3,305,957 | A | * | 2/1967 | Sobesky | 40/652 |
| 3,645,561 | A | | 2/1972 | Kendall | |
| 3,809,485 | A | | 5/1974 | Beyer | |
| 3,950,107 | A | | 4/1976 | Seaborn | |
| 3,993,374 | A | * | 11/1976 | Schudy et al. | 312/184 |
| 4,295,747 | A | | 10/1981 | Errichiello | |
| 4,400,107 | A | | 8/1983 | Pitts | |
| 4,552,478 | A | | 11/1985 | Cohen | |
| 4,584,737 | A | | 4/1986 | Ohman | |
| 4,697,945 | A | | 10/1987 | Geiger | |
| 4,722,628 | A | | 2/1988 | Rager | |
| 4,773,787 | A | | 9/1988 | Chang | |
| 4,904,102 | A | | 2/1990 | Handler | |
| 4,935,998 | A | | 6/1990 | Frazier et al. | |
| 4,943,177 | A | | 7/1990 | Jordan et al. | |
| 5,035,526 | A | | 7/1991 | Cooper et al. | |
| 5,100,253 | A | | 3/1992 | Cooper | |
| 5,106,223 | A | | 4/1992 | Kraus | |
| 5,120,149 | A | | 6/1992 | Smith | |
| 5,158,387 | A | | 10/1992 | Davies | |
| 5,160,209 | A | | 11/1992 | Schuessler | |
| 5,180,247 | A | | 1/1993 | Yu | |
| 5,199,809 | A | * | 4/1993 | Semerjian | 402/4 |
| 5,265,967 | A | | 11/1993 | Han | |
| 5,269,616 | A | | 12/1993 | O'Neill | |
| 5,286,128 | A | | 2/1994 | Gillum | |
| 5,348,412 | A | * | 9/1994 | Fuller | 402/75 |
| 5,354,142 | A | | 10/1994 | Yu | |
| 5,368,407 | A | | 11/1994 | Law | |
| 5,378,073 | A | | 1/1995 | Law | |
| 5,393,155 | A | | 2/1995 | Ng | |
| D356,945 | S | | 4/1995 | Kinner | |
| 5,476,335 | A | | 12/1995 | Whaley | |
| 5,511,301 | A | | 4/1996 | McGuire | |
| 5,577,852 | A | | 11/1996 | To | |
| 5,634,666 | A | * | 6/1997 | Lee | 281/20 |
| 5,688,091 | A | | 11/1997 | McKinlay | |
| 5,704,100 | A | | 1/1998 | Swan | |
| 5,718,530 | A | * | 2/1998 | Tibbetts | 402/73 |
| 5,755,513 | A | | 5/1998 | To | |
| 5,772,348 | A | | 6/1998 | To | |
| 5,803,692 | A | | 9/1998 | Postadan | |
| 5,842,807 | A | | 12/1998 | To | |
| 5,864,934 | A | | 2/1999 | Young | |
| 5,879,097 | A | | 3/1999 | Cheng | |
| 5,882,135 | A | * | 3/1999 | Ko | 402/36 |
| 5,924,811 | A | | 7/1999 | To et al. | |
| 5,971,649 | A | | 10/1999 | To | |
| D419,598 | S | | 1/2000 | Whaley | |
| 6,019,538 | A | | 2/2000 | Whaley | |
| 6,033,144 | A | | 3/2000 | Ng et al. | |
| D422,307 | S | | 4/2000 | Whaley | |
| 6,132,153 | A | | 10/2000 | LeVey | |
| 6,168,339 | B1 | | 1/2001 | To | |
| D438,244 | S | | 2/2001 | Whaley | |
| 6,357,951 | B1 | | 3/2002 | Tibbetts | |
| 6,357,952 | B1 | * | 3/2002 | McKeown | 402/79 |
| 6,394,686 | B1 | | 5/2002 | Whaley | |
| 6,419,416 | B1 | | 7/2002 | Tomoda | |
| D461,498 | S | | 8/2002 | To et al. | |
| 6,438,808 | B1 | * | 8/2002 | Kung | 24/572.1 |
| 6,470,535 | B1 | * | 10/2002 | Mayne et al. | 24/3.12 |
| D466,153 | S | | 11/2002 | To et al. | |
| 6,511,244 | B1 | | 1/2003 | Cohen | |
| 6,659,676 | B2 | | 12/2003 | Zheng | |
| 6,746,171 | B2 | | 6/2004 | Welch | |
| 6,749,357 | B2 | | 6/2004 | Cheng | |
| RE38,731 | E | | 5/2005 | To | |
| 7,175,152 | B2 | | 6/2005 | Dittmer | |
| 7,032,274 | B2 | | 4/2006 | Kumagai | |
| 7,097,378 | B2 | * | 8/2006 | Peleman | 402/18 |
| 7,192,234 | B2 | | 3/2007 | Anderson | |
| 2002/0048484 | A1 | * | 4/2002 | Tomoda | 402/18 |
| 2002/0076262 | A1 | * | 6/2002 | To | 402/73 |
| 2002/0131810 | A1 | | 9/2002 | Whaley | |
| 2003/0031503 | A1 | * | 2/2003 | Cohen | 402/73 |
| 2003/0103797 | A1 | * | 6/2003 | Cheng | 402/73 |
| 2005/0127260 | A1 | | 6/2005 | Dittmer | |
| 2007/0048071 | A1 | | 3/2007 | Li | |
| 2007/0048074 | A1 | | 3/2007 | Kwong | |
| 2007/0048075 | A1 | | 3/2007 | Cheng | |
| 2007/0048076 | A1 | | 3/2007 | To | |
| 2007/0048078 | A1 | | 3/2007 | Cheng | |
| 2007/0048079 | A1 | | 3/2007 | Ng | |

FOREIGN PATENT DOCUMENTS

| | | | |
|---|---|---|---|
| EP | 0764549 | A1 | 3/1997 |
| EP | 0882603 | A1 | 9/1998 |
| GB | 954 417 | | 4/1964 |
| GB | 1 111 435 | | 4/1968 |
| GB | 1 484 908 | | 9/1977 |
| JP | 2003170688 | | 6/2003 |
| JP | 2003170689 | | 6/2003 |

OTHER PUBLICATIONS

Office Action dated Feb. 29, 2008 from related U.S. Appl. No. 11/215,948, 19 pages.

Office action dated Jun. 27, 2008 from related U.S. Appl. No. 11/316,511, 9 pgs.

Office action dated Jun. 30, 2008 from related U.S. Appl. No. 11/316,500, 11 pgs.

* cited by examiner

RING BINDER HAVING A CLIP

CROSS-REFERENCE TO RELATED APPLICATION

This application is a continuation-in-part of co-pending U.S. patent application Ser. No. 11/316,500 filed Dec. 22, 2005, which is a continuation-in-part of co-pending U.S. patent application Ser. No. 11/215,948 filed Aug. 31, 2005. Both of these patent applications are incorporated herein by reference in their entirety.

BACKGROUND OF THE INVENTION

This invention relates to ring binders for retaining loose-leaf pages, and in particular to a clip for attaching a ring binder mechanism to a cover to form the ring binder.

Conventional ring binders are made by securing a ring binder mechanism to a cover using rivets. Commonly, ring binder mechanisms include a housing and a plurality of ring members attached to the housing for retaining loose-leaf pages, such as hole-punched pages. Typically, the ring binder mechanism is secured to the cover by inserting the rivets through the cover and openings in the ring binder mechanism. The tail of each of the rivets is then deformed (e.g., by punching) to engage and fasten the ring binder mechanism. Once assembled, the ring binder is packaged and shipped to a distributor, a retailer, or directly to an end user (i.e., consumer).

One of the drawbacks of traditional ring binders relates to their shipping and storage after they are assembled. When assembled, large gaps exist between the ring binder mechanism and the cover for each ring binder leaving large amounts of room unused during shipping and storing of multiple ring binders. Thus, the number of ring binders in each package is greatly limited. As a result, packaging and shipping conventional ring binders is inefficient which results in significant shipping and handling costs. Moreover, even a limited number of ring binders occupy a substantial amount of storage space or retail display space.

In response to this drawback, manufacturers of ring binders typically pack the mechanisms in alternating directions. But even this packing technique leaves large amounts of unused space. Further efforts to overcome some of the short comings of conventional ring binders have been disclosed in co-assigned U.S. Pat. Nos. 5,924,811 to To et al., 5,879,097 to Cheng, and 5,160,209 to Schuessler, all of which are hereby incorporated by reference in their entireties.

SUMMARY OF THE INVENTION

In one aspect, the present invention is directed to a ring binder generally comprising a substrate and a ring binder mechanism including a housing and at least one ring supported by the housing for mounting loose leaf paper. At least one clip is adapted to secure the clip to a substrate and thereby mount the ring binder mechanism on the substrate. The clip has a first portion, a second portion spaced from the first portion, and an intermediate portion connecting the first and second portions. The first portion has an attachment member for attaching the clip to the housing. At least one of the portions comprises a wire.

In another aspect, the present invention is directed to a ring binder comprising a ring binder mechanism including a housing having at least one ring for mounting loose leaf paper. A cover includes a front panel, a back panel, and a spine. The front and back panels are hingedly attached to the spine so that the panels are movable to selectively cover or expose loose leaf pages retained by the ring binder mechanism. A clip has a first attachment portion for attaching the clip to the housing and a second attachment portion for attaching the clip to the cover to thereby mount the ring binder mechanism on the cover. The second attachment portion comprises a bent wire.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE INVENTION

Figure 1:
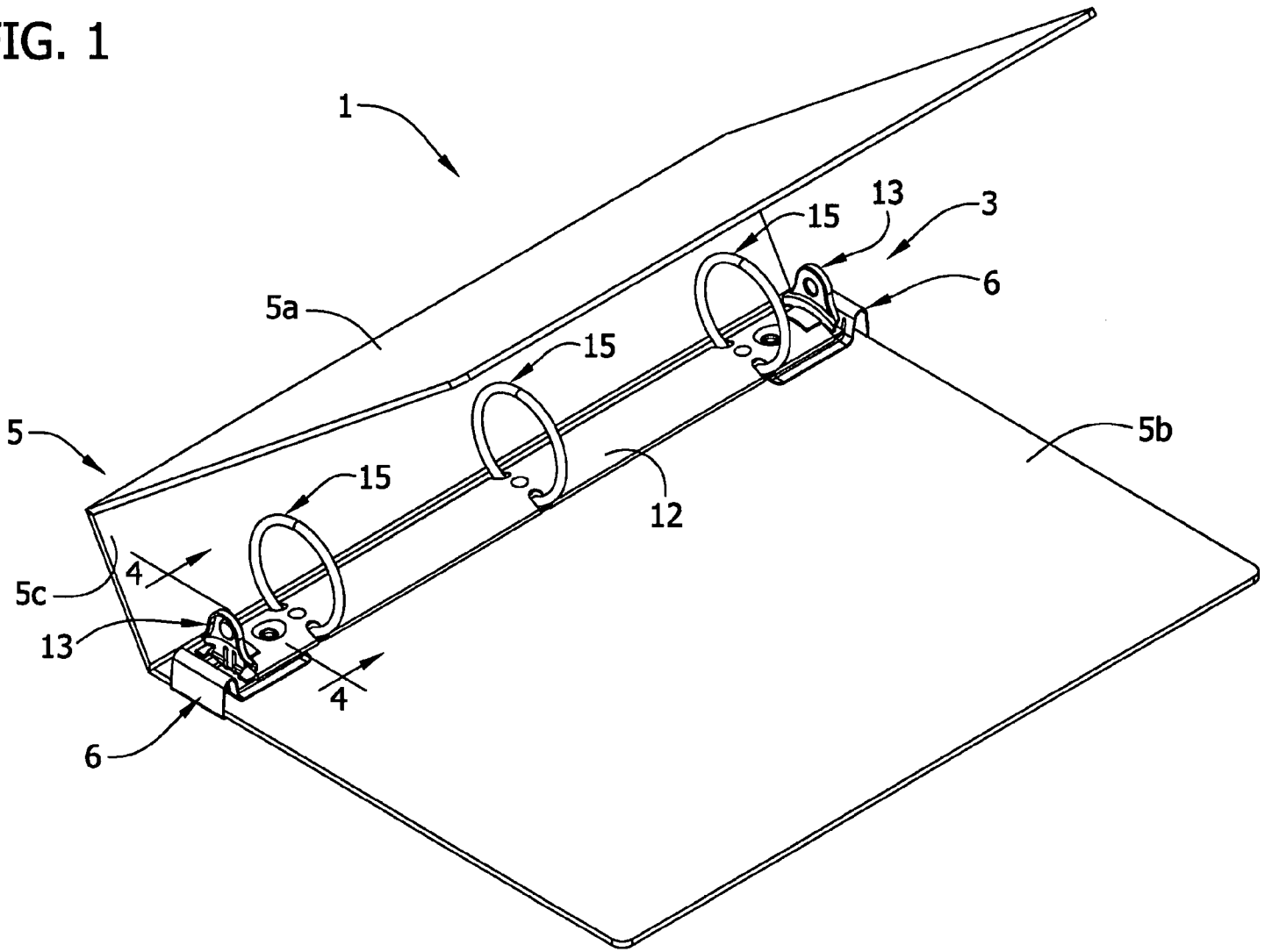
FIG. 1 is a perspective of a ring binder including a cover and a ring binder mechanism attached to the cover using a clip of the present invention.
Figure 2:
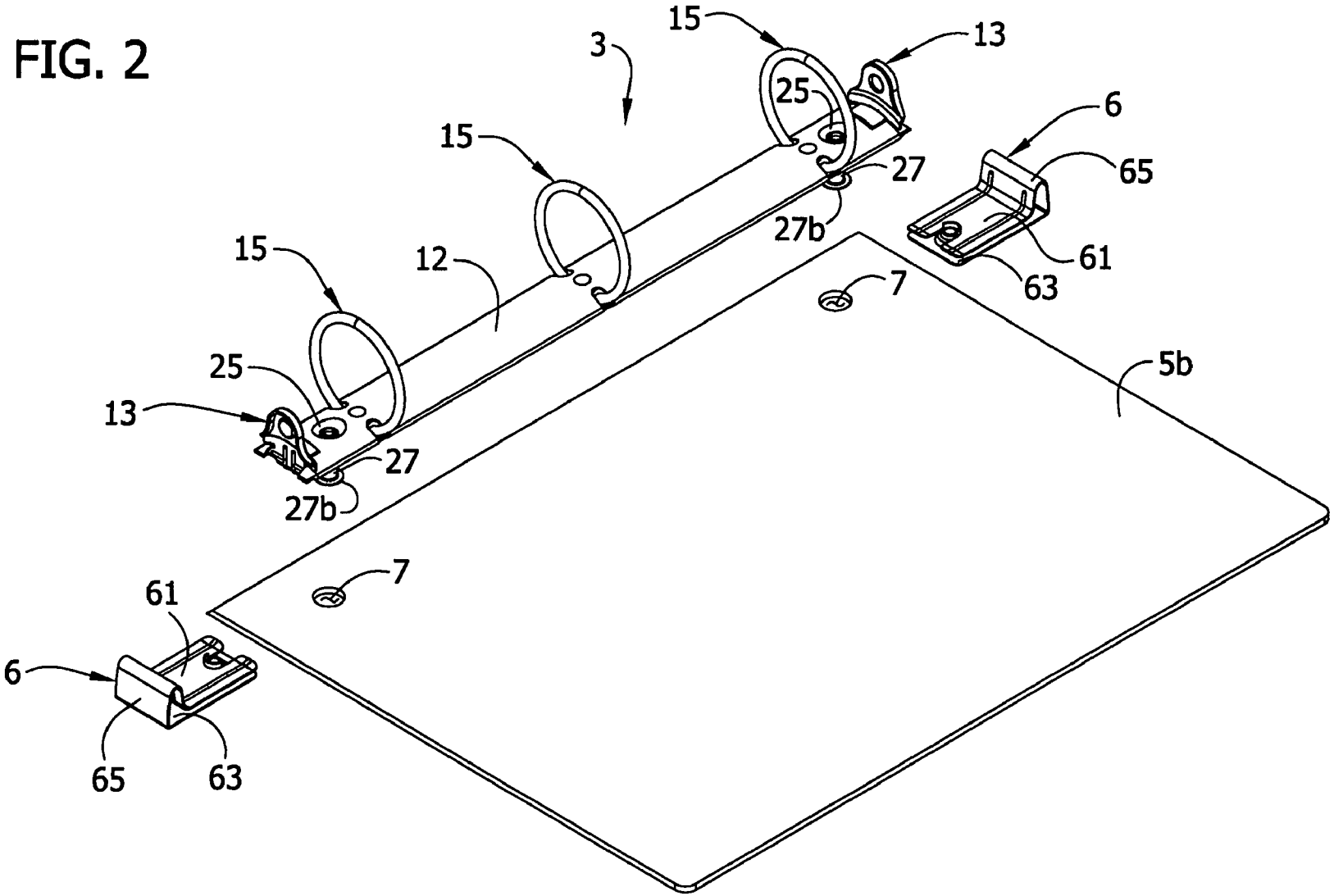
FIG. 2 is the perspective of FIG. 1 with the ring binder mechanism exploded from a back panel of the cover, a spine and front panel of the cover being removed.

Referring now to the drawings, and particularly to FIGS. 1 and 2, a ring binder according to the present invention is designated generally by reference numeral 1. The ring binder 1 comprises a ring binder mechanism 3 affixed on a cover 5 (broadly, "a substrate") using a clip 6 of the present invention. The cover, ring binder mechanism, and clip are indicated generally by their respective reference numbers. The cover 5 includes a front panel 5*a*, a back panel 5*b*, and a spine 5*c*. The front and back panels 5*a*, 5*b* are hingedly attached to the spine 5*c* so that they are movable to selectively cover or expose loose leaf pages (not shown) retained by the ring binder mechanism 3. As shown in FIG. 2, the back panel 5*b* of the cover 5 includes two apertures 7. One of the apertures 7 is located generally adjacent one edge of the back panel 5*b* and the other aperture is located generally adjacent an opposite edge of the back panel. The number of apertures 7 may be other than two and be within the scope of the present invention. While the ring binder mechanism 3 is shown affixed on the back panel 5*b* of the cover 5, it is understood that the ring binder mechanism 3 can be affixed on the front panel 5*a* or the spine 5*c* of the cover 5. Moreover, the ring binder mechanism 3 can be mounted on substrates other than the cover 5, such as files, without departing from the scope of the present invention.

As shown in FIGS. 1-4, the ring binder mechanism 3 includes an elongate housing 12 that supports two substantially similar actuating levers (each designated generally by reference numeral 13) and three rings (each designated generally by reference numeral 15). The housing 12 is symmetrical with a roughly arch-shaped cross section (see FIG. 4) and includes a longitudinal axis, two transversely opposite longitudinally extending edges, and two longitudinal ends (see FIG. 2). Each lever 13 pivotally mounts on the housing 12, generally at an opposite longitudinal end, for controlling movement of the rings 15 between a closed position (see FIG. 5) and an open position (see FIG. 7).

Figure 5:
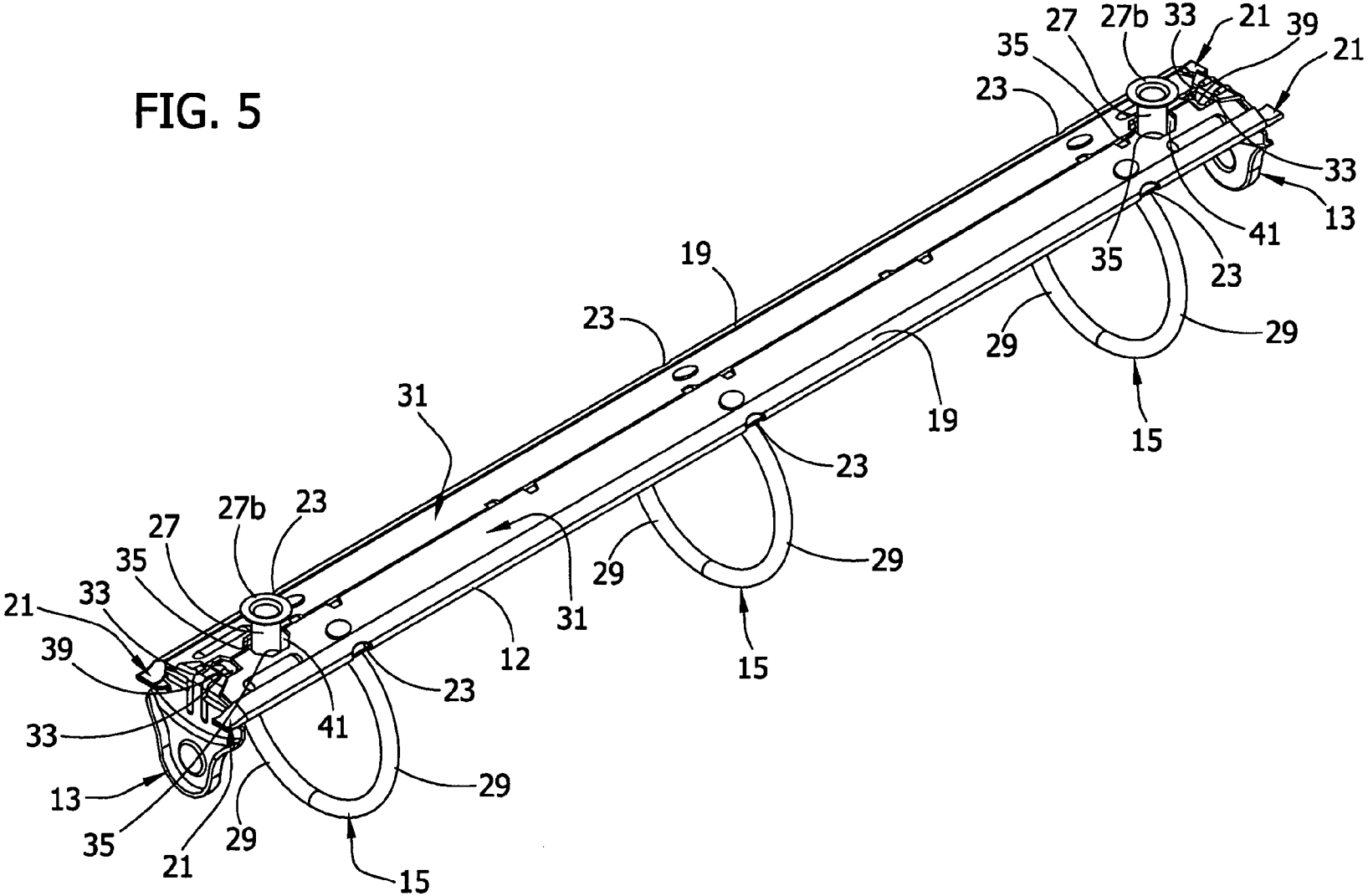
FIG. 5 is a bottom side perspective of the ring binder mechanism.
Figure 6:
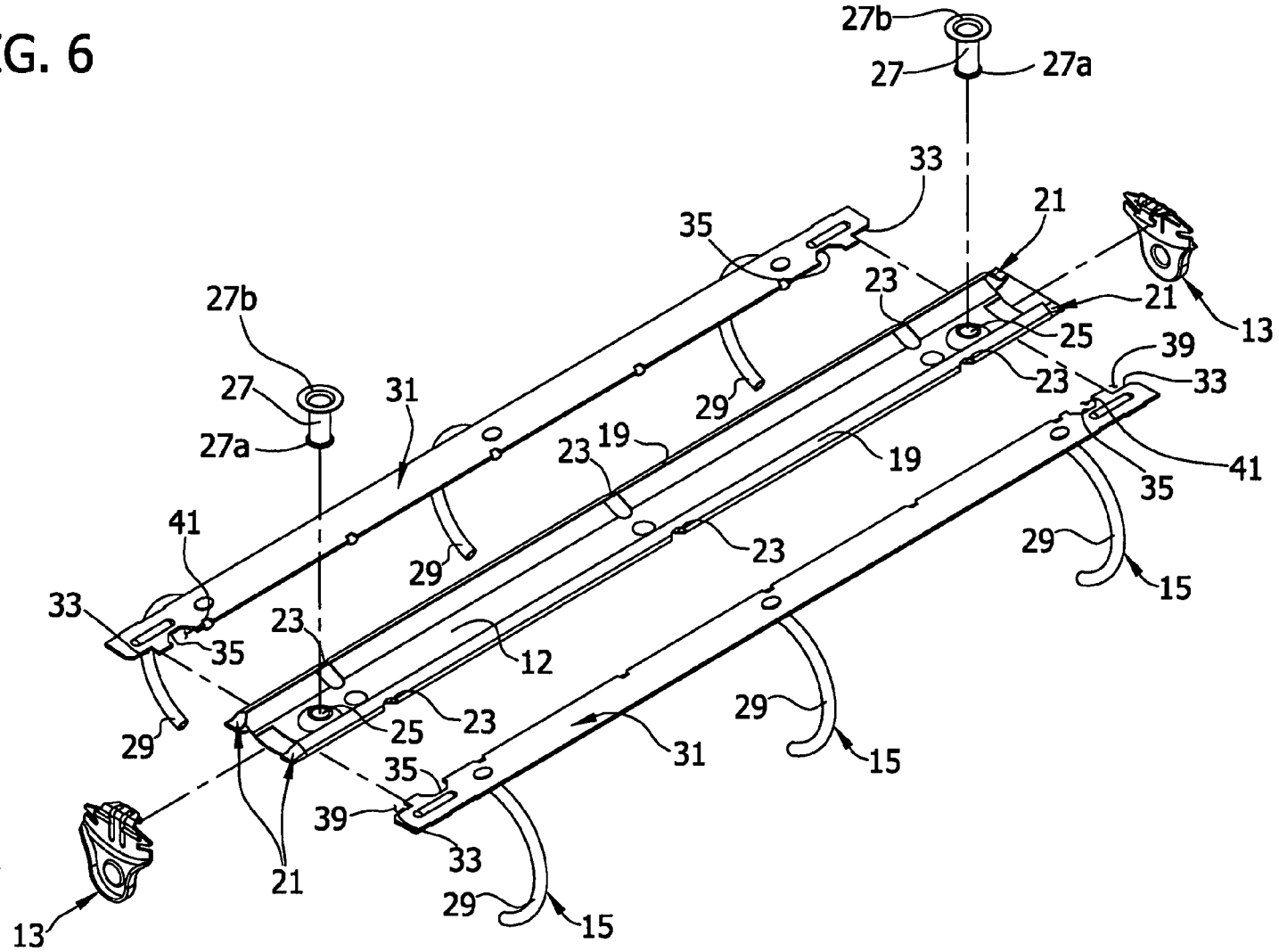
FIG. 6 is an exploded perspective of the ring binder mechanism.

As best shown in FIGS. 5 and 6, a bent under rim 19 formed along each longitudinal edge of the housing 12 extends the full length of the housing from one longitudinal end to the other. Each end of the two bent under rims 19 is pinched together with a portion of an upper surface of the housing 12 to form four pockets (each pocket being designated by reference numeral 21). Accordingly, there are two pockets 21 located at each end of the housing 12. Six total slots 23 are positioned along the two bent under rims 19. The slots 23 are arranged in three transversely opposed pairs with each pair receiving one of the rings 15 therethrough, allowing each ring to move laterally of the housing 12 for opening and closing. As shown in FIG. 6, two additional circular openings 25 are provided in the upper surface of the housing 12, near the longitudinal ends, each receiving and attaching mounting posts 27 (broadly, "connector members") to the housing 12. It is envisioned that the housing of the present invention is made of metal, but it may be made of any other suitable material that is sufficiently rigid to provide a stable mount for components of the mechanism. In addition, differently shaped housings, including asymmetrical ones, do not depart from the scope of this invention.

Figure 7:
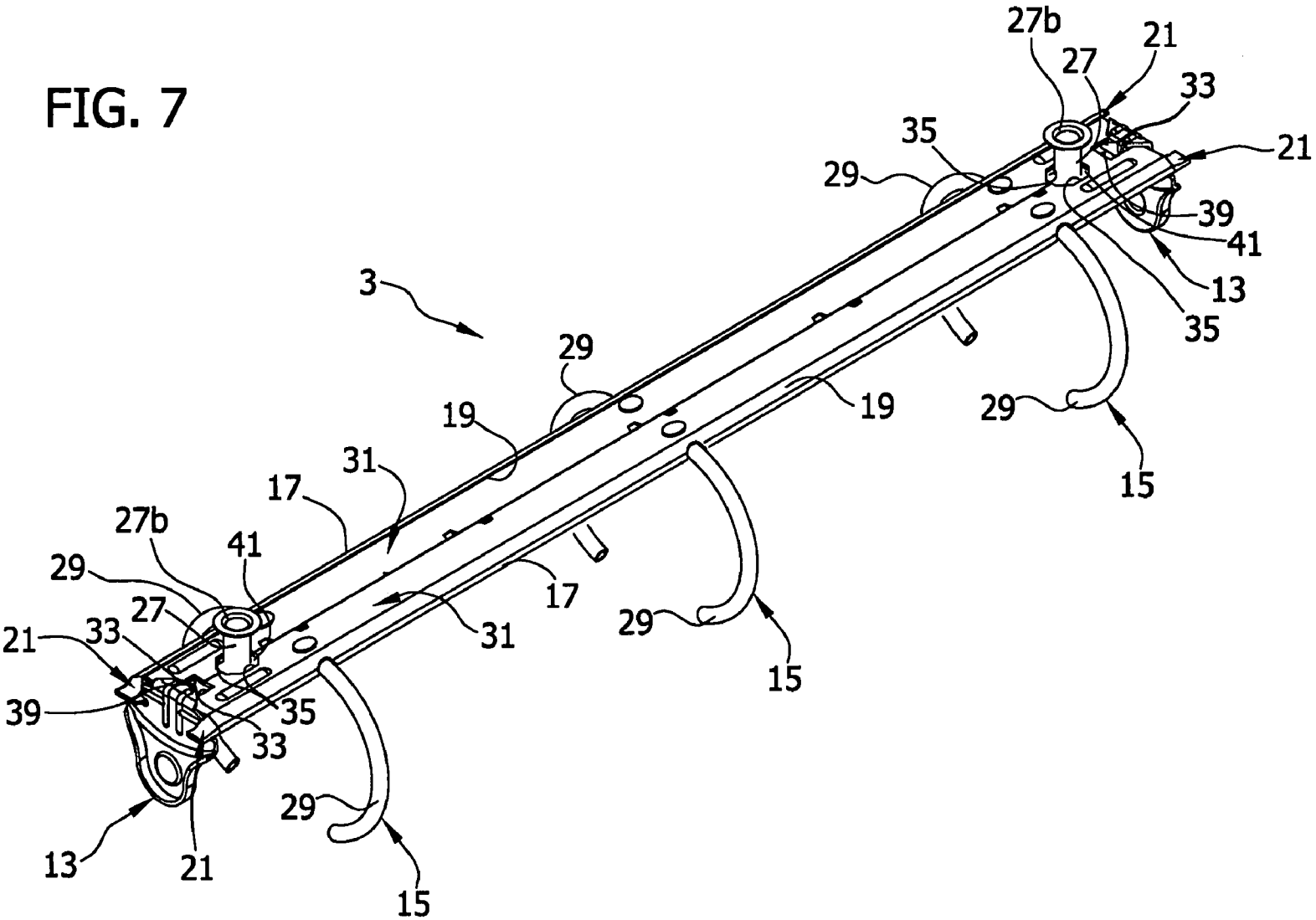
FIG. 7 is the perspective of FIG. 5 but with the ring members in an open position.

Each of the rings 15 include two ring members 29, which are supported by the housing 12 for movement relative to one another between a closed position (see FIG. 5) and an open position (see FIG. 7). In the closed position, the ring members 29 form a substantially continuous, closed, ring or loop for retaining loose-leaf pages and for allowing the pages to move along the rings 15 from one ring member 29 to the other. In the open position, the ring members 29 form a discontinuous, open loop suitable for adding or removing pages. It is envisioned that the ring members are formed of a conventional, cylindrical rod of suitable material, such as steel. But it is understood that ring members having a different cross section or ring members made of different material do not depart from the scope of the present invention. Although in the illustrated mechanism both ring members can move, mechanisms having one movable ring member and one fixed do not depart from the scope of the invention. In addition, mechanisms with greater or fewer than three rings or with rings that form other shapes, such as slanted "D" shapes, when ring members are closed, do not depart from the scope of this invention.

As shown in FIGS. 5-7, the two ring members 29 of each ring 15 are mounted opposite each other on one of a pair of hinge plates (each hinge plate being designated generally by reference numeral 31). The hinge plates 31 are each thin and elongate, having an inner and an outer longitudinal edge margin and two longitudinal ends. Each hinge plate 31 additionally includes two squared notches 33 and two rounded cutouts 35, each of which are located along the inner longitudinal edge margin of the hinge plate. The two notches 33 are each located at a respective longitudinal end of the hinge plate 31, and the two cutouts 35 are each located inward from a one of the respective notches 33 but still generally adjacent the hinge plate's ends.

Referring again to FIGS. 5 and 7, the hinge plates 31 attach to one another in parallel arrangement along their inner longitudinal edge margins, forming a central hinge having a pivot axis. The housing 12 loosely receives the outer longitudinal edge margins of the interconnected hinge plates 31 above its two bent under rims 19. Thus, the hinge plates 31 are retained on the housing 12 while the outer longitudinal edge margins are free to move within the rims 19. Corresponding notches 33 of the adjoining hinge plates align to form two box-shaped recesses 39 at opposite longitudinal ends of the plates 31. These recesses 39 are sized and shaped to interact with the actuating levers 13, as will be described in more detail hereinafter. Similarly, corresponding cutouts 35 align to form two openings 41, each sized and shaped for receiving one of the mounting posts 27 through the hinge plates 31. In the illustrated ring binder mechanism the box-shaped recesses 39 and the oval openings 41 are both symmetrically positioned about the pivot axis of the interconnected hinge plates 31. However, mechanisms in which openings and recesses are positioned differently about a pivot axis of interconnected hinge plates do not depart from the scope of the present invention.

The housing 12 is slightly narrower than the joined hinge plates 31 when the hinge plates are in a coplanar position (i.e., an angle between exterior surfaces of the hinge plates is 180°). So as the hinge plates 31 pivot through this position, they deform the resilient housing 12 and cause a spring force in the housing that urges the hinge plates 31 to pivot away from the coplanar position, either closing the ring members 29 (i.e., moving the pivot axis down and away from the housing's upper surface (FIG. 5)) or opening them (i.e., moving the pivot axis up and toward the housing's upper surface (FIG. 7)). Moreover, when the ring members 29 are closed, this spring force resists hinge plate movement and clips the ring members together. When the ring members 29 are open, the spring force holds them apart. Thus, the illustrated embodiment uses a conventional arrangement to move the hinge plates 31 and ring members 29. It will be understood that other ways of moving the rings members 29 and locking them in a closed position or open position may be used within the scope of the present invention.

Figure 8A:
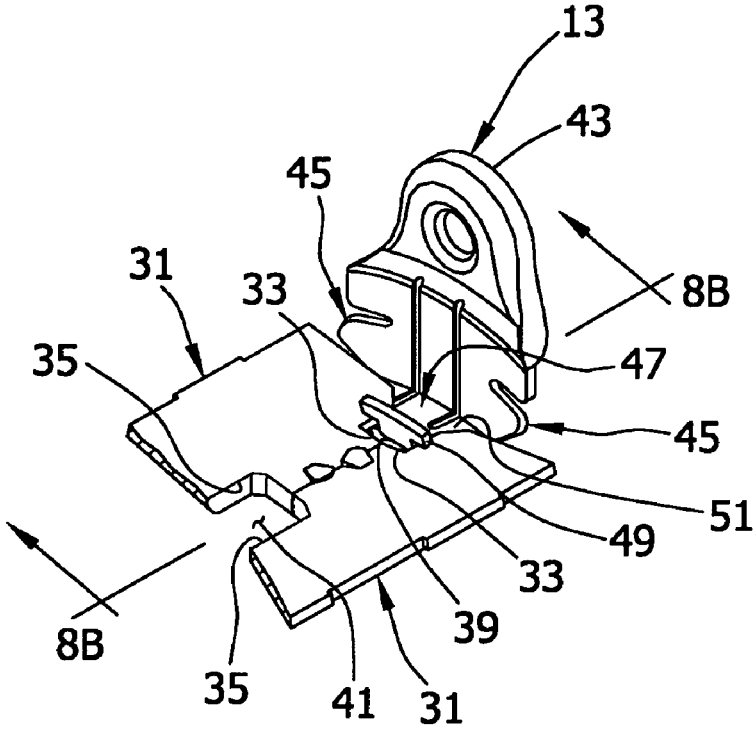
FIG. 8A is an enlarged fragmentary perspective of the ring binder mechanism with a housing removed and showing a lever connected to hinge plates.
Figure 8B:
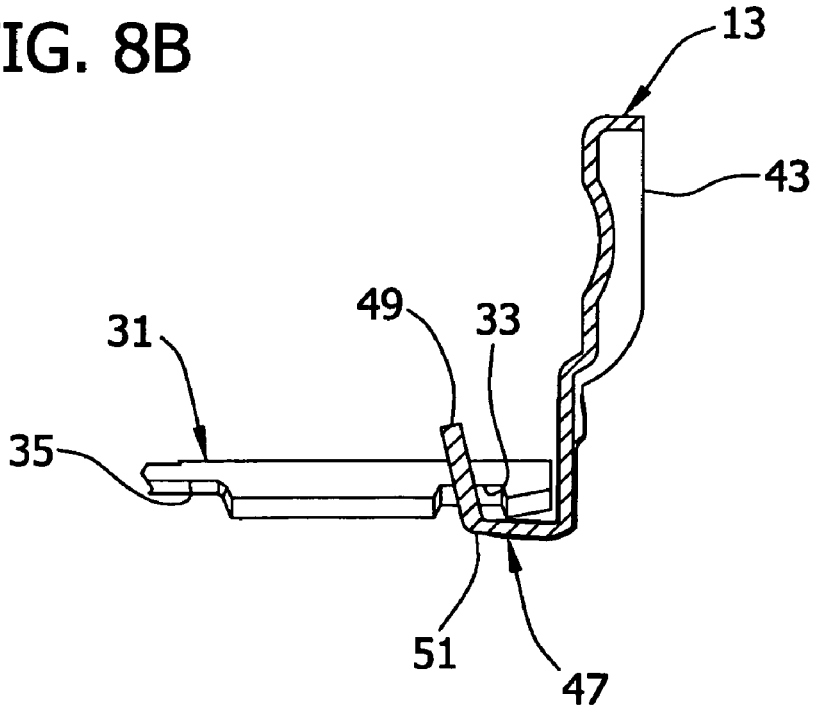
FIG. 8B is a section taken on line 8B-8B of FIG. 8A.
Figure 9:
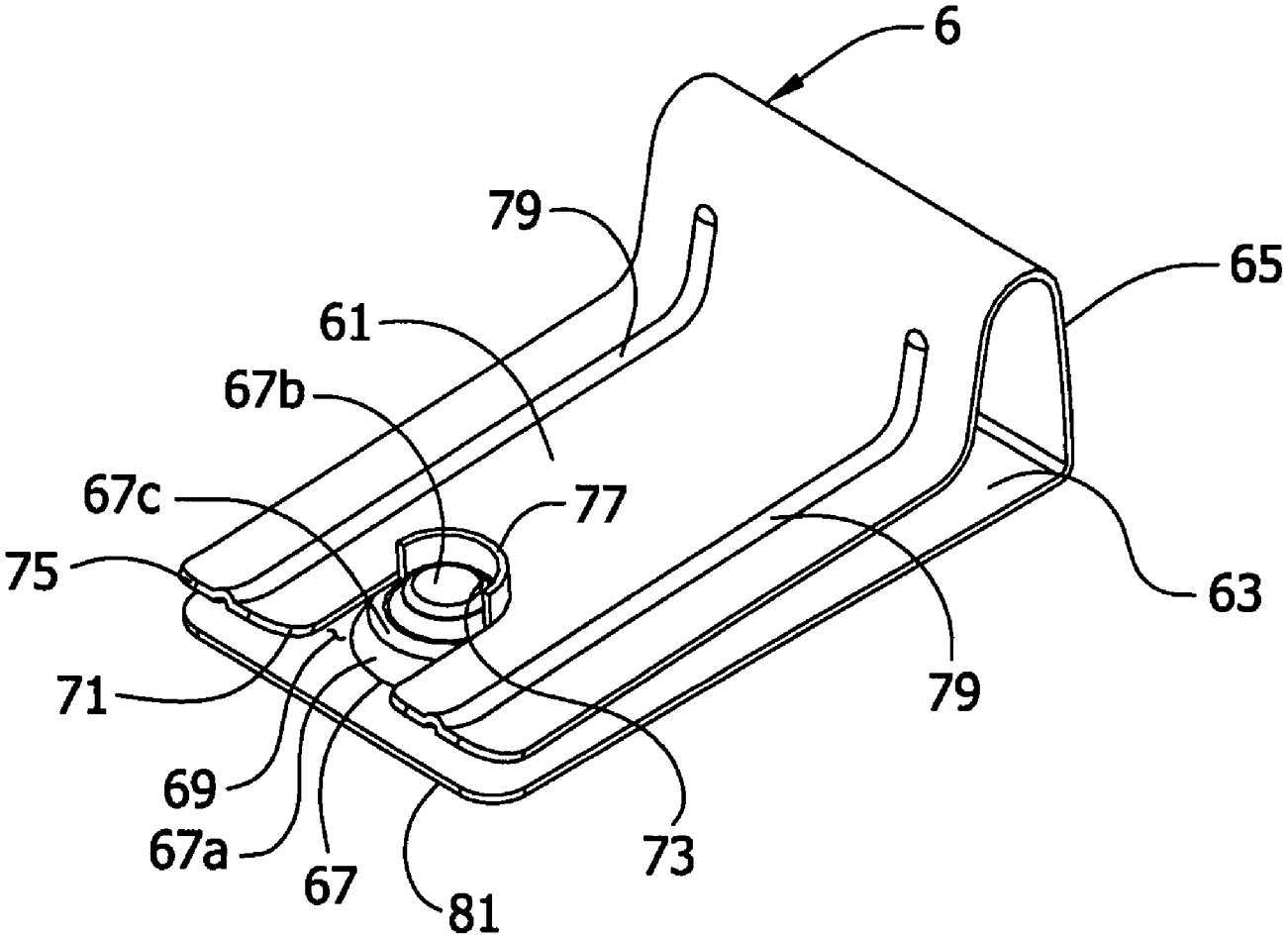
FIG. 9 is an enlarged, top side perspective of the clip.

The two actuating levers 13 are generally shown in FIGS. 1-3, 8A and 8B. Each lever 13 includes a relatively flat head 43 that extends upward, generally above the housing 12, for grasping to pivot the lever. Each additionally includes two lateral arms, each designated by reference numeral 45, and a cam, designated generally by reference numeral 47. As best shown in FIG. 8A, the lateral arms 45 extend laterally outward from opposite sides of each lever 13 below the flat head 43. The two arms 45 of each lever loosely fit within the two pockets 21 located at each longitudinal end of the housing 12, allowing the levers 13 to pivot within the pockets 21 relative to the housing about an axis transverse to the housing (FIGS. 5 and 7). Referring again to FIGS. 8A and 8B, the cam 47 of each lever is integrally attached to the lever 13 below the lateral arms 45. It extends downward from the arms 45 and curves outward from the flat head 43, fitting into one of the respective box-shaped recesses 39 of the hinge plates. An enlarged tab 49 of each cam fits loosely over the interconnected hinge plates 31 while a base 51 of each cam rests below the plates. Together, the tab 49 and base 51 capture the hinge plates 31 therebetween for operable engagement to control the pivoting motion of the hinge plates that close and open the ring members 29. In operation to close the ring members 29, the levers 13 are pivoted upward and inward. The tabs 49 engage a top surface of the hinge plates 31 and pull the pivot axis of the plates downward. To open the ring members 29, the levers 13 are pivoted outward and downward. The bases 51 engage a bottom surface of the hinge plates 31 and push the pivot axis of the plates upward. Mechanisms (not shown) having levers with different shapes or levers pivotally attached to a housing differently do not depart from the scope of the present invention. In addition, mechanisms having only one lever for driving the hinge plates do not depart from the scope of the present invention.

Figure 10:
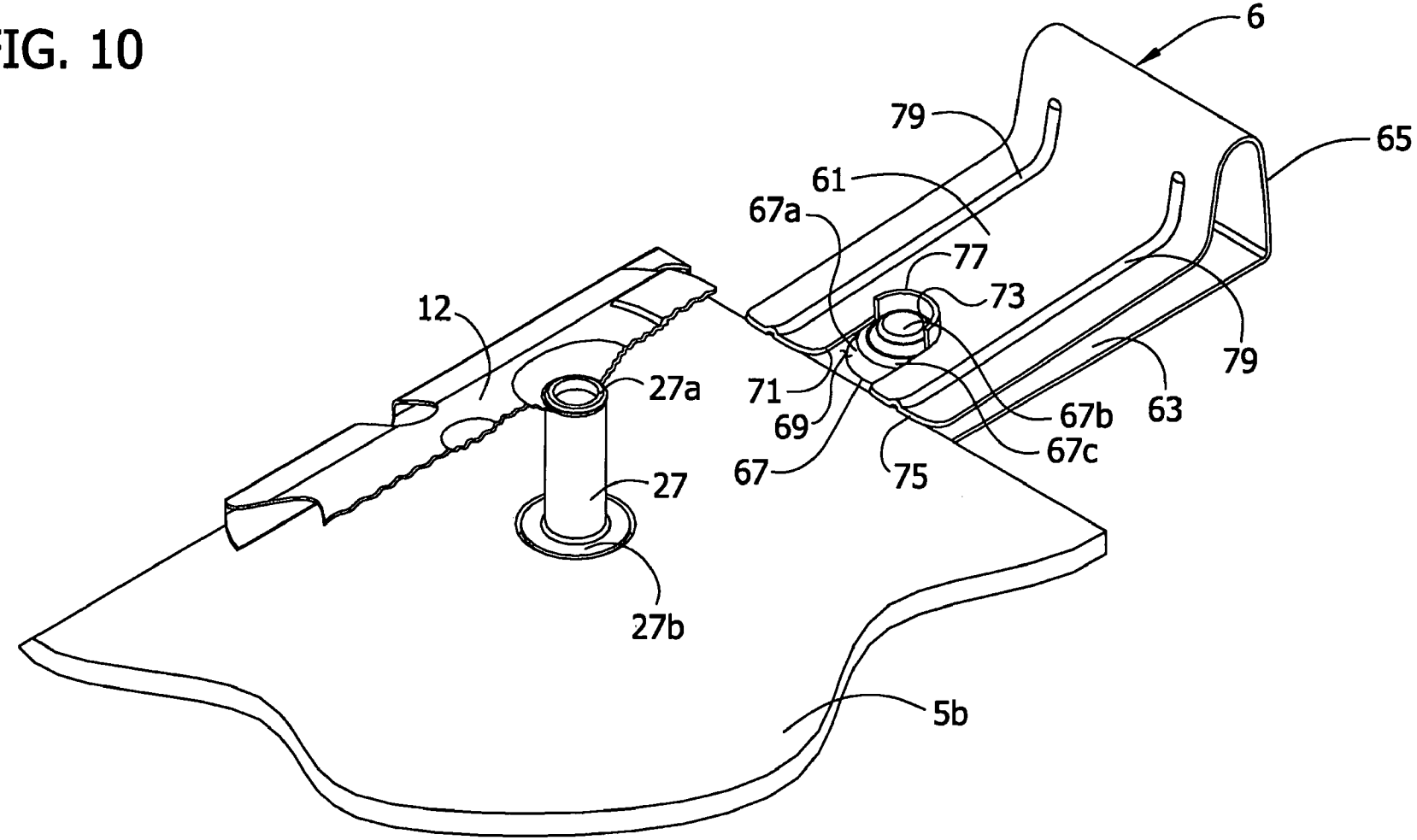
FIG. 10 is a fragmentary perspective of the ring binder mechanism engaging the cover with the clip contacting an edge of the cover.

Referring again to FIGS. 5-7, the two mounting posts 27 are located adjacent the levers 13 and space the ring binder mechanism 3 off the cover 5 so that the hinge plates 31 can pivot without engaging the back panel 5*b* of the cover. In this position, the mounting posts 27 align with the oval openings 41 of the interconnected hinge plates 31 and pass through the hinge plates without interfering with their operation. Each mounting post 27 includes a tubular body defining an interior space and two open longitudinal ends. A first end includes a deformable lip 27*a* for attaching the mounting post to one of the circular openings 25 in the upper surface of the housing 12 (FIG. 10). It will be understood that other ways of attaching the mounting posts 27 to the housing 12 may be used without departing from the scope of the present invention. Referring again to FIGS. 5-7, a second end includes a flange 27*b* that extends outwardly from the mounting post 27. The flange can have other shapes and configurations without departing from the scope of this invention.

Figure 3:
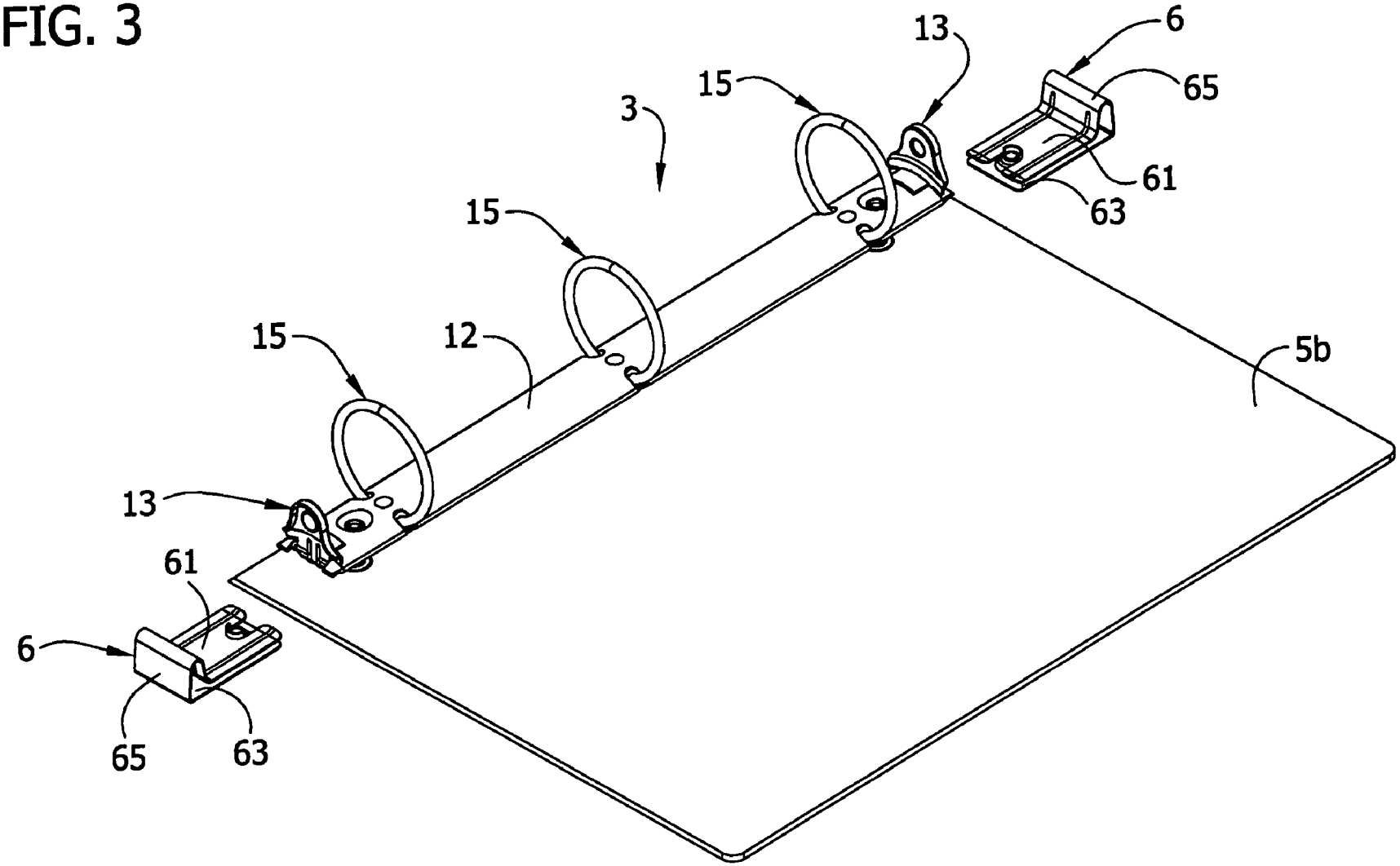
FIG. 3 is a perspective similar to the one shown in FIG. 2 except the ring binder mechanism is shown engaging the back panel of the cover.
Figure 4:
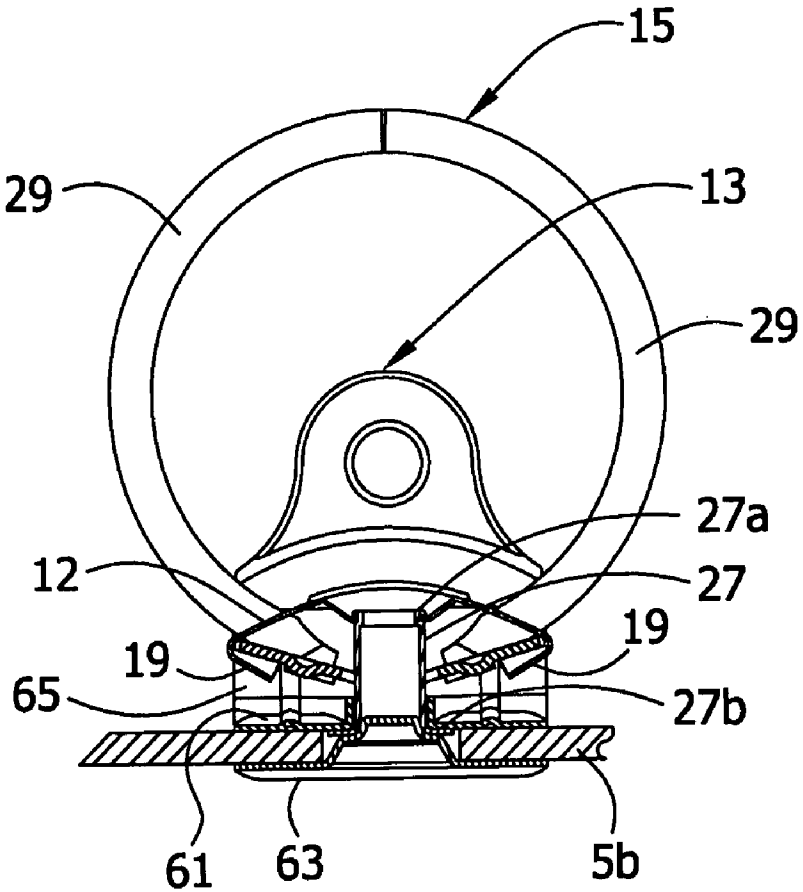
FIG. 4 is a section taken on line 4-4 of FIG. 1.

As illustrated in FIGS. 1-3, the ring binder mechanism 3 is securely attached to the back panel 5*b* of the cover 5 using two clips 6. The clips 6 are sized and shaped to slide onto the back panel 5*b* of the cover 5 and engage respective mounting posts 27 for securing both the clips and the mounting posts to the back panel. Since the clips 6 are substantially identical, only one will be described in detail. The use of two differently configured clips with the same ring binder mechanism and cover would not depart from the scope of the present invention. The clip 6, as shown in FIGS. 9-12, comprises a first portion 61, a second portion 63, and an intermediate portion 65 connecting the upper and second portions. The first and second portions 61, 63 are resiliently biased toward one another so that when the clip 6 is received on the back panel 5*b* of the cover 5 the clip can secure the mounting post 27 and thereby the ring binder mechanism 3 to the cover. In other words, the first and second portion 61, 63 are adapted to squeeze the mounting post 27 and the cover 5 together. The first and second portions 61, 63 define generally flat opposing surfaces that lie generally in parallel planes. The spacing between the surfaces of the upper and second portions 61, 63 is slightly less than the thickness of the cover 5. The clip 6 of the illustrated configuration is formed from a single-piece of generally flat sheet metal. But it is understood that the clip 6 can be formed from more than one piece without departing from the scope of this invention.

Figure 12:
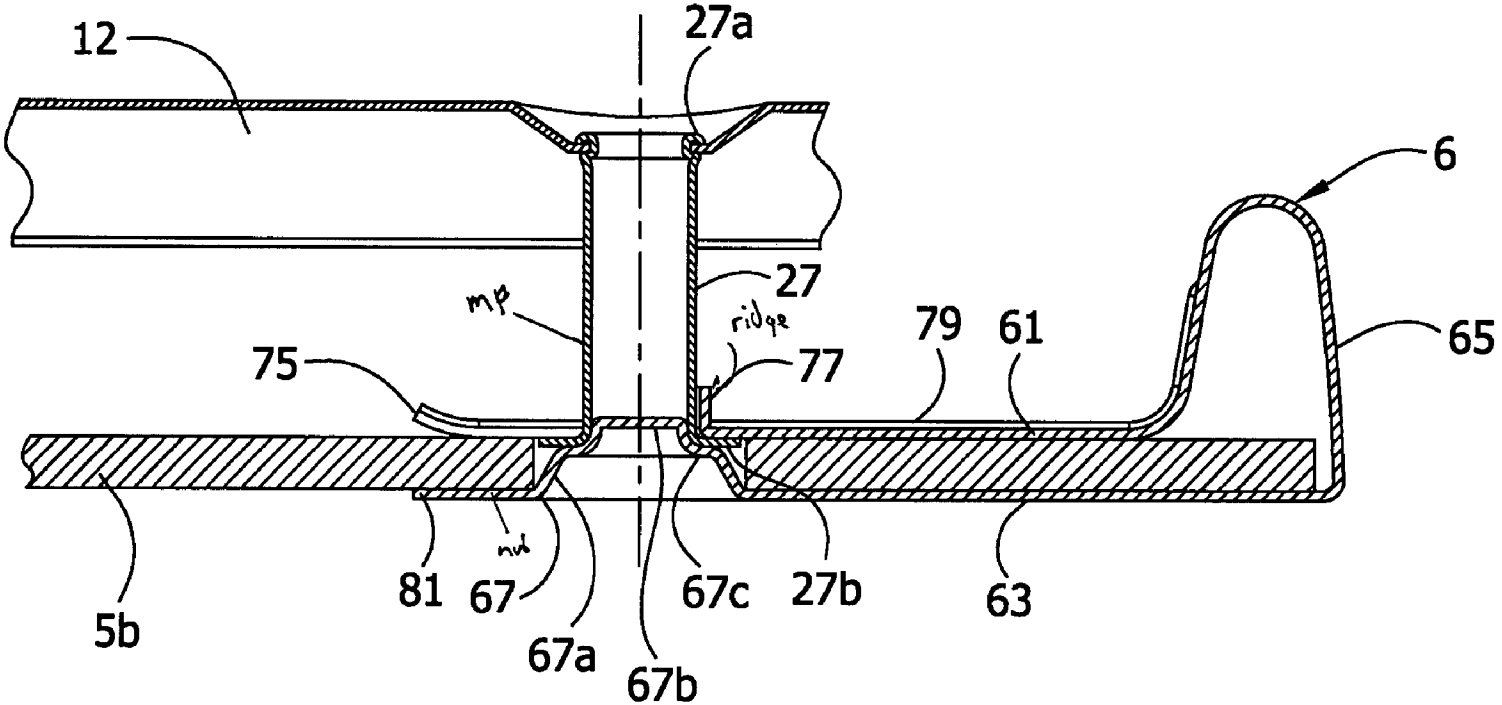
FIG. 12 is a section taken on line 12-12 of FIG. 11.

The second portion 63 is formed with a seat for receiving the flange 27*b* of one of the mounting posts 27. The seat comprises a generally conical nub 67 extending upwardly from the second portion. As best shown in FIG. 12, the nub 67 includes a base portion 67*a*, a top portion 67*b*, and a shelf 67*c* separating the base and top portions. When engaged with the mounting post 27, the flange 27*b* of the mounting post 27 rests on the shelf 67*c* and the top portion 67*b* extends partially into the interior space of the mounting posts. When the clip 6 is attached to the cover 5, the nub 67 is received in one of the apertures 7 in the cover and the most of the remainder of the second portion 63 is in face-to-face relationship with an exterior surface of the cover.

The first portion 61 includes a slot 69 having an open end 71 and a closed bottom end 73. The slot 69 is sized and shaped for receiving one of the mounting posts 27 and extends from a free outer edge 75 of the first portion to slightly past the top 67*b* of the nub 67 so that the flange 27*b* on the mounting post can be engaged with the nub. A reinforcing ridge 77 is positioned adjacent the closed bottom end 73 of the slot 69 for engaging the mounting post 27 when the clip 6 is positioned on the cover 5. The first portion 61 is bent slightly upward away from the second portion 63 adjacent the outer free edge 75 for allowing the clip 6 to slide more easily onto the cover 5 as described in move detail below. The first portion 61 also includes two elongate ribs 79 extend generally lengthwise of the first portion on opposite sides of the slot 69 to strengthen the first portion against bending about an axis transverse to the first portion of the clip 6. When the clip 6 is positioned on the cover 5, the surface of the first portion 61 is in face-to-face relationship with an interior surface of the cover.

The intermediate portion 65 yieldably and resiliently resists movement of the first and second portions 61, 63 with respect to one another to prevent the clip 6 from inadvertently disengaging the mounting post 27 and/or cover 5. In the illustrated configuration, the intermediate portion 65 extends from the second portion 63 past the plane of the first portion 61 and thence back to the first portion. As a result, the intermediate portion 65 defines a grip projecting up from the first portion 61 for gripping the clip. The grip makes it easier for a user to engage and disengage the clip from the cover. Moreover, when the clip 6 is positioned on the cover 5, the intermediate portion 65 provides a guard protecting a user's fingers from the ends of the ring binder, which may potentially have sharp edges. In addition, the intermediate portion 65 covers and protects a portion of an edge of the cover 5. It is understood that in other configurations of the clip 6, the intermediate portion can connect the first and second portions 61, 63 without extending beyond the plane of the first portion.

The ring binder 1 of the illustrated embodiment can be assembled by aligning the ring binder mechanism 3 with respect to the cover 5 so that the flanges 27*b* of the mounting posts 27 are received in the apertures 7 in the back panel 5*b* of the cover 5 (FIGS. 3 and 10). The clips 6 are slid onto the cover 5 one at a time. Since both clips 6 are attached to the cover 5 in the same way, only one is described herein. The free outer edge 75 of the first portion 61 of the clip 6 is placed against an upper edge of the cover and a free outer edge 81 of the second portion 63 is placed against a lower edge of the cover. The clip 6 is pushed toward the ring binder mechanism 3 so that the first portion 61 slides over the interior surface of the cover 5 and the second portion 63 sides over the exterior surface of the cover. The bent surface at the outer free edge 75 of the first portion 61 acts as an inclined surface and facilities sliding the clip 6 onto the cover 5 by wedging the first and second portions apart. As the clip 6 slides on the cover 5, the second portion 63 pivots about the intermediate portion 65 and deflects away from the first portion 61 to allow the nub 67 to slide along the exterior surface of the cover. The slot 69 receives the mounting post 27 into engagement with the ridge 77 at the closed bottom end 73 of the slot. The nub 67 eventually moves into registration with the aperture 7 and the resiliency of the clip 6 causes the nub to snap into the aperture.

Figure 11:
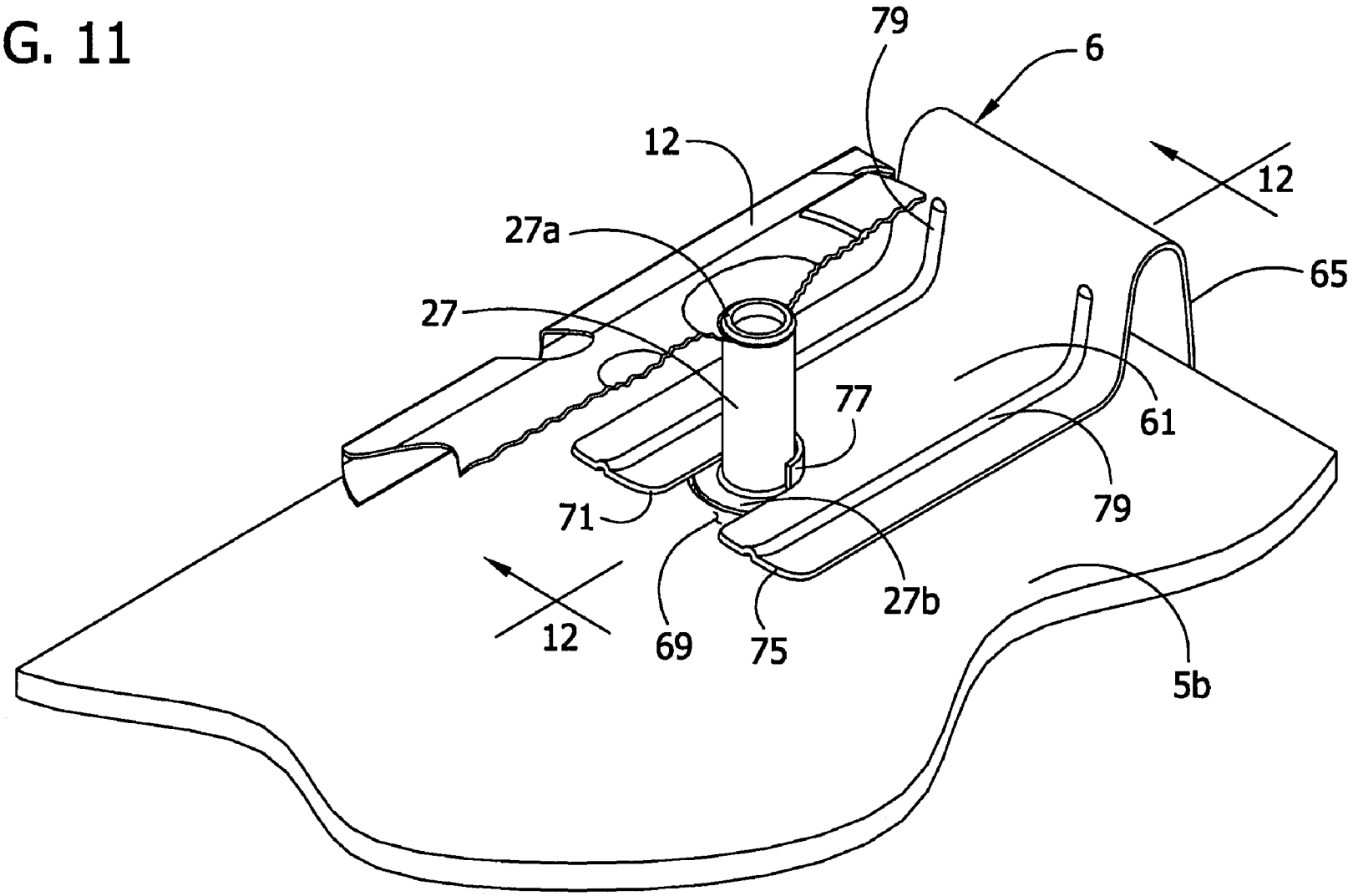
FIG. 11 is a fragmentary perspective similar to FIG. 10 except the clip is received on the cover and secures the ring binder mechanism to the cover.

Referring to FIGS. 1, 11, and 12, once in place the clip 6 secures the ring binder mechanism 3 to the cover 5. The nub 67 of the second portion 63 is received in the aperture 7 of the cover 5 to inhibit axial movement of the clip. The flange 27*a* of the mounting post 27 is received on the shelf 67*c* of the nub 67 and the top portion 67*a* of the nub is received in the interior space of the mounting post. The first portion 61 cooperates with the shelf 67*c* of the nub 67 to securely hold the flange 27*a* of the mounting post 27. Another clip can be secured to the other mounting post in the same way. Once both clips 6 are in place, the ring binder mechanism 3 is securely affixed to the cover 5.

The ring binder mechanism 3 can be separated from the cover 5 by disengaging both clips 6 from the ring binder mechanism and the cover. One way to remove one of the clips 6 from the ring binder mechanism 3 and the cover 5 is to deflect the second portion 63 of the clip 6 a sufficient amount to allow the nub 67 to clear the aperture 7 in the cover 5. The second portion 63 can be deflected either manually or with a tool (not shown). Once the nub 67 is deflected beyond the aperture 7, the clip 6 can be slid off the cover 5. The clip 6 can also be removed by grasping the intermediate portion 65 of the clip 6 and pulling the clip longitudinally away from the ring binder mechanism 3 and the cover 5. The sloped sides of the nub 67 slide along the edge of the respective aperture 7 in the cover 5 causing the first and second portions 61, 63 of the clip 6 to deflect away from each other as the clip is pulled off the cover and away from the mounting post 27 of the ring binder mechanism. Once both clips 6 have been removed, the ring binder mechanism 3 can be easily separated from the cover 5 by removing the flanges 27*b* of the mounting posts 27 from the apertures 7 in the cover.

Accordingly, ring binders 1 of the present invention can be packaged, shipped, stored and/or sold without having the ring binder mechanism 3 attached to the cover 5. For example, the covers 5 can be packaged such that little space between adjacent covers is wasted. This can be done by lying the covers 5 flat such that the front panel 5*a*, back panel 5*b*, and spine 5*c* are all substantially in the same plane and stacking others on top. The ring binder mechanisms 3 can be packaged in the same container as the covers 5 or separately. Either way, the ring binder mechanism 3 can be arranged to minimize wasted space. One possible packing arrangement for the ring binder mechanisms 3 is to pack them in alternating directions such that the rings 15 of one mechanism are positioned between the rings of an adjacent mechanism. The clips 6 can be packaged with the cover 5, the ring binder mechanisms 3 or in a separate container. The separated covers 5 and ring binder mechanisms 3 can be packaged, shipped, and stored more efficiently and cost effectively than covers having the ring binder mechanisms attached.

The ring binder mechanism 3 and covers 5 can be attached, for example, by the retailer prior to transferring them to a customer (i.e., after a sale) or before placing them on display. It is also understood that the customer may wish to maintain the ring binder mechanism 3 and covers 5 separately to take advantage of the saved storage space. Thus, the customer may be the one who attaches the ring binder mechanism 3 to the cover 5. Accordingly, it is understood that the ring binder mechanism 3 and cover 5 of the present invention can be joined to form a ring binder 1 at any of various times. The examples of the ring binder mechanism 3 being attached to the cover 5 by a retailer and an end user are exemplary only as it is understood that other individuals, including the ring binder manufacturer, may assemble the ring binder. It is also understood that the ring binder mechanism could be attached to the cover using an automated process as well as the manual process described herein.

Figure 13:
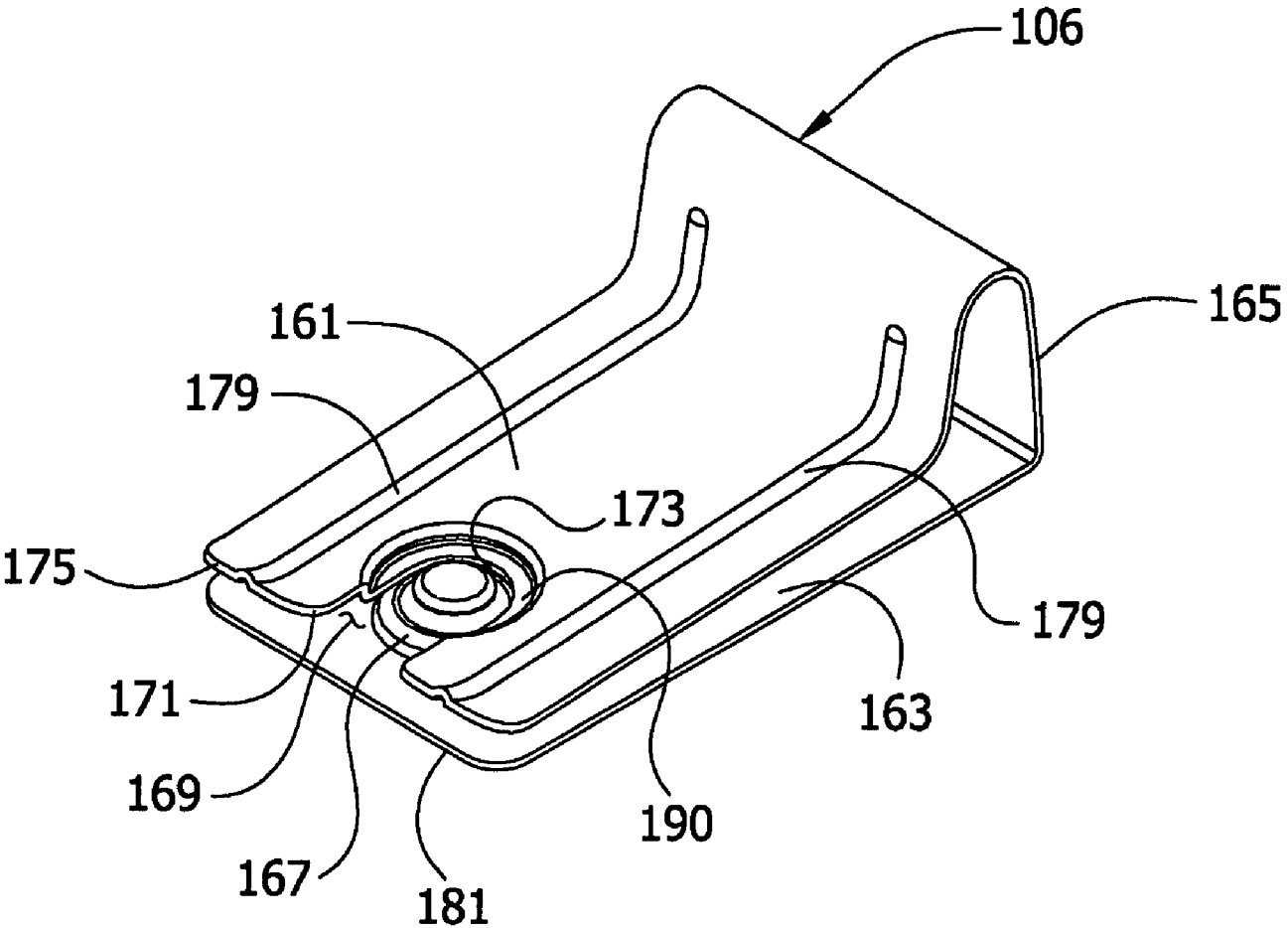
FIG. 13 is a perspective of a clip having another configuration.
Figure 14:
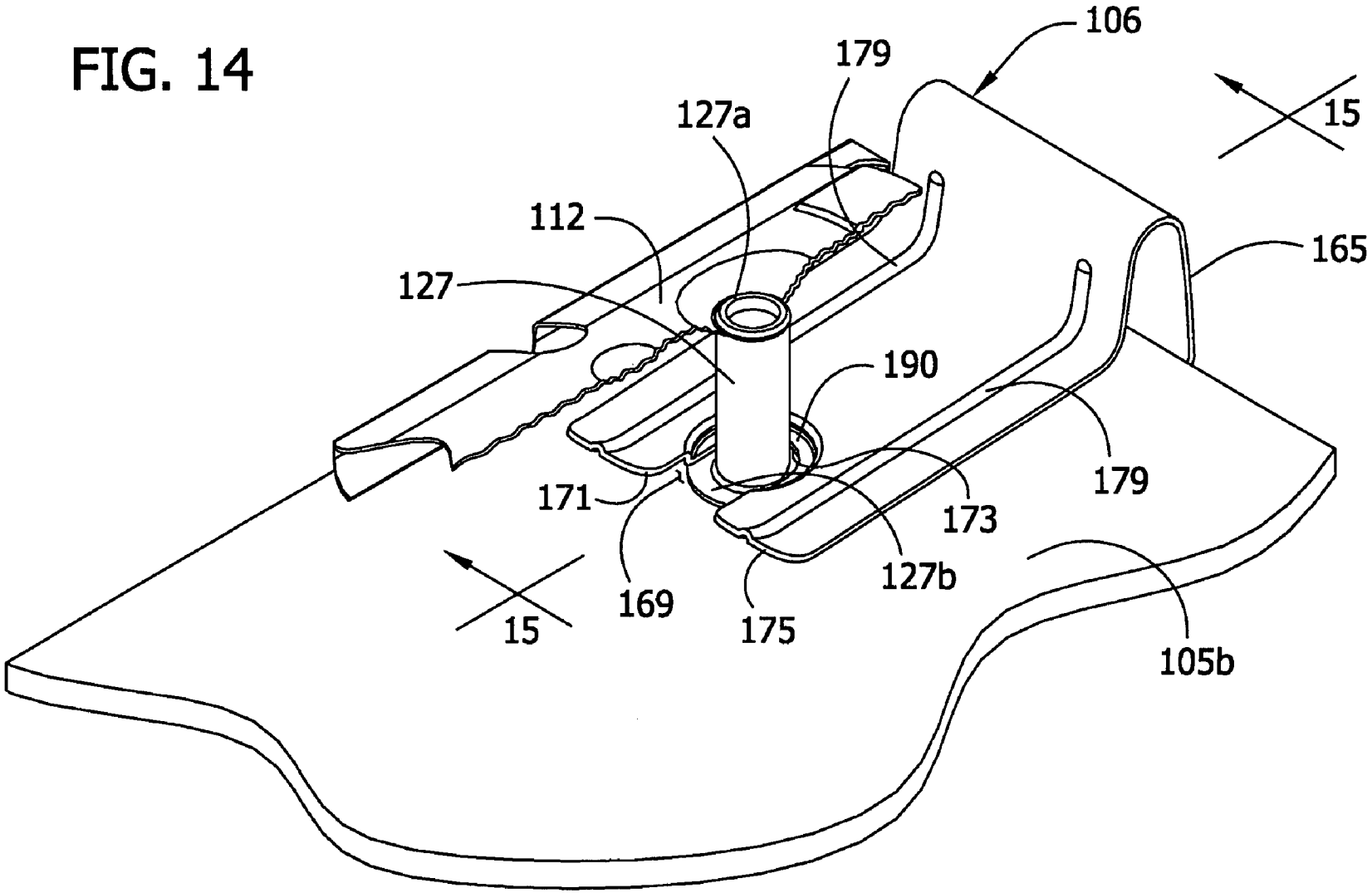
FIG. 14 is a fragmentary perspective similar to FIG. 11, but showing the clip of the FIG. 13 configuration.
Figure 15:
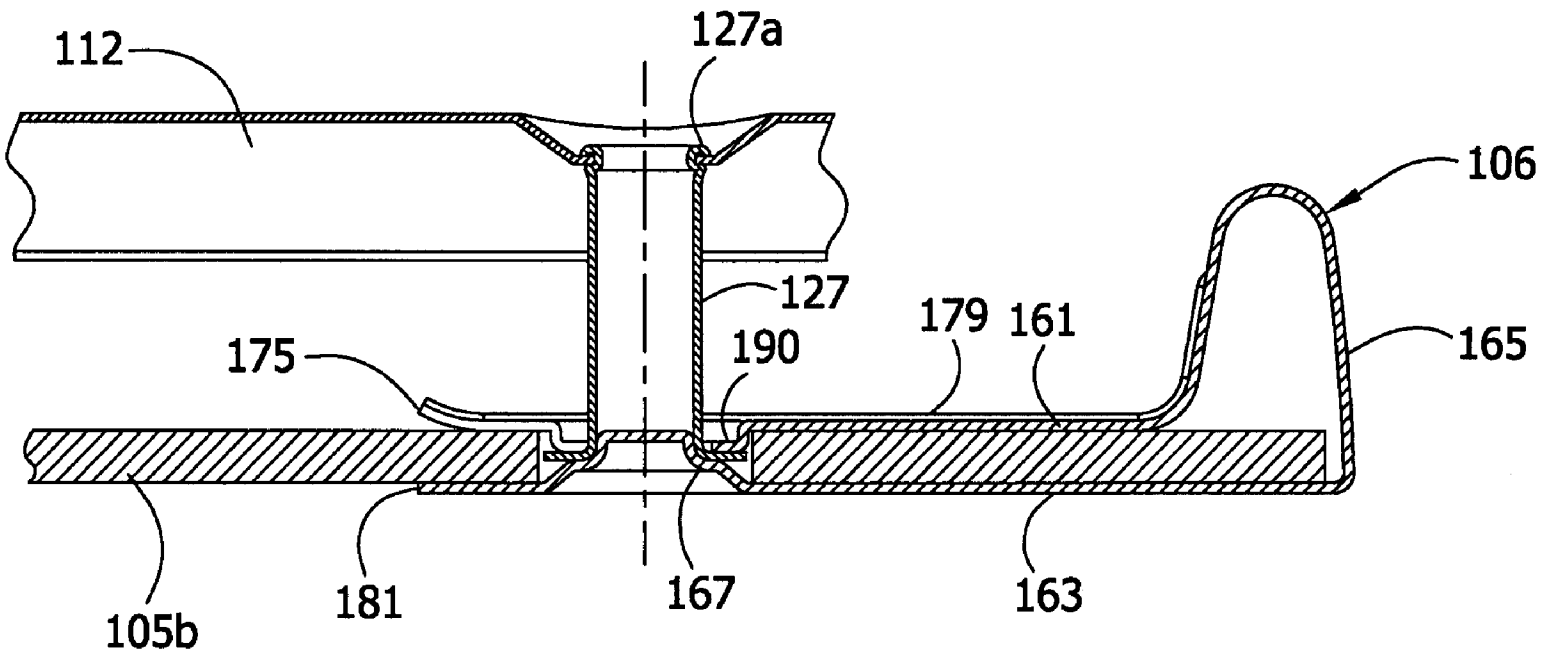
FIG. 15 is a section taken on line 15-15 of FIG. 14.
Figure 16:
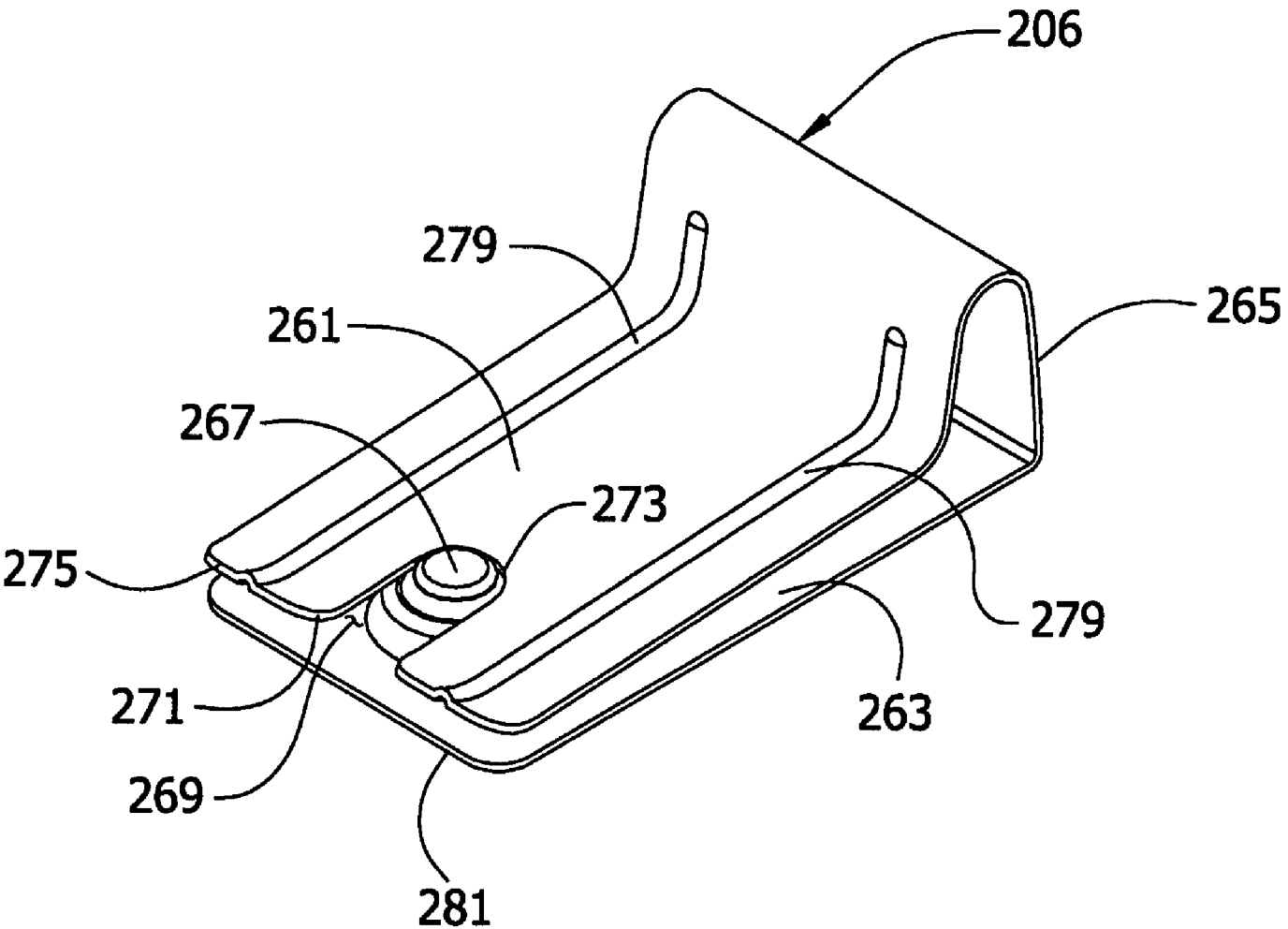
FIG. 16 is a perspective of a clip having yet another configuration.
Figure 17:
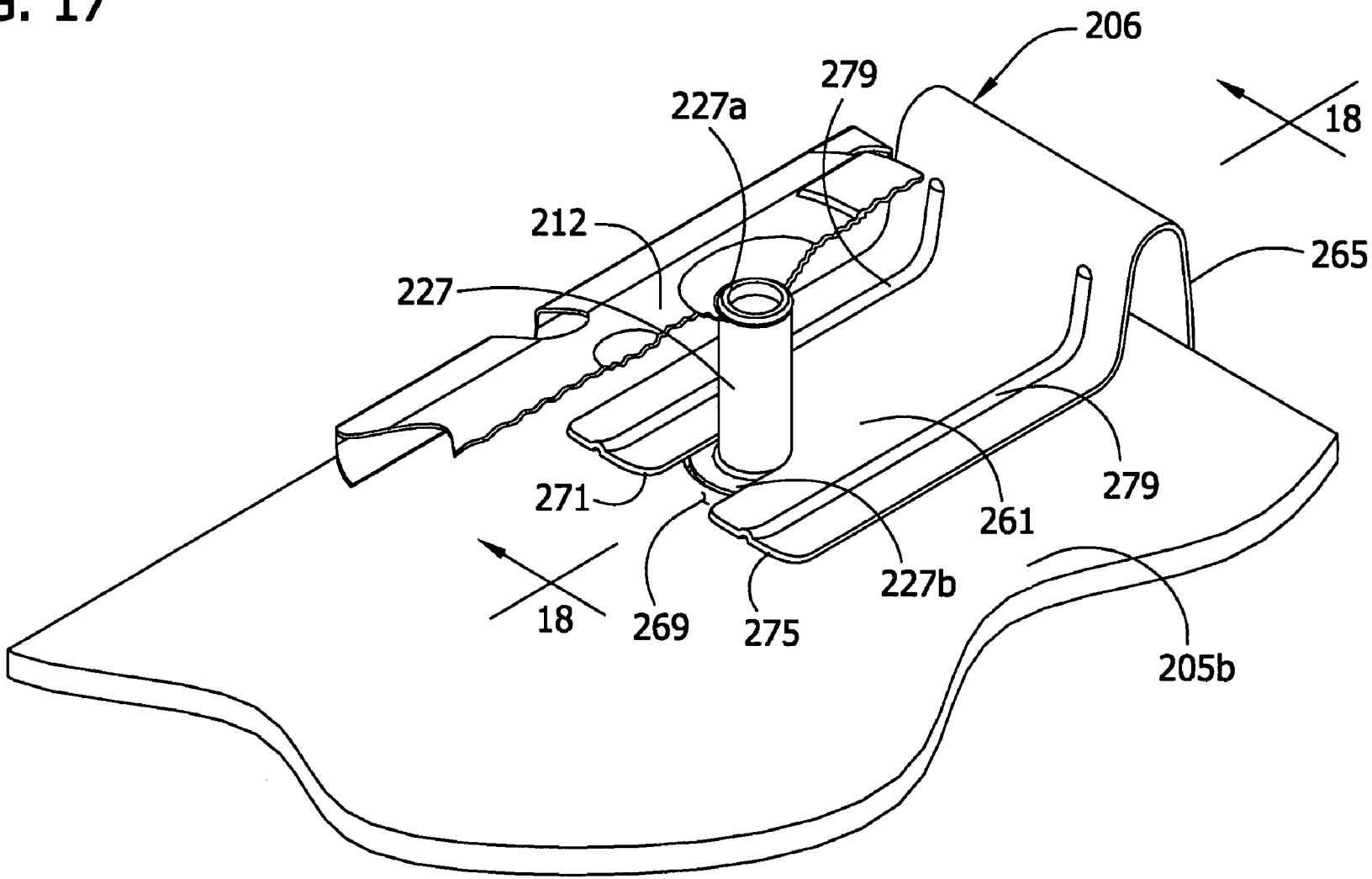
FIG. 17 is a fragmentary perspective similar to FIG. 11, but showing the clip of the FIG. 16 configuration.
Figure 18:
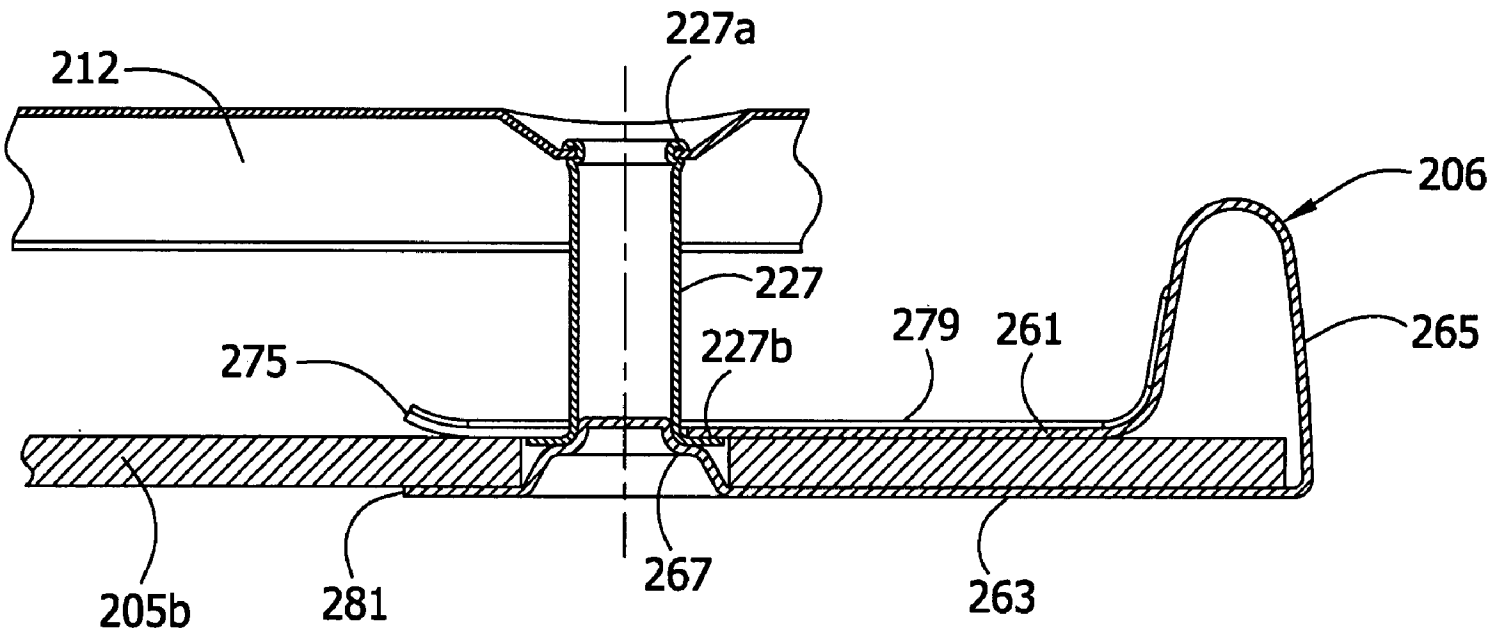
FIG. 18 is a section taken on line 18-18 of FIG. 17.
Figure 19:
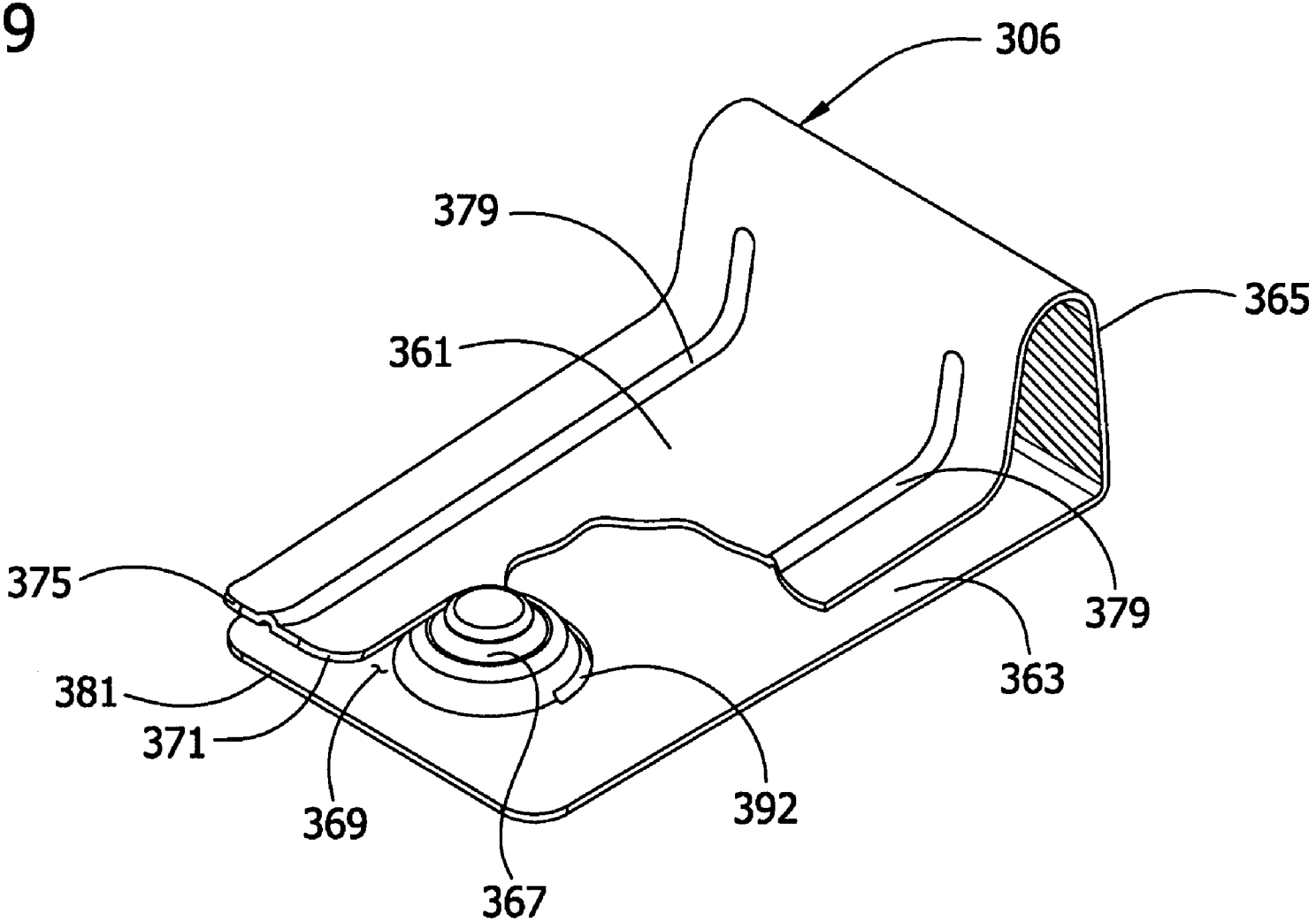
FIG. 19 is a perspective of a clip having still another configuration, part of the clip being broken away.
Figure 20:
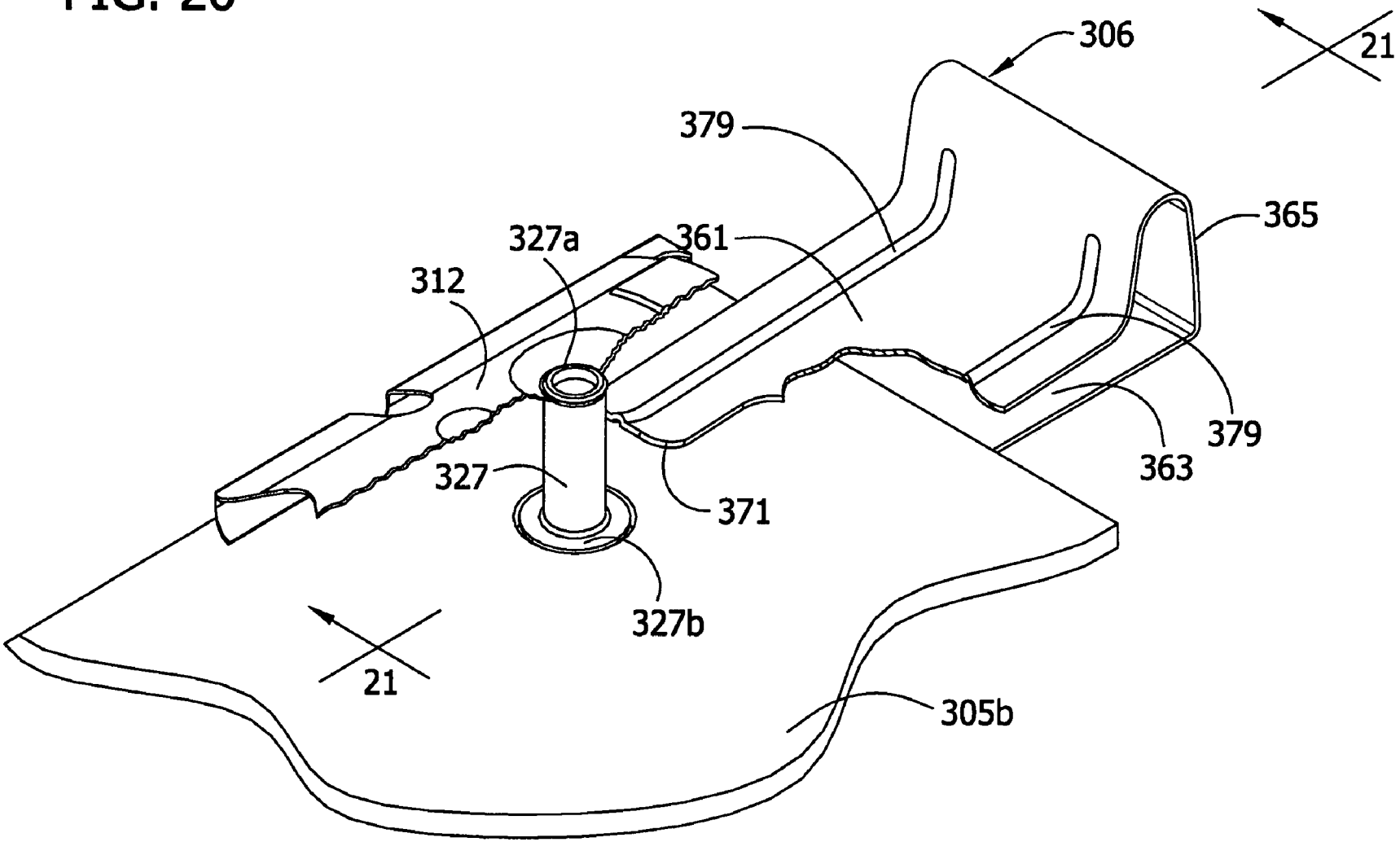
FIG. 20 is a fragmentary perspective showing the clip of the FIG. 19 configuration being slid onto a cover.
Figure 21:
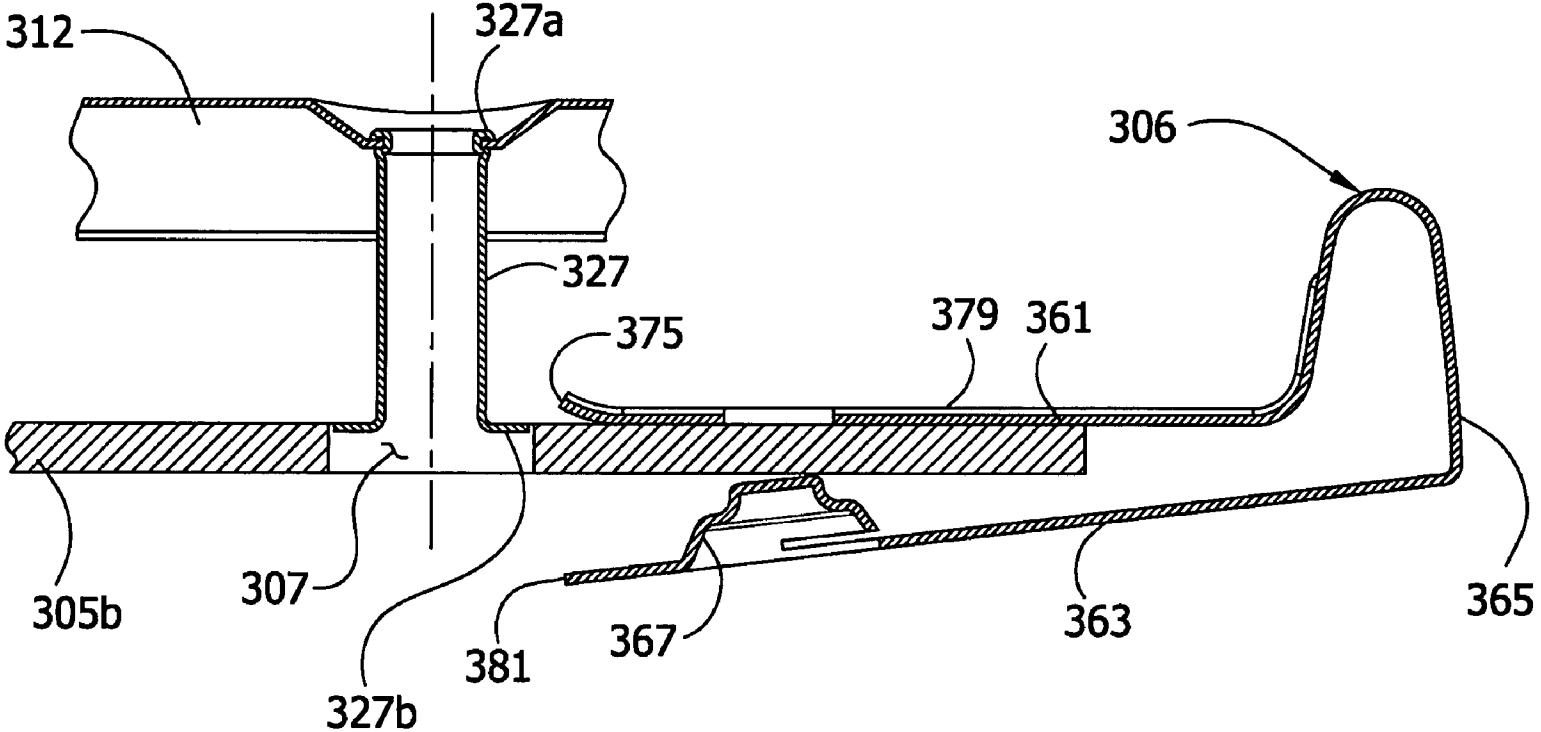
FIG. 21 is a section taken on line 21-21 of FIG. 20.
Figure 22:
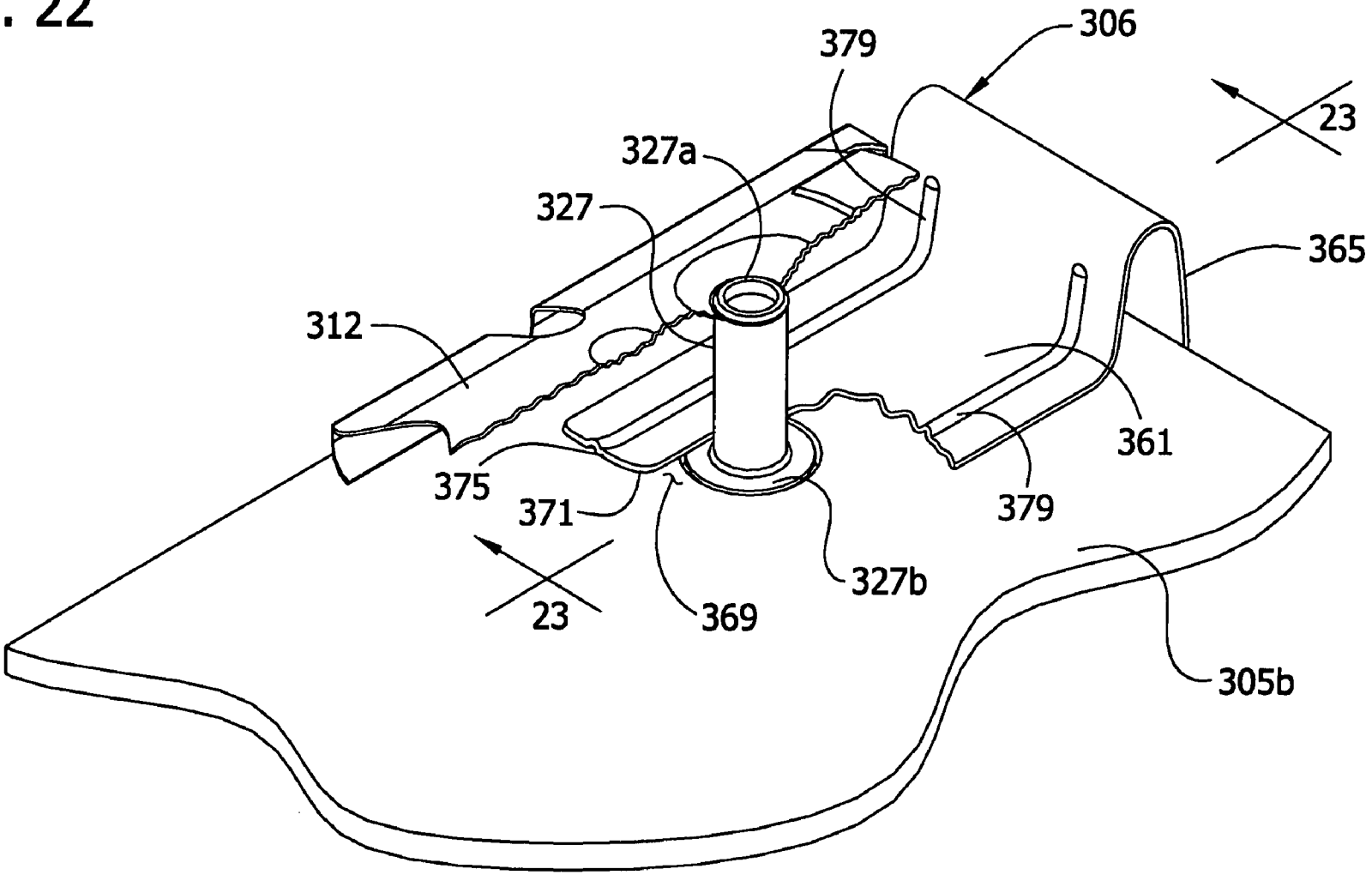
FIG. 22 is a fragmentary perspective similar to FIG. 11, but showing the clip of the FIG. 19 configuration.
Figure 23:
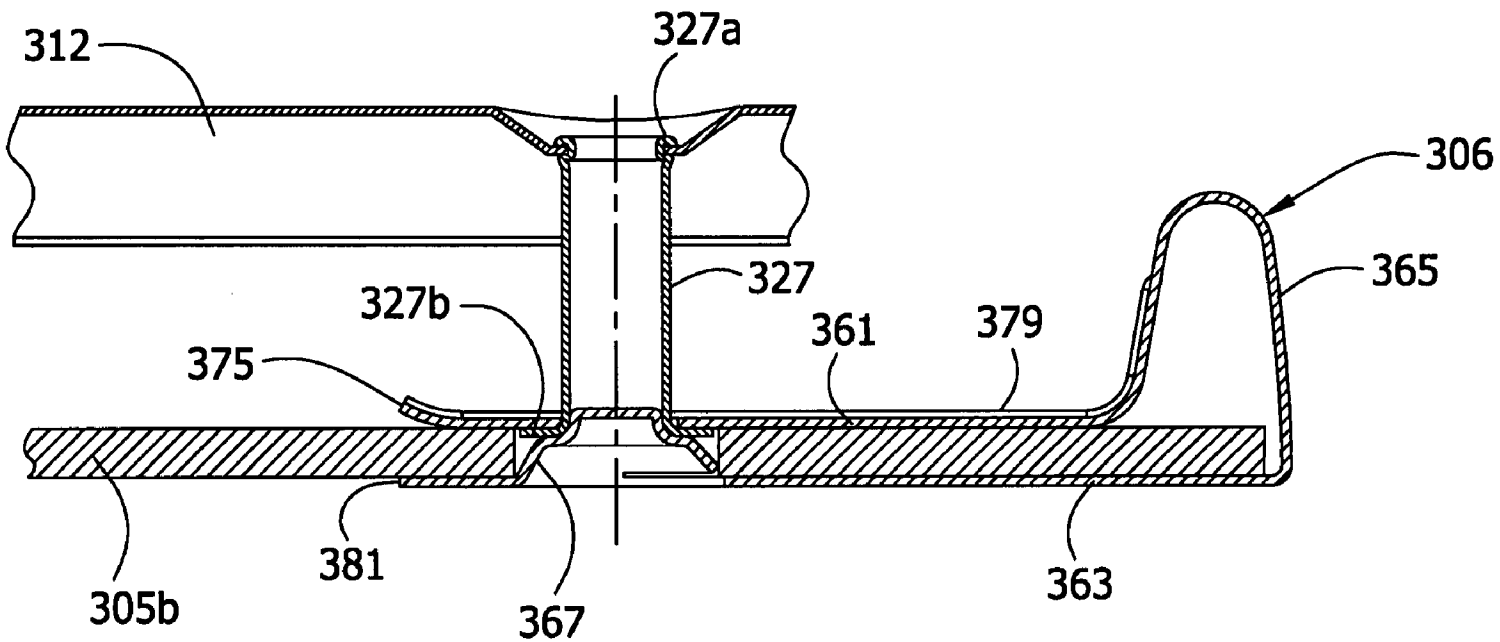
FIG. 23 is a section taken on line 23-23 of FIG. 21.

FIGS. 13-15 show a configuration of a clip 106 substantially similar to the previous described clip 6 except that a recess 190 is located adjacent a slot 169 in a first portion 161 of the clip. The recess 190 is sized and shaped for cooperating with a nub 167 to secure a flange 127*b* of a mounting post 127 in an aperture 107 in a cover 105. The recess 190 (as best seen in FIG. 15) extends down into the aperture 107 to clamp the flange 127*b* against the nub 167. As a result, this configuration supports the flange 127*b* of the mounting post 127 about midway through the cover aperture 107. Corresponding parts are indicated by the same reference numbers used in FIGS. 1-12 plus "100". FIGS. 16-18 show another configuration of a clip 206 substantially similar to the clip of FIGS. 1-12. However, the ridge 77 adjacent the slot 69 of the clip 6 of FIGS. 1-12 is not present in this configuration. In this configuration, as best shown in FIG. 17, a closed bottom end 273 of a slot 269 engages a mounting post 227 when the clip 206 is positioned on a cover 205. Parts corresponding to those in FIGS. 1-12 are indicated by the same reference numbers plus "200". FIGS. 19-23 show yet another configuration of a clip 306 substantially similar to the clip 6 of FIGS. 16-18. In this configuration, however, a slit 392 is located along adjacent a nub 67 located on a second portion 363 of the clip 306 for allowing the nub to deflect relative to the second portion as it is being slid over an exterior surface of a cover 305 (FIG. 21). Parts corresponding to those in FIGS. 1-12 are indicated by the same reference numbers plus "300".

Figure 24:
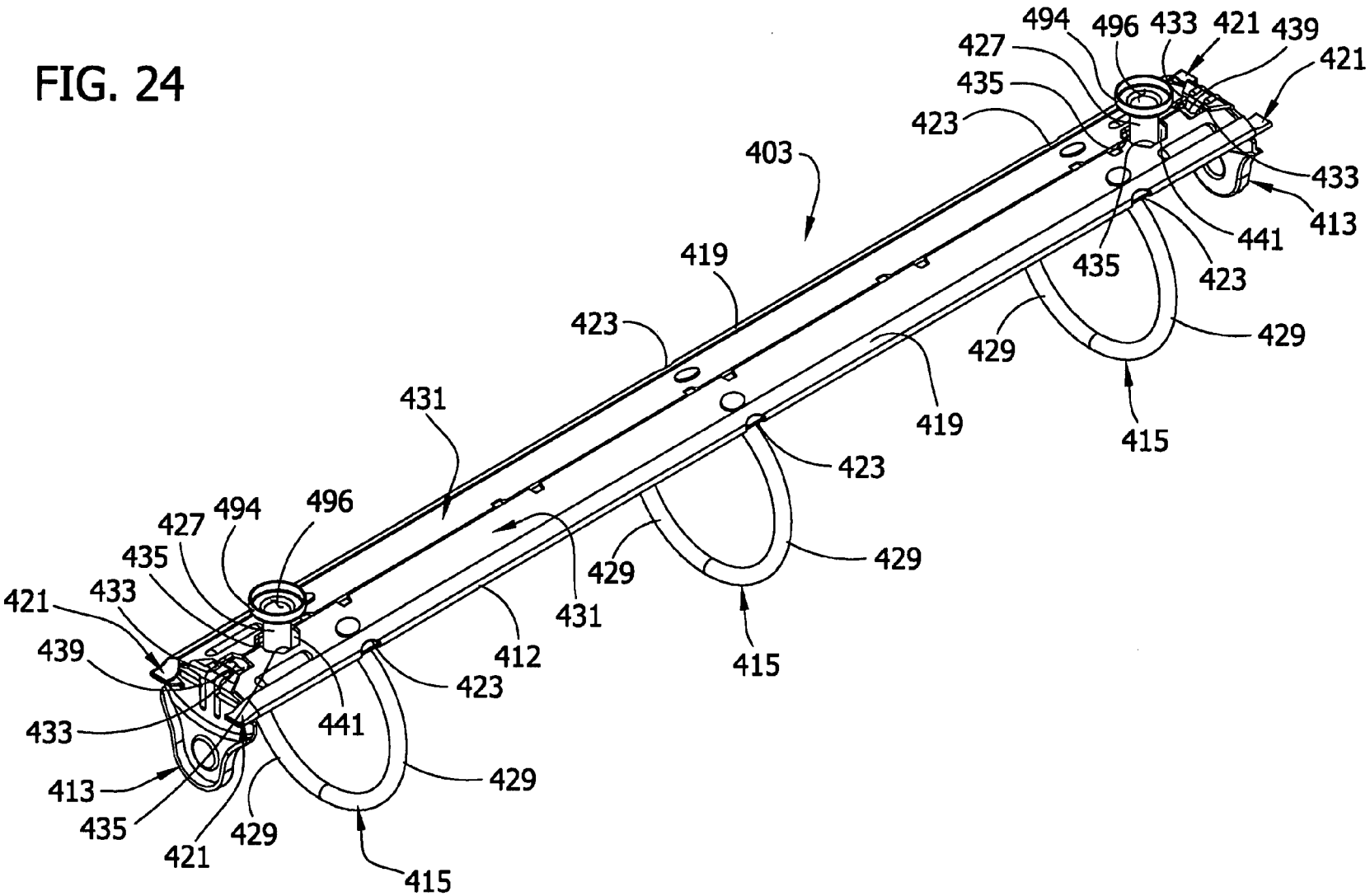
FIG. 24 is a bottom side perspective of a ring binder mechanism having another configuration.
Figure 25:
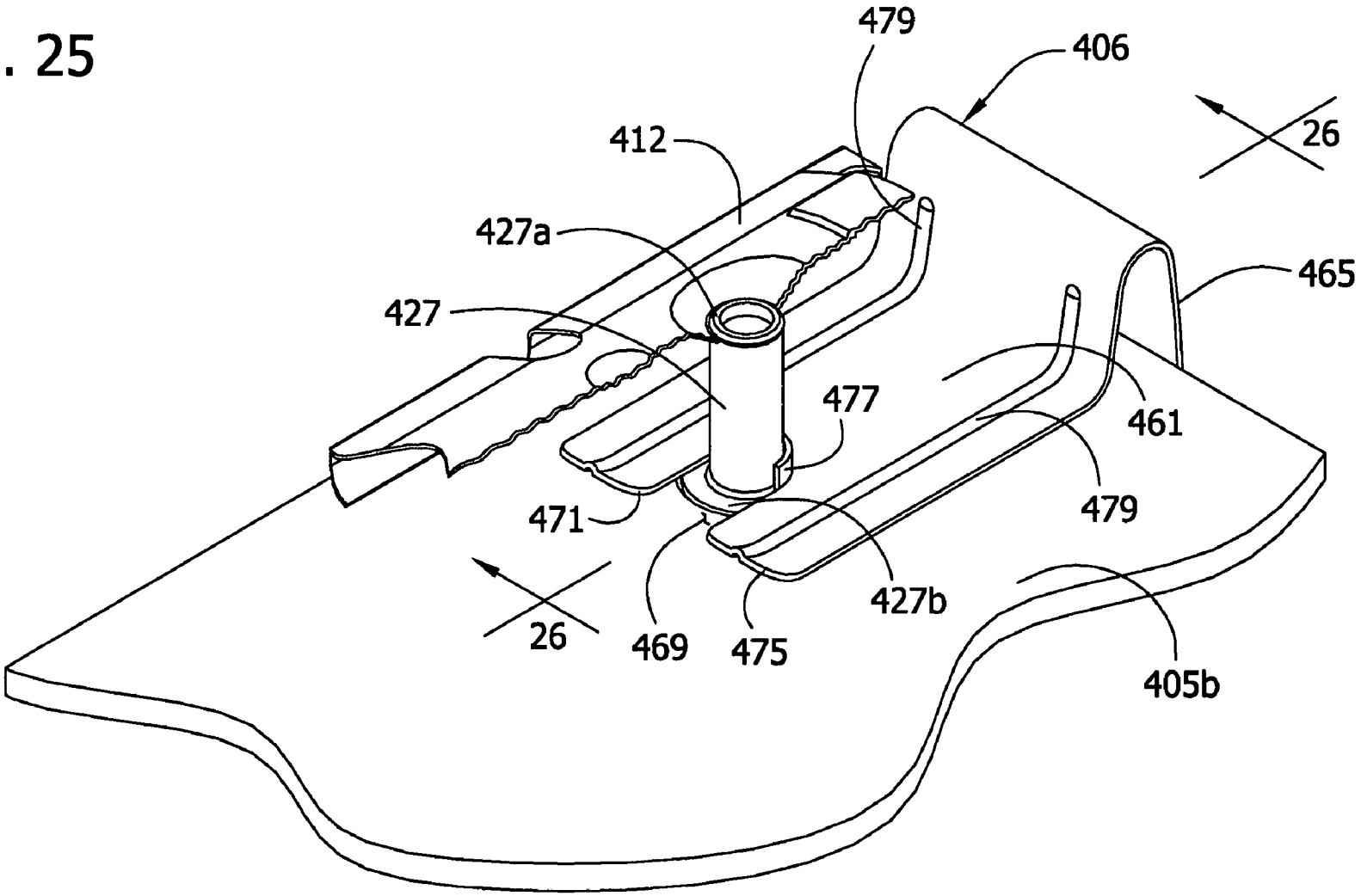
FIG. 25 is a fragmentary perspective similar to FIG. 11, but showing a ring binder mechanism of FIG. 24.
Figure 26:
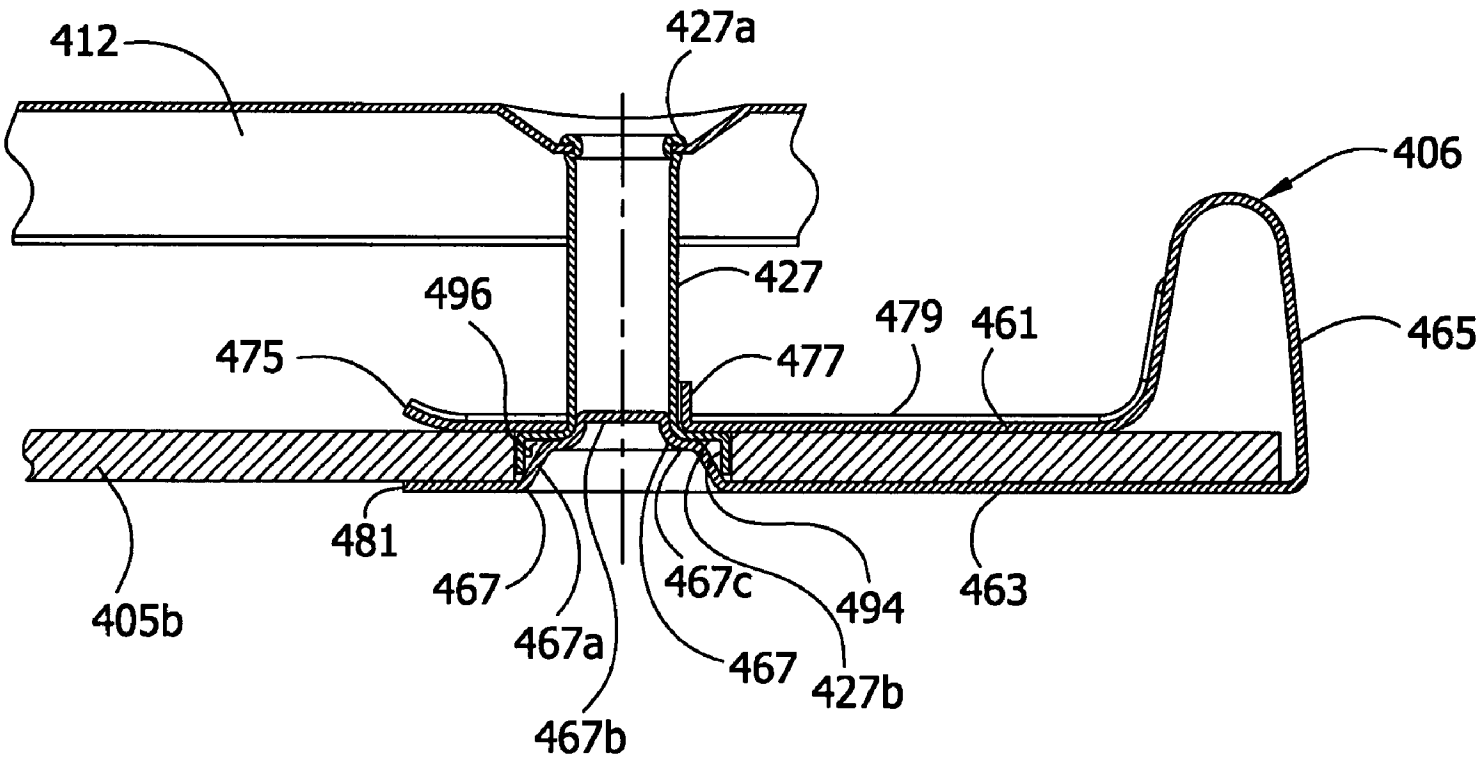
FIG. 26 is a section taken on line 26-26 of FIG. 25.

FIGS. 24-26 show another configuration of a ring binder mechanism 403 that is similar to the ring binder mechanism 3 shown in FIGS. 1-12 except the ring binder mechanism in this configuration includes a mounting post 427 having a rim 494 extending axially outwardly from a flange 427*b* and defining a socket 496. As shown in FIG. 26, the rim 494 is sized and shaped for placement adjacent a wall defining an aperture 407 in the cover 405 and the socket 496 is sized and shaped for receiving a portion of a nub 467. The rim 494 may engage the wall of the aperture 407 to help locate the ring binder mechanism 403.

Figure 27:
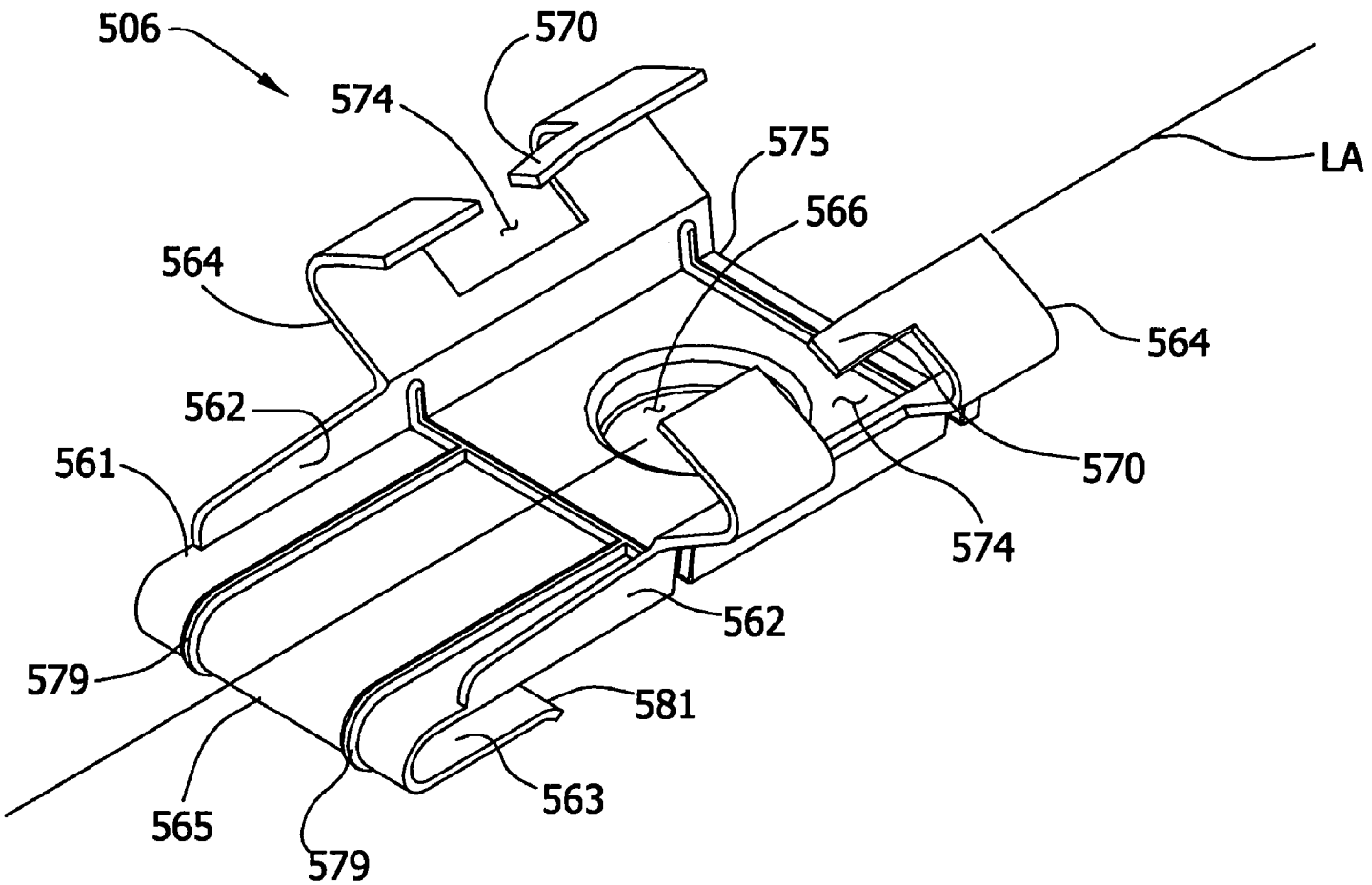
FIG. 27 is a perspective of a clip having still yet another configuration.
Figure 28:
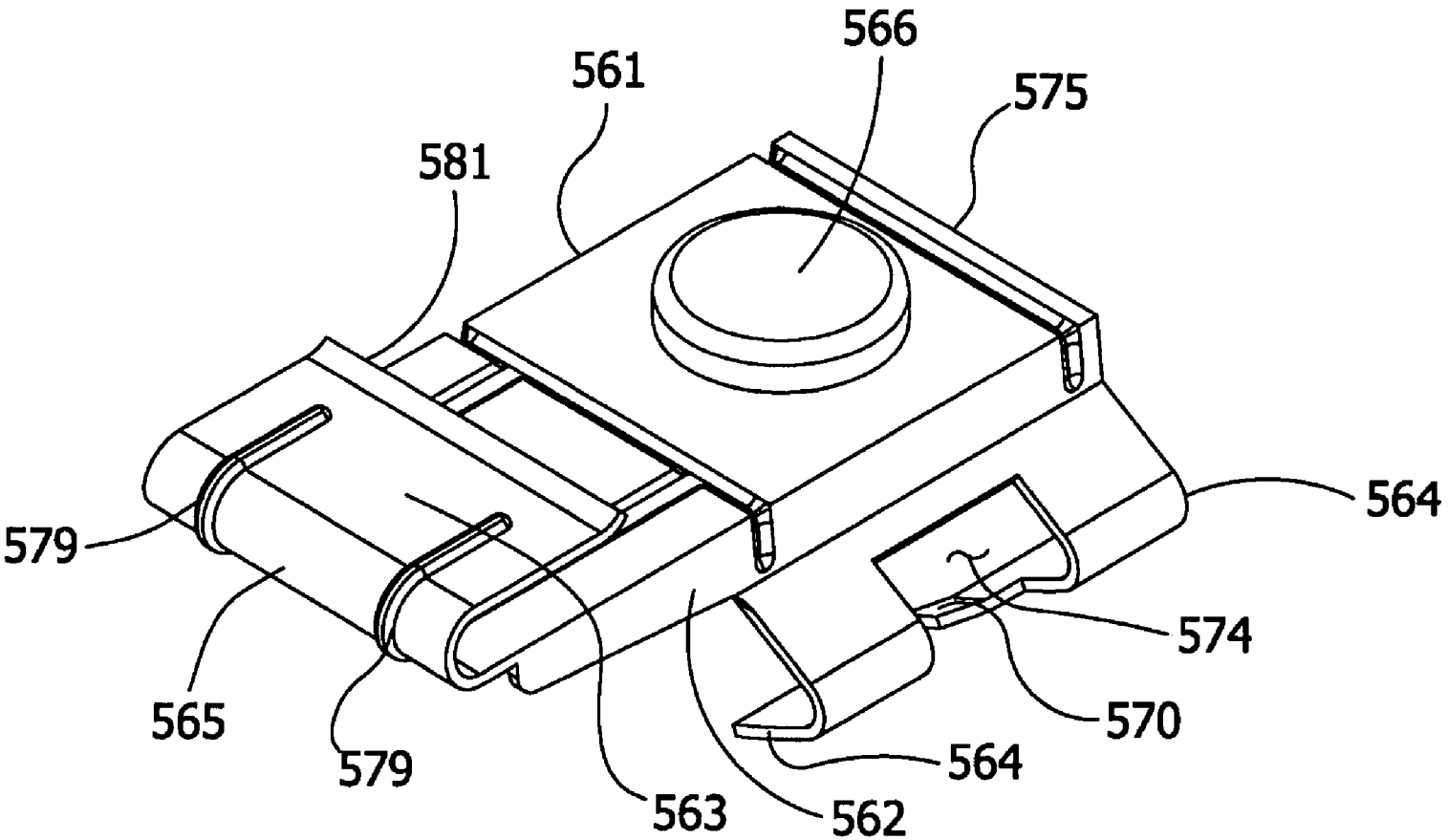
FIG. 28 is a bottom side perspective of the clip of FIG. 27.

FIGS. 27-38 show another configuration of a clip 506. The clip in this configuration is sized and shaped to slide onto a housing 512 of a ring binder mechanism 503 and adapted to secure the housing to a cover 505. As shown in FIGS. 27 and 28, the clip 506 comprises a first portion 561, a second portion 563, and an intermediate portion 565 connecting the first and second portions. The first and second portions 561, 563 define generally flat opposing surfaces that lie generally in parallel planes. The spacing between the surfaces of the first and second portions 561, 563 is slightly less than the thickness of the cover 505. The clip 506 of the illustrated configuration is formed from a single-piece of generally flat sheet metal. But it is understood that the clip 506 can be made from more than one piece of metal (e.g., spring steel) and/or other material without departing from the scope of this invention.

Figure 38:
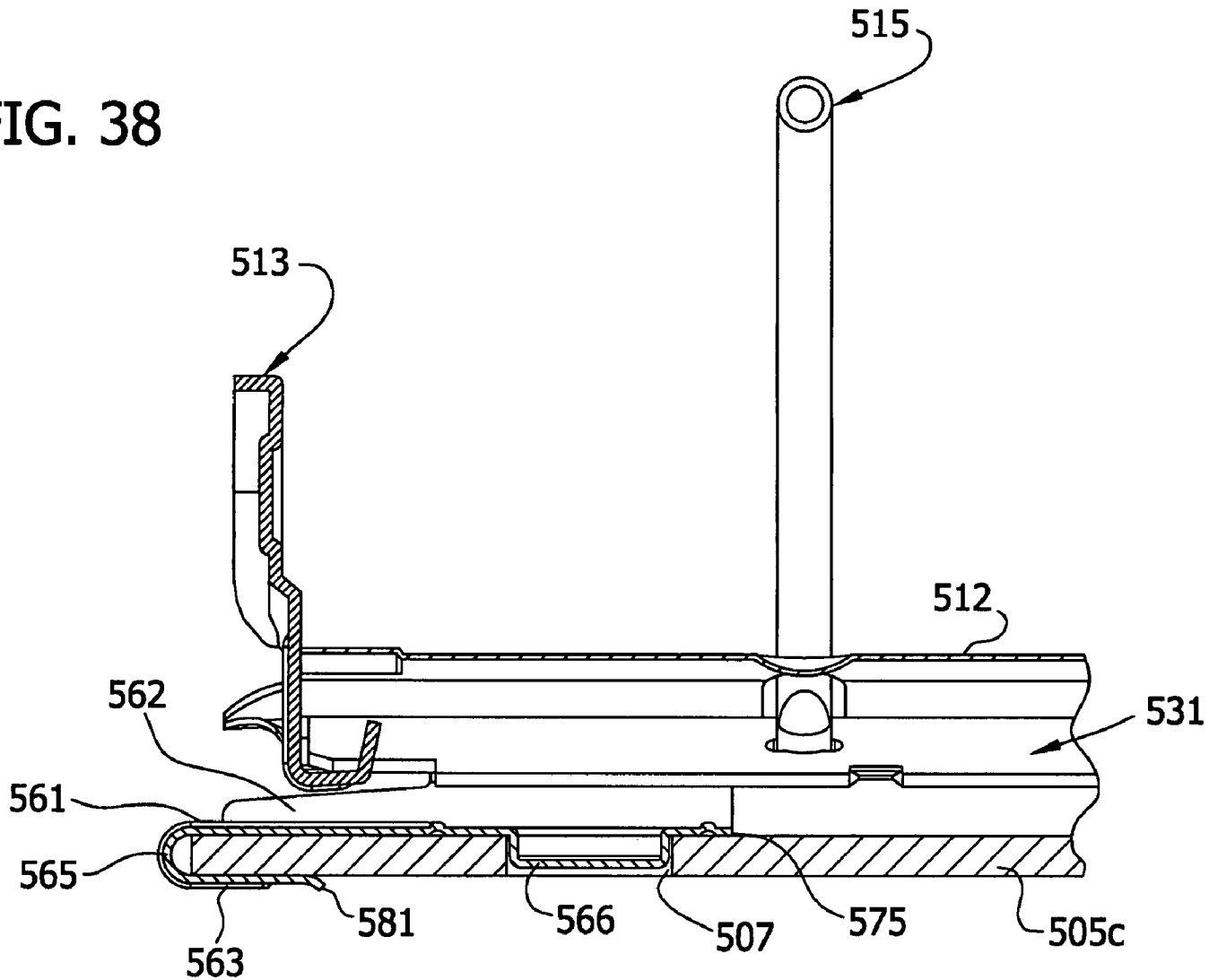
FIG. 38 is a section taken along line 38-38 of FIG. 36.

The first portion 561 includes a base and a pair of side walls 562 extending upwardly from the base. Extending further upwardly from the side walls 562 and away from the base are two arms 564 adapted to engage and slide along the sides of the housing 512 of the ring binder mechanism 503. Each of the arms 564 is generally C-shaped in cross-section to match the shape of the sides of the ring binder mechanism housing 512. The spacing between the opposed arms 564 is slightly smaller than the width of the housing 512 of the ring binder mechanism 503. As the clip 506 is slid onto the housing 512, the arms 564 are flexed outwardly away from a longitudinal axis of the ring binder mechanism 503. The resiliency of the arms 564 causes the arms to tightly grip the sides of the housing 512 of the ring binder mechanism 503, which attaches the housing to the clip. The arms 564 of the illustrated configuration extend approximately half the length of the base of the first portion 561 but it is understood that the arms can be longer or shorter. Each of the arms 564 of the clips 506 has a generally L-shape cutout 574, which defines an elongate tab 570. Each of the tabs 570 are bent slightly downward at its free outer end toward the base of the first portion 561. The first portion 561 also has a circular protuberance 566 extending outwardly from the base in a direction away from the arms 564. The protuberance 566 is positioned on the base between the arms 564. The protuberance 566 can have other shapes and sized than those illustrated and can positioned at different locations on the clip 506. When the clip is positioned on the cover 505, the surface of the first portion 561 is in face-to-face relationship with an interior surface of the cover 505 and the circular protuberance 566 extends into an aperture 507 in the cover to inhibit axial movement of the clip 506 with respect to the cover (FIG. 38).

Figure 33:
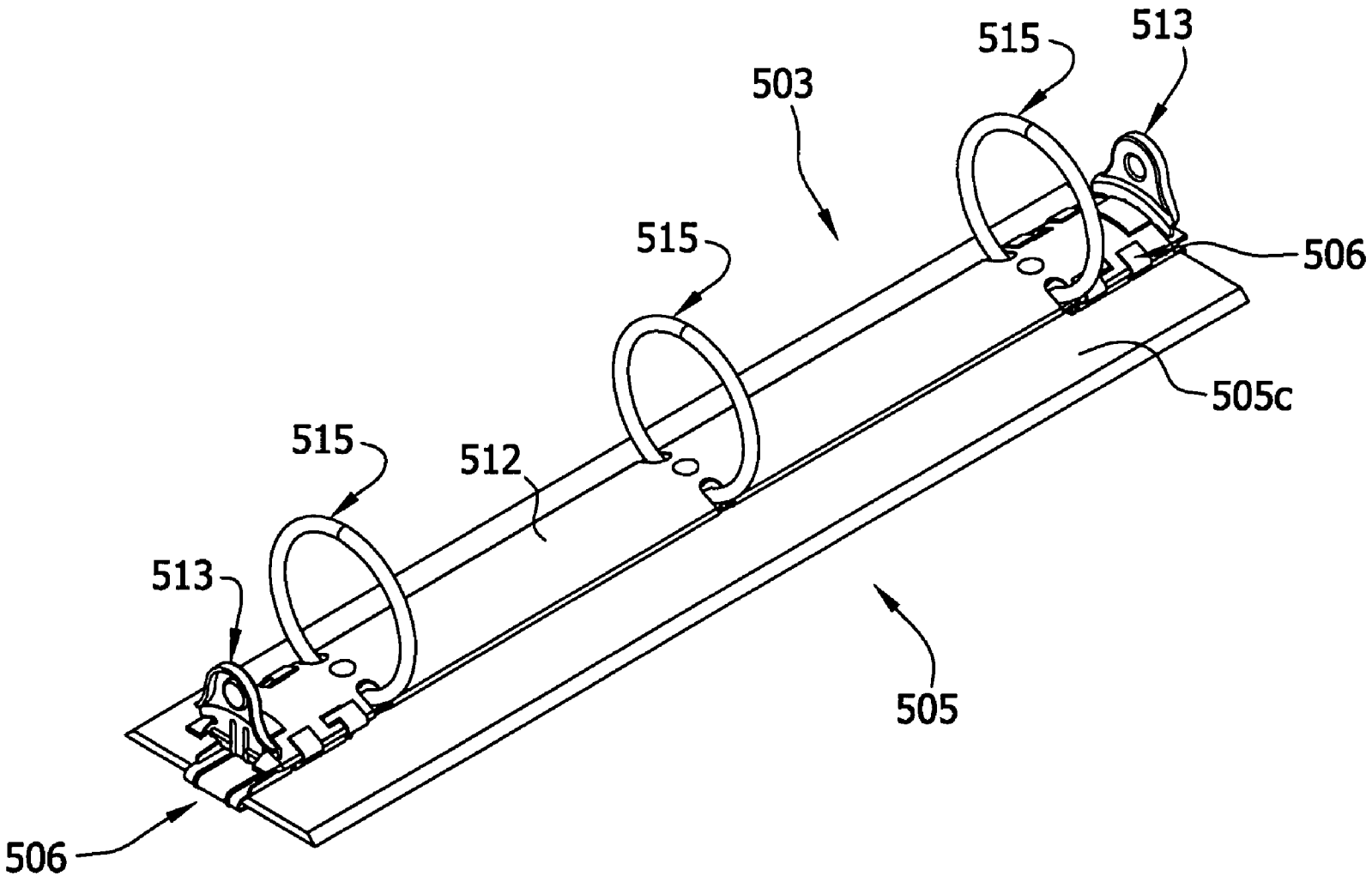
FIG. 33 is a perspective similar to FIGS. 29-32 except the clips are securing the ring binder mechanism to the spine of the cover.
Figure 34:
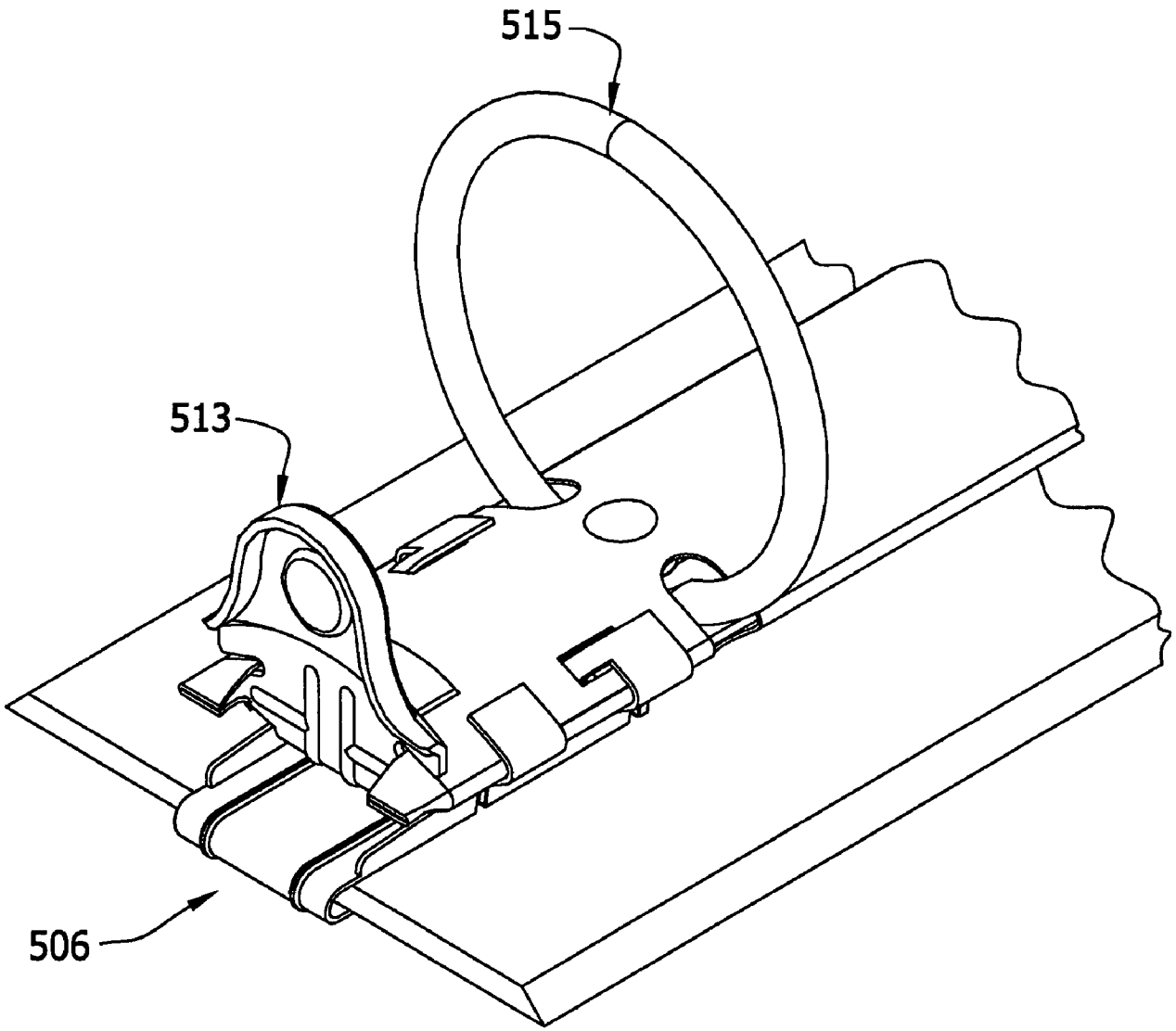
FIG. 34 is an enlarged, fragmentary perspective showing one of the clips of FIG. 33.

Referring again to FIGS. 27 and 28, the intermediate portion 565 yieldably and resiliently resists movement of the first and second portions 561, 563 with respect to one another to prevent the clip 506 from inadvertently disengaging the cover 505. The intermediate portion 565 is arcuate and connects the first portion to the second portion 561, 563. When the clip 506 is attached to the cover 505, the intermediate portion 565 covers and protects a portion of an edge of the cover (FIGS. 33 and 34).

As shown in FIGS. 27 and 28, the second portion 563 lies in a plane generally parallel to the plane the first portion 561. However, the length of the second portion 563 is significantly shorter than the length of the first portion 561. In the illustrated configuration, the length of the second portion 563 is approximately a third of the length of the first portion 561. It is understood, however, that the second portion 563 can have lengths other than those illustrated including lengths longer or equal to the length of the first portion 561. A free outer edge 581 of the second portion 563 is bent slightly downward away from the first portion 561 for allowing the clip 506 to slide more easily onto the cover 505 as described in move detail below. When the clip 506 is attached to the cover 505, the second portion 563 is generally in face-to-face relationship with an exterior surface of the cover (FIG. 38).

Figure 29:
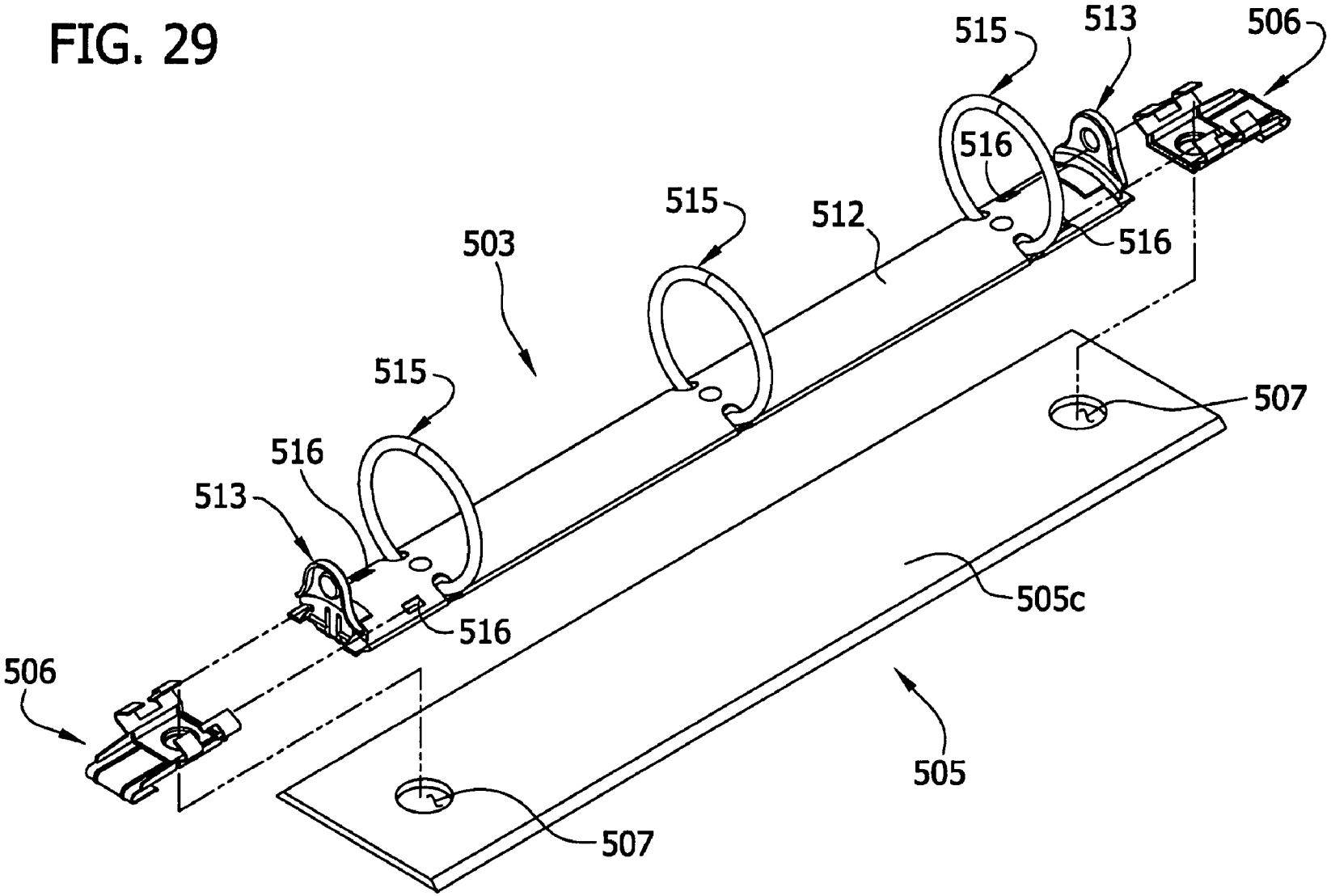
FIG. 29 is an exploded perspective showing two clips removed from a ring binder mechanism and a spine of a cover.
Figure 30:
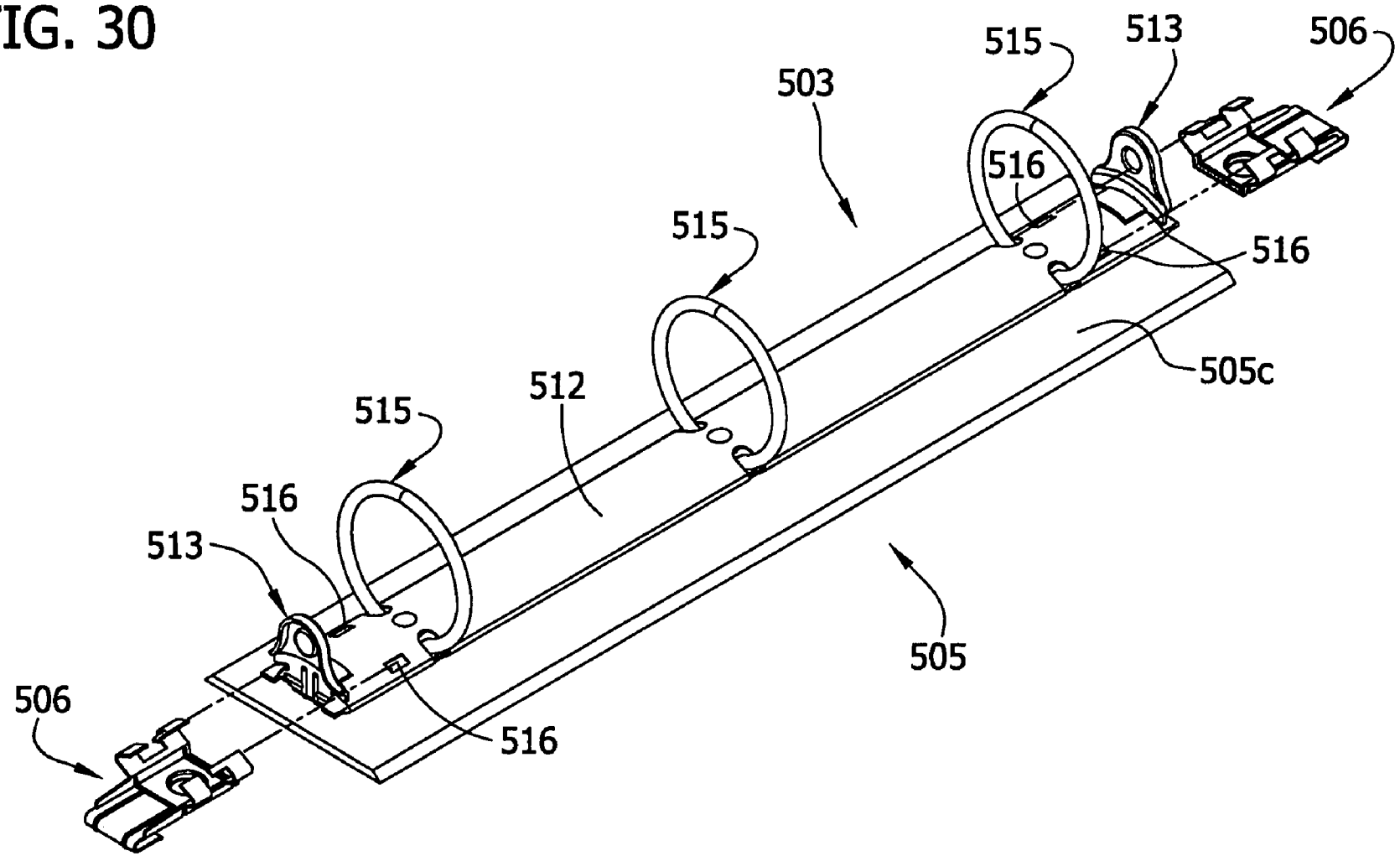
FIG. 30 is an exploded perspective similar to FIG. 29 except the ring binder mechanism is shown engaging the cover.
Figure 31:
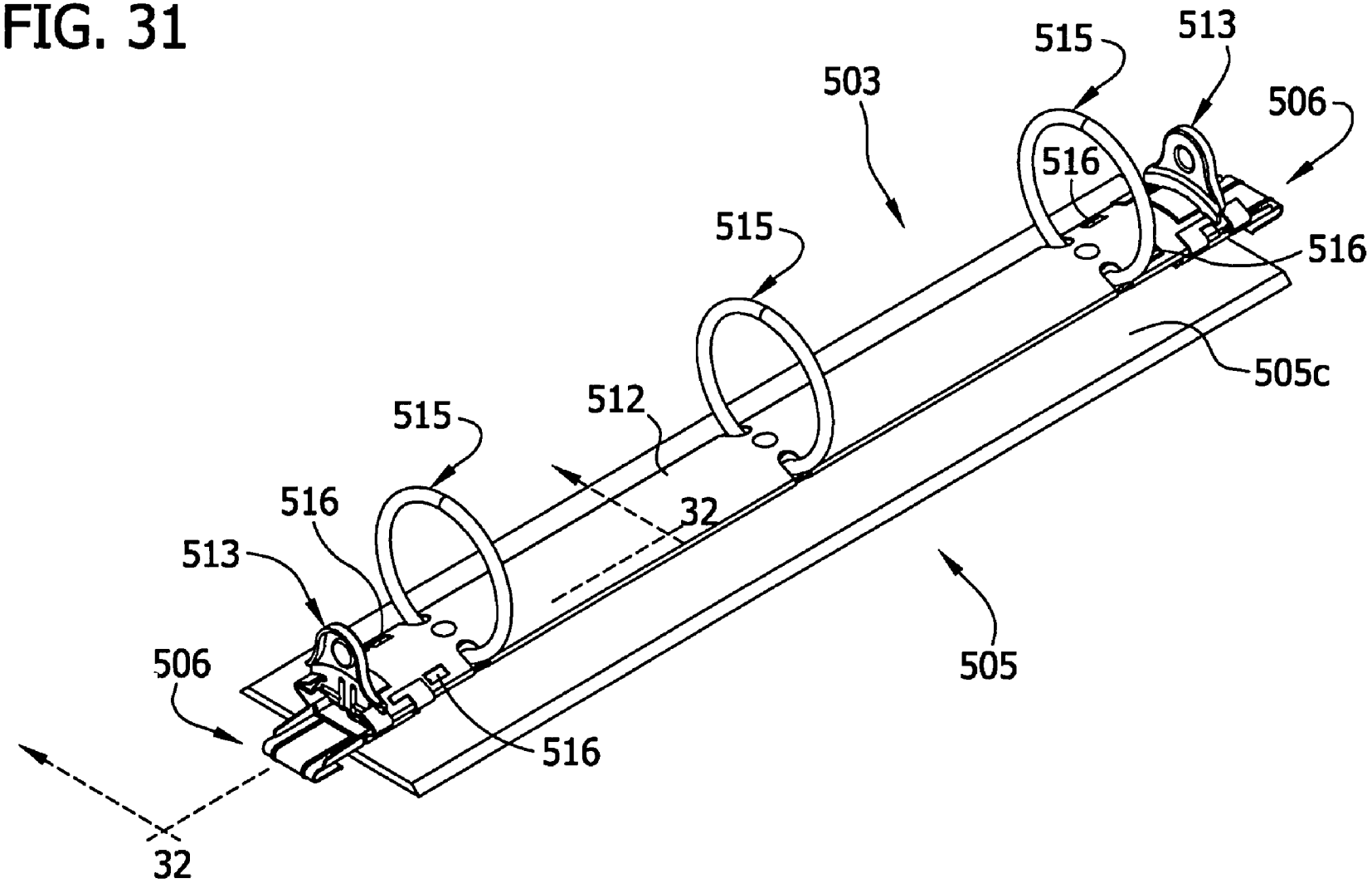
FIG. 31 is an exploded perspective similar to FIGS. 29 and 30 except the clips are partially engaging the ring binder mechanism and the cover.
Figure 32:
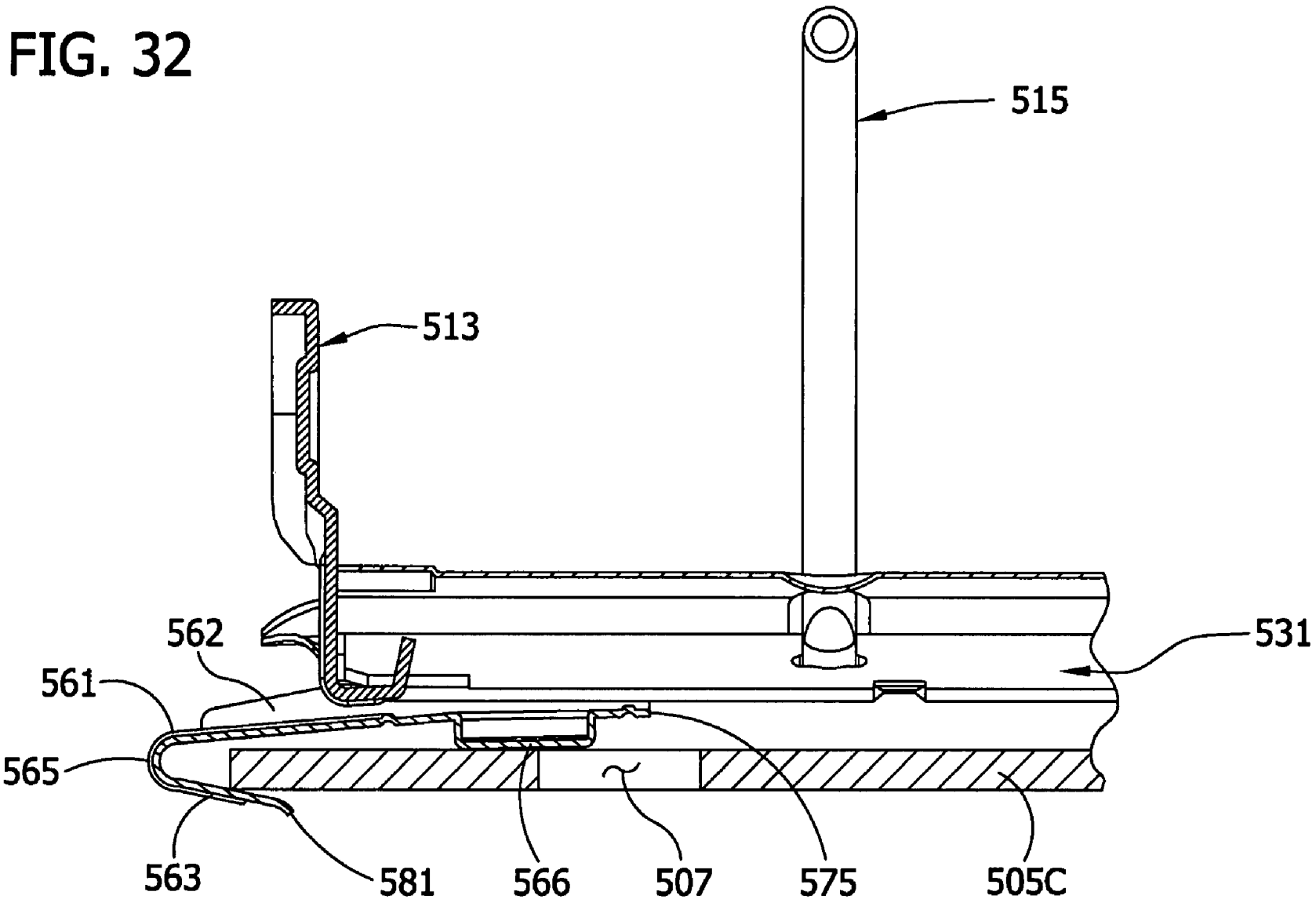
FIG. 32 is a fragmentary section taken on line 32-32 of FIG. 31.
Figure 35:
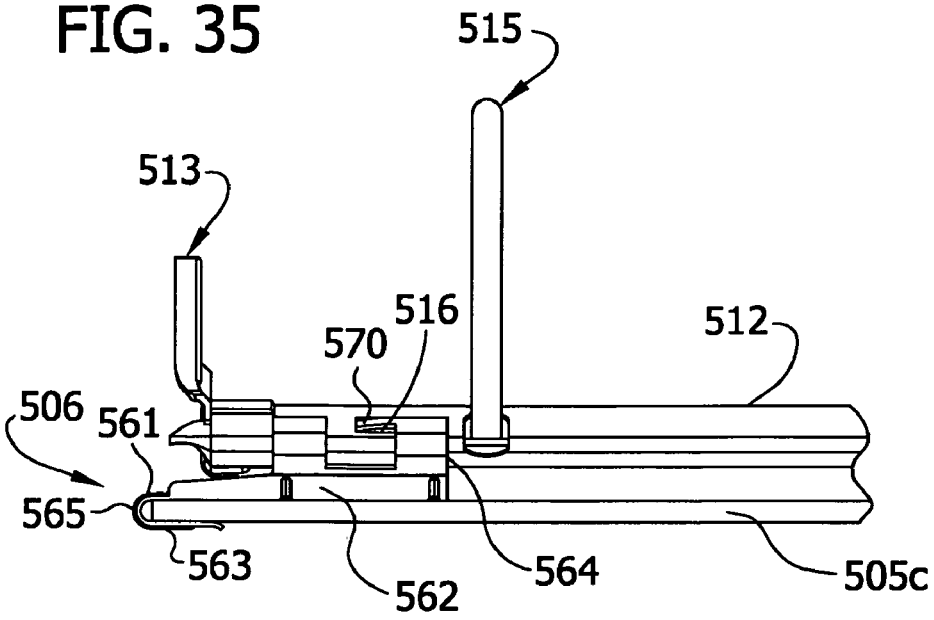
FIG. 35 is a fragmentary side elevation showing one of the clips.
Figure 36:
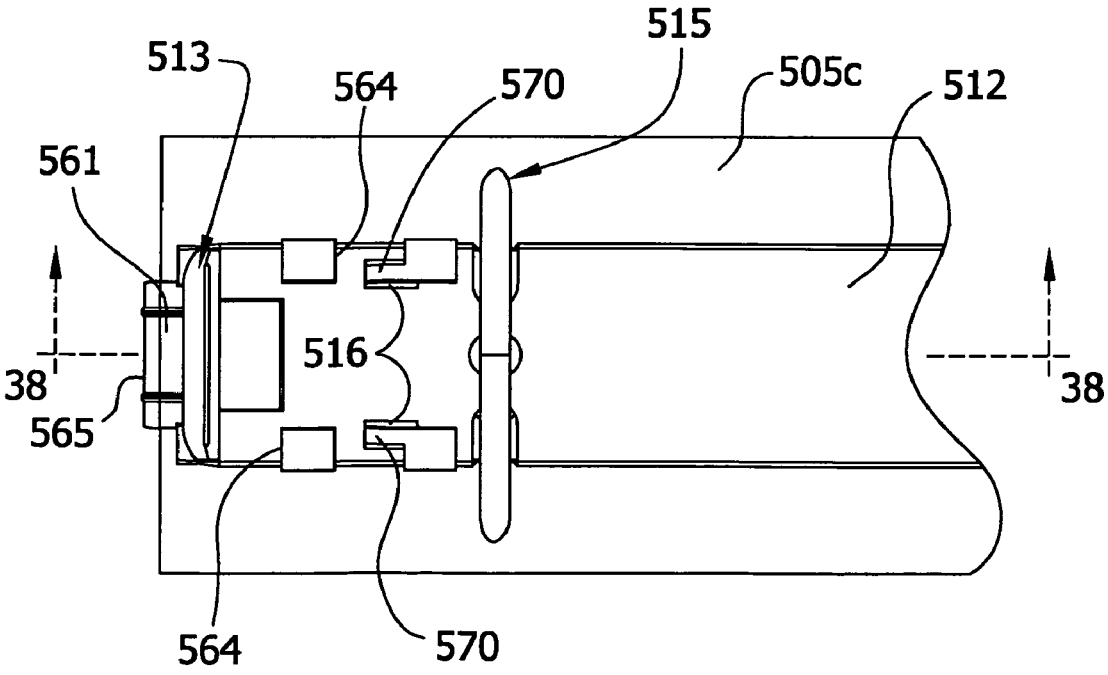
FIG. 36 is a fragmentary top plan showing one of the clips.
Figure 37:
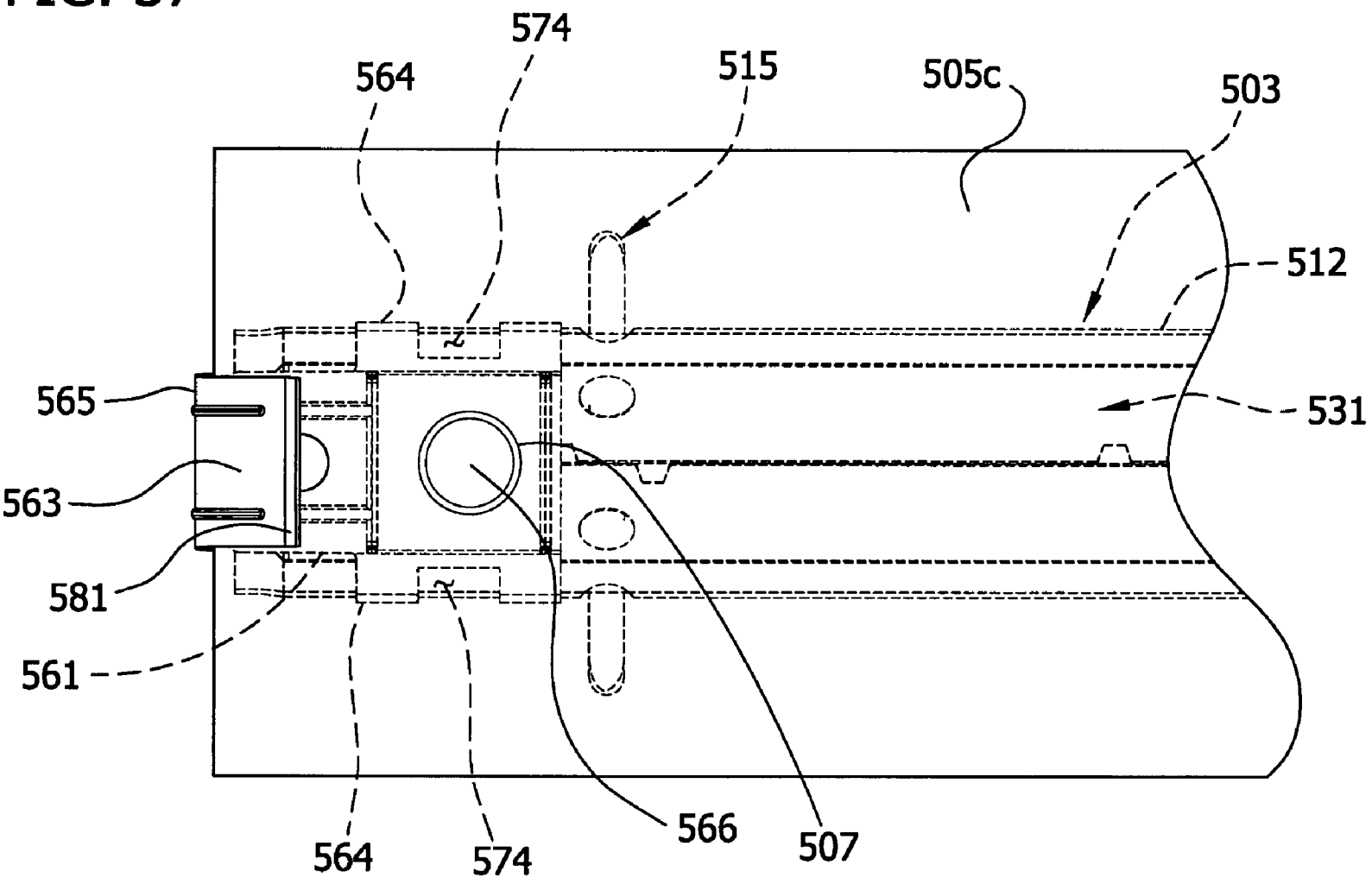
FIG. 37 is a fragmentary bottom plan showing one of the clips.

A ring binder 501 of the illustrated configuration can be assembled by aligning the housing 512 of the ring binder mechanism 503 with respect to a spine 505*c* of the cover 505 (FIGS. 29 and 30). The clips 506 are slid onto the cover 505 and ring binder mechanism 503 one at a time, although a simultaneous connection would not depart from the scope of the present invention. Since both clips 506 are attached in the same way, only one is described herein. A free outer edge 575 of the first portion 561 of the clip 506 is placed against an upper edge of the cover 505. The clip 506 is pushed toward the ring binder mechanism 503 so that the first portion 561 slides over the interior surface of the cover 505 and the arms 564 engage and slide along the housing 512 (FIG. 31). As the clip 506 slides on the cover 505, the first portion 561 pivots about the intermediate portion 565 and deflects away from the second portion 563 to allow the protuberance 566 to slide along the interior surface of the cover (FIG. 32). Once the protuberance 566 moves into registration with the aperture 507, the resiliency of the clip 506 causes the protuberance to snap into the aperture (FIGS. 37 and 38). While the clip 506 is sliding on the cover 505, the arms 564 of the clip engage and sliding receive the housing 512 of the ring binder mechanism 503 (FIG. 31). As mentioned, each of the arms 564 are generally C-shaped to match the shape of the sides of the ring binder mechanism housing 512 and the spacing between the opposed arms 564 is slightly smaller than the width of the housing 512 of the ring binder mechanism 503. Therefore, as the clip 506 is being slid onto the housing 512, the arms 564 flex outwardly away from a longitudinal axis of the ring binder mechanism 503. The resiliency of the arms 564 causes the arms to tightly grip the sides of the housing 512 of the ring binder mechanism 503, which attaches the housing to the clip. The ring binder 501 in the illustrate configuration has openings 516 for receiving the tabs 570 formed by the L-shaped cutouts 574 in the arms 564 of the clip 506 (FIGS. 35 and 36). The tabs 570 are bent slightly downward at its free outer end so that once the tabs are aligned with the openings 516 in the housing 512, the tabs extend downward into the openings 516 to prevent the clips 506 from being unattached to the housing. It is understood that other fasteners can be used to secure the housing to the clip.

Once in place, the clip 506 secures the ring binder mechanism 503 to the cover 505 (FIGS. 33-38). The protuberance 566 of the first portion 561 is received in the aperture 507 of the cover 505 to inhibit axial movement of the clip 506. With the arms 564 of the clip 506 engaging the housing 512 of the ring binder mechanism 503, the bent portions of the tabs 570 extend into the openings 516 in the housing to thereby secure the housing with respect to the clip. The intermediate portion 565 covers and protects the edge of the cover 505. Another clip 506 can be secured to the other end of the ring binder mechanism 503 in the same way. With both clips 506 in place, the ring binder mechanism 503 is securely mounted on the cover 505.

The ring binder mechanism 503 can be separated from the cover 505 by disengaging both clips 506 from the ring binder mechanism and the cover. One way to remove one of the clips 506 from the ring binder mechanism 503 and the cover 505 is to deflect the tabs 570 of the arms 564 away from and out of the openings 516 in the housing 512 of the ring binder mechanism. The clips 506 and ring binder mechanism 503 need to be pulled away from the interior surface of the cover 505 so that the protuberance 566 on the first portion 561 is able to slide free of the aperture 507 in the cover 505 (FIG. 32). With the tabs 570 removed from the openings 516 and the protuberance 566 removed from the aperture 507, the clip 506 can be slid off both the ring binder mechanism 503 and the cover 505. Once both clips 506 have been removed, the ring binder mechanism 503 is free to move with respect to the cover 505 (FIGS. 29 and 30).

Figure 39:
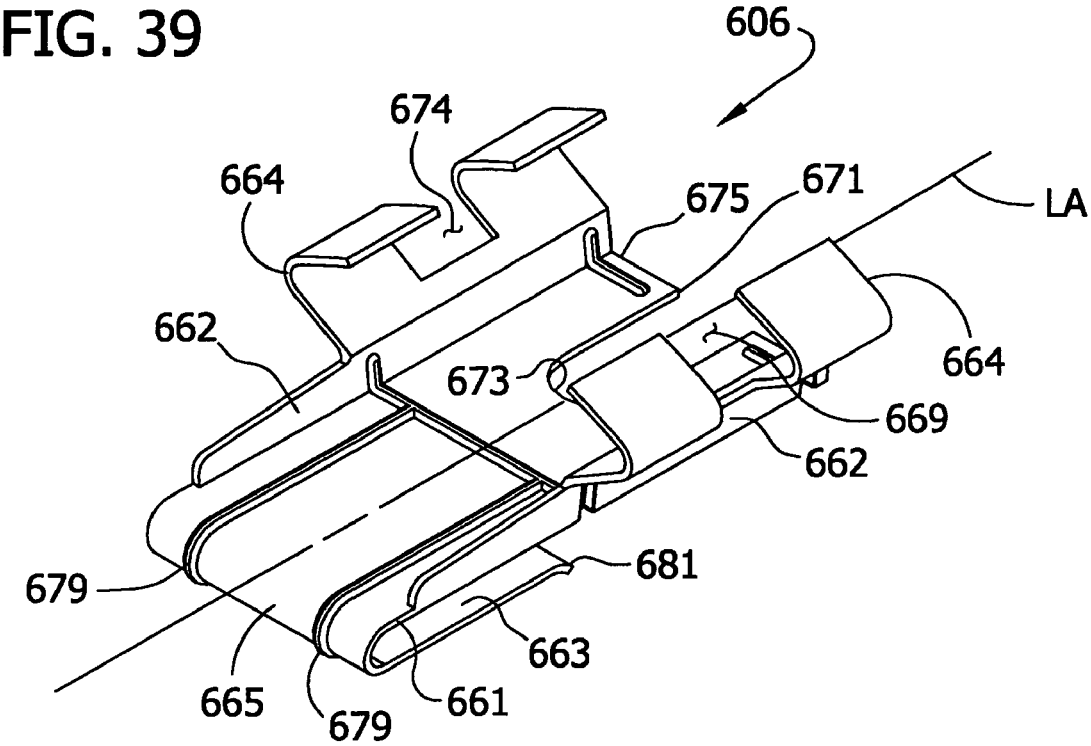
FIG. 39 is a perspective of a clip having another configuration.
Figure 40:
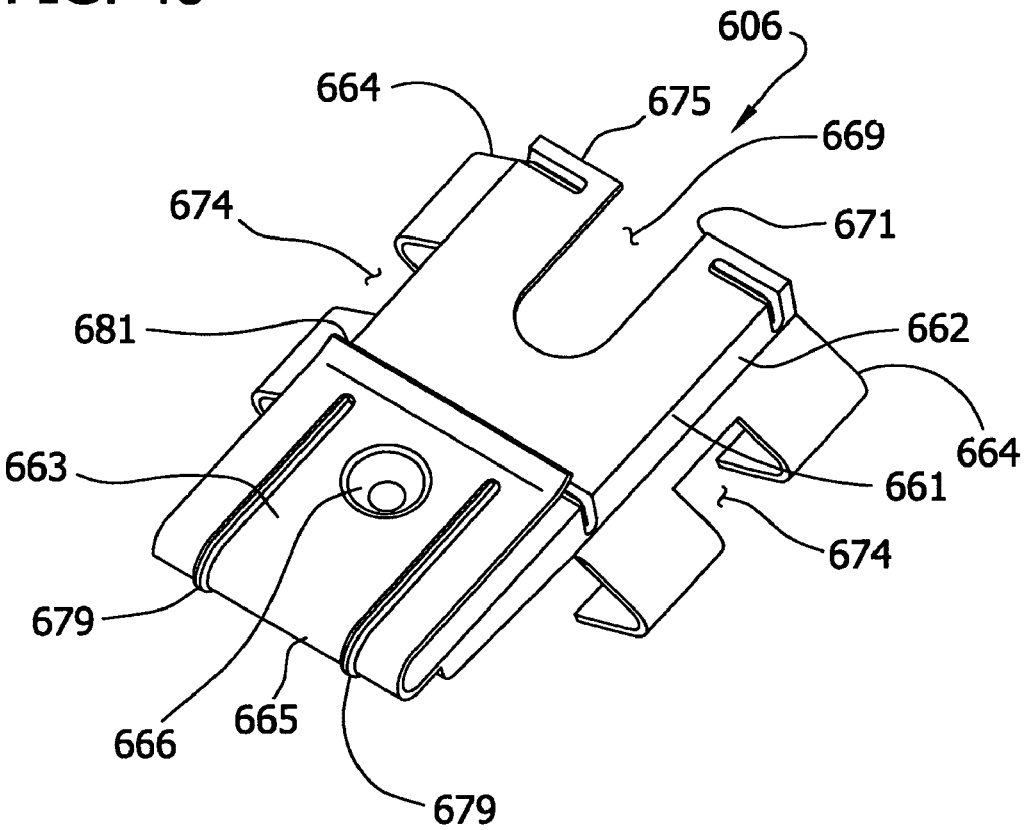
FIG. 40 is a bottom side perspective of the clip of FIG. 39.
Figure 41:
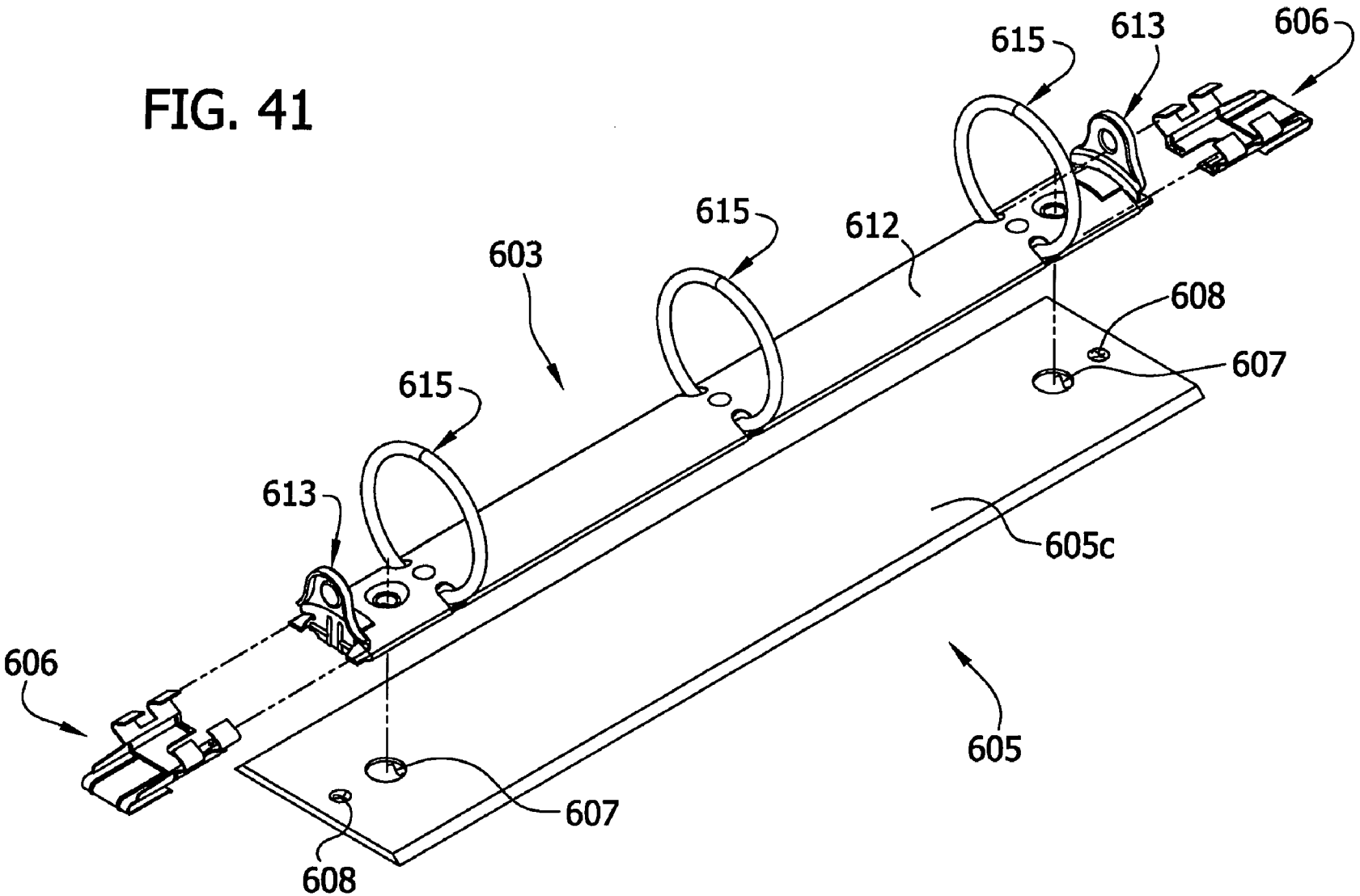
FIG. 41 is an exploded perspective showing two clips removed from a ring binder mechanism and a spine of a cover.
Figure 42:
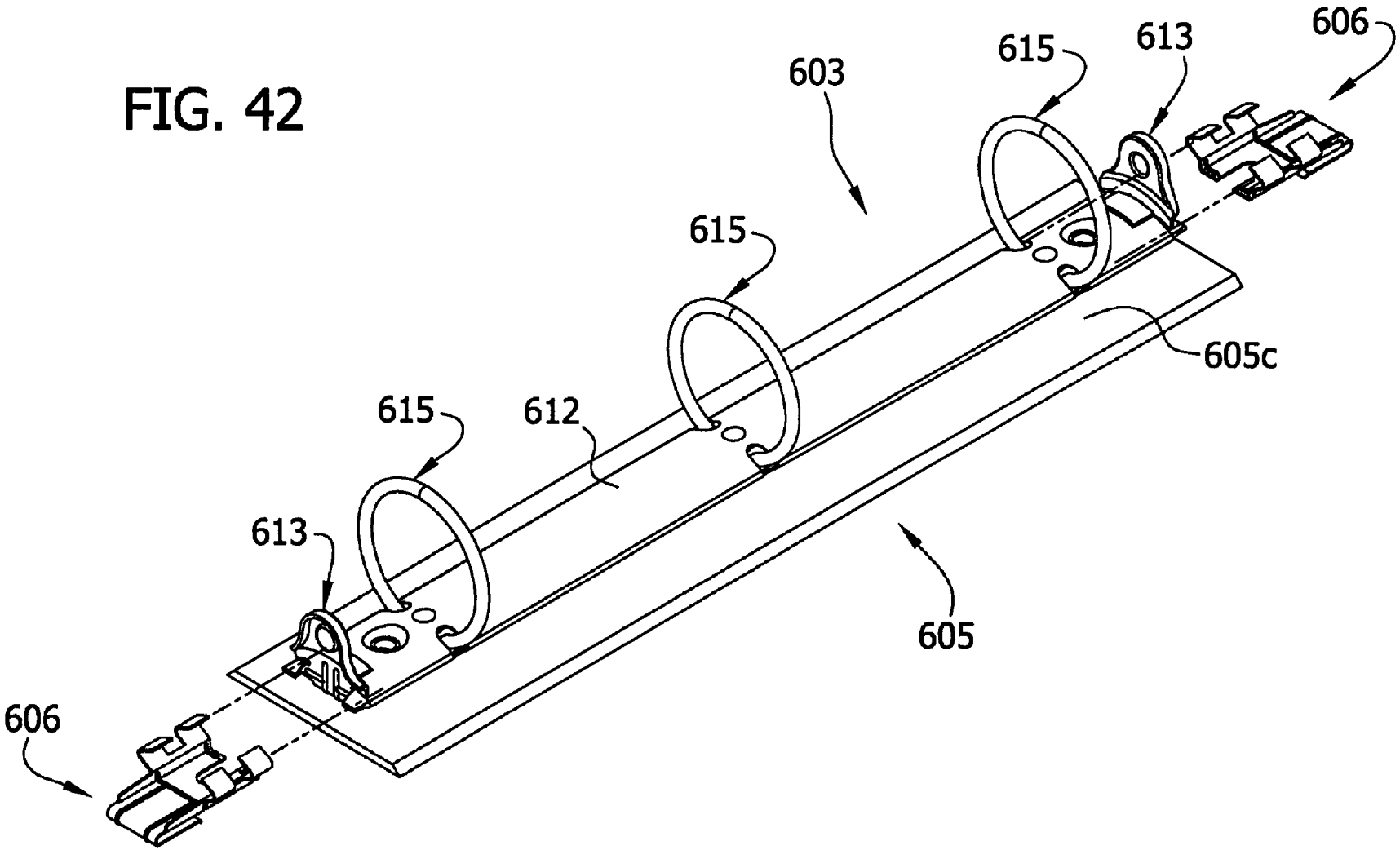
FIG. 42 is a perspective similar to FIG. 41 except the ring binder mechanism is shown engaging the cover.
Figure 43:
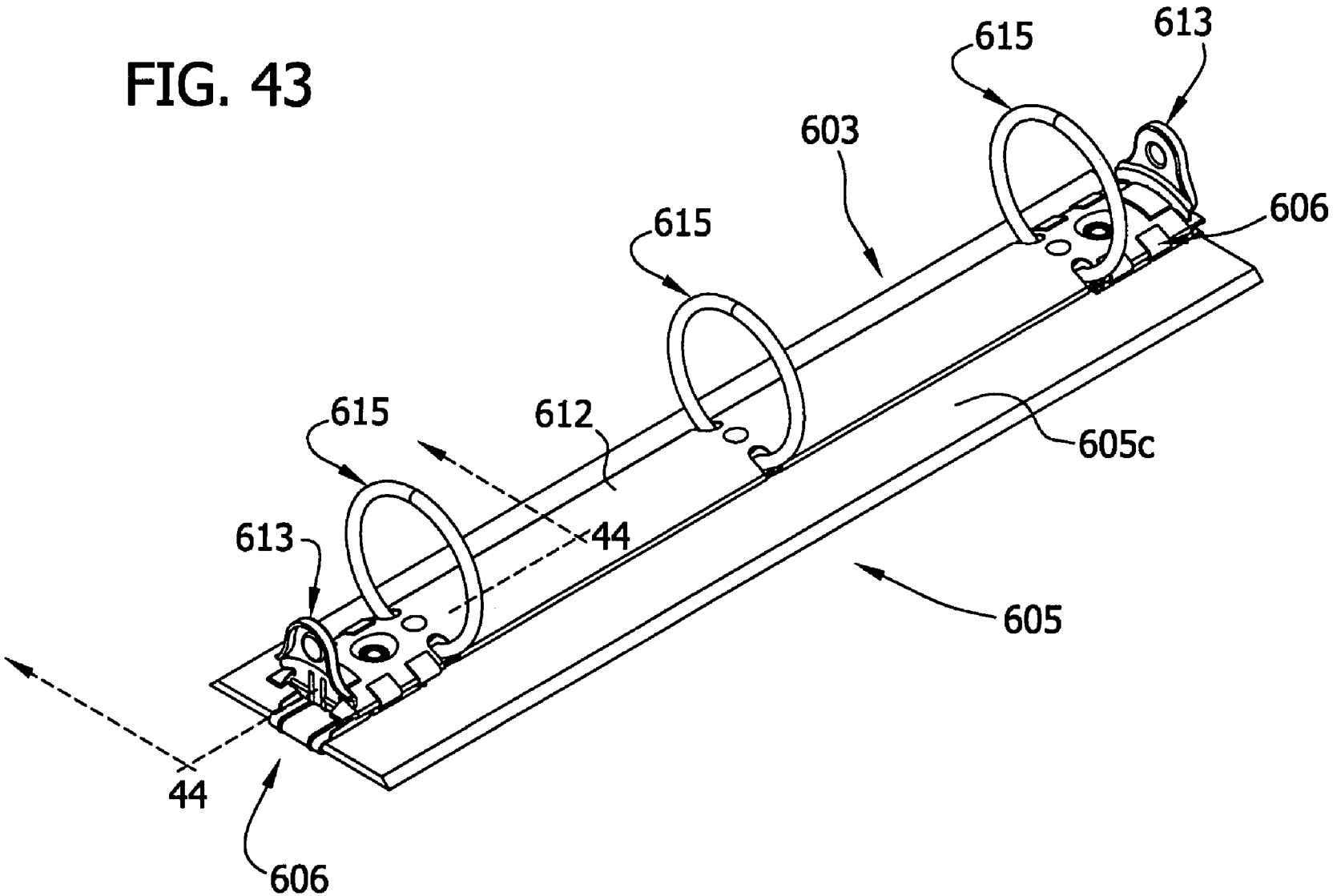
FIG. 43 is a perspective similar to FIGS. 41 and 42 except the clips are securing the ring binder mechanism to the cover.
Figure 44:
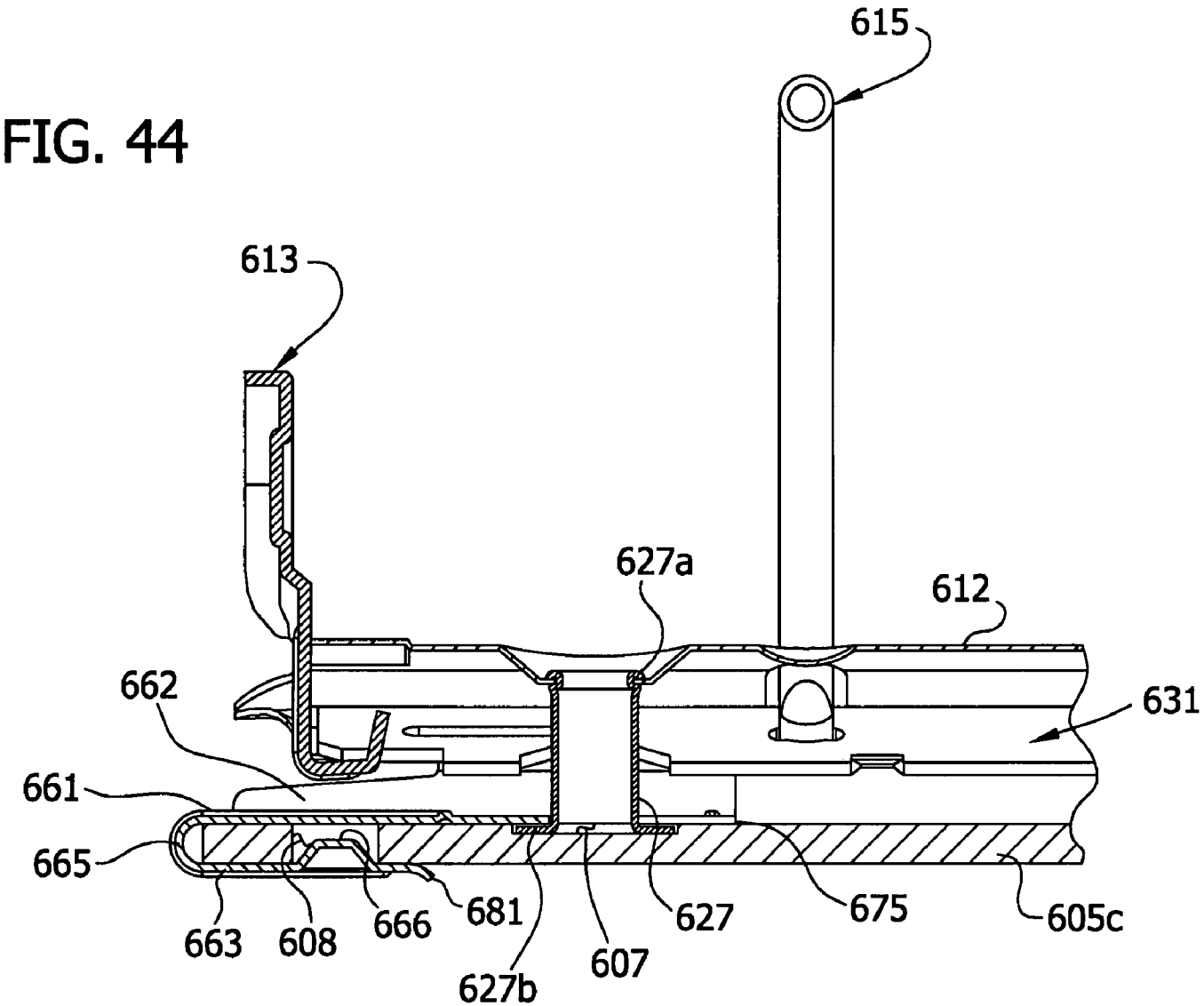
FIG. 44 is a section taken along line 44-44 of FIG. 43.
Figure 45:
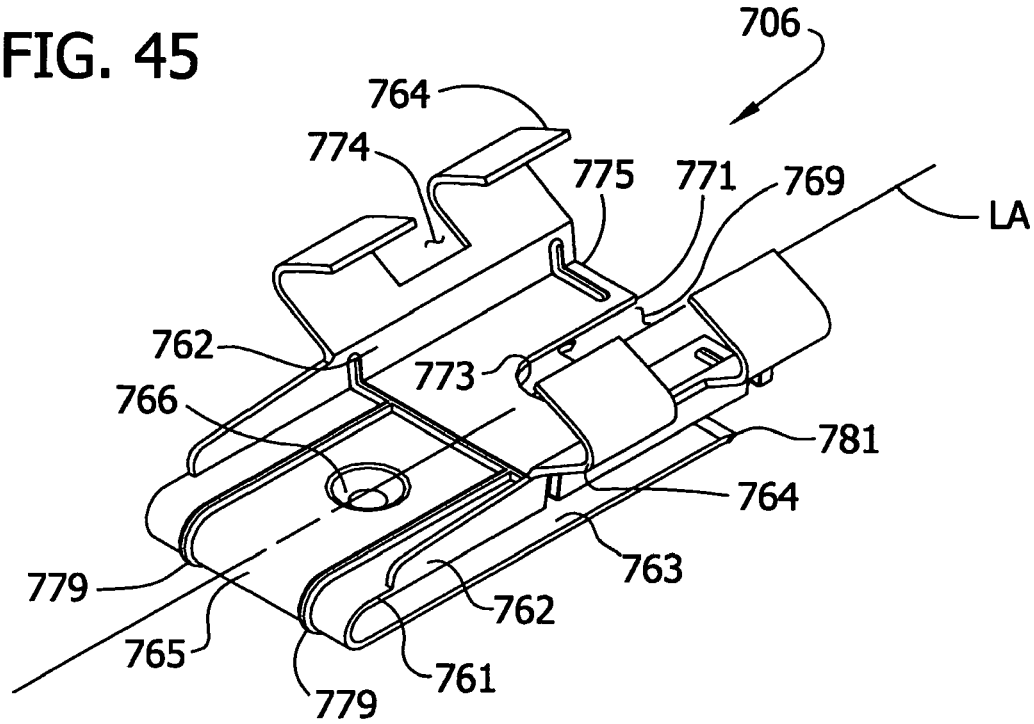
FIG. 45 is a perspective of a clip having yet another configuration.
Figure 46:
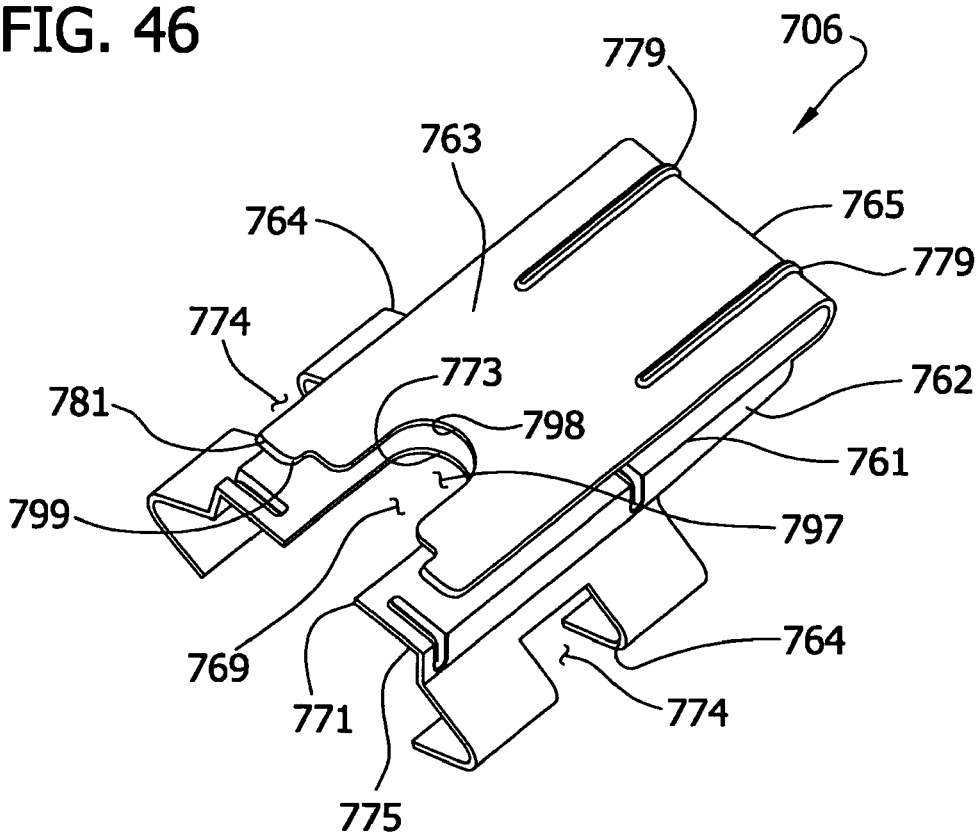
FIG. 46 is a bottom side perspective of the clip of FIG. 45.
Figure 47:
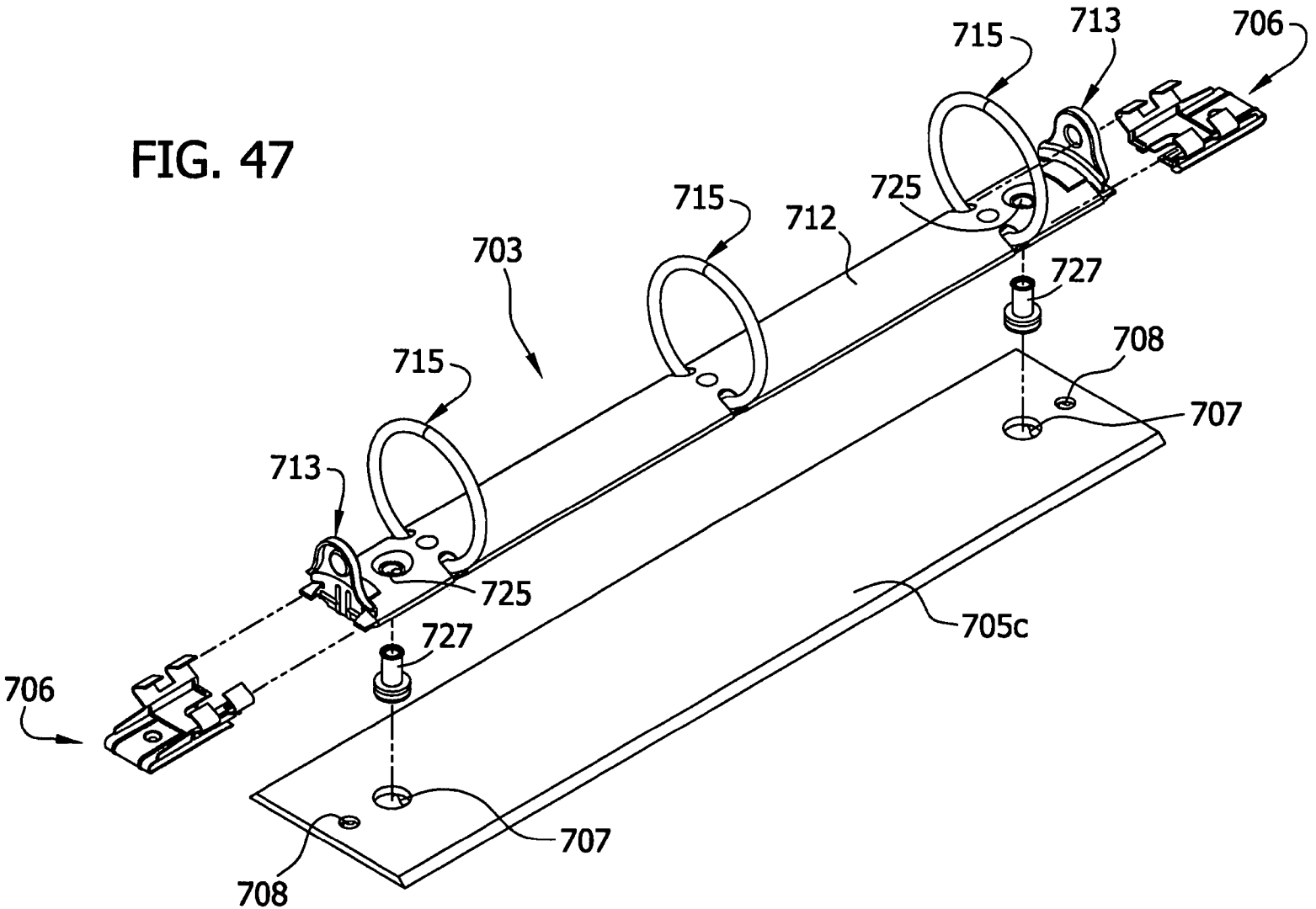
FIG. 47 is an exploded perspective showing two clips removed from a ring binder mechanism and a spine of a cover.
Figure 48:
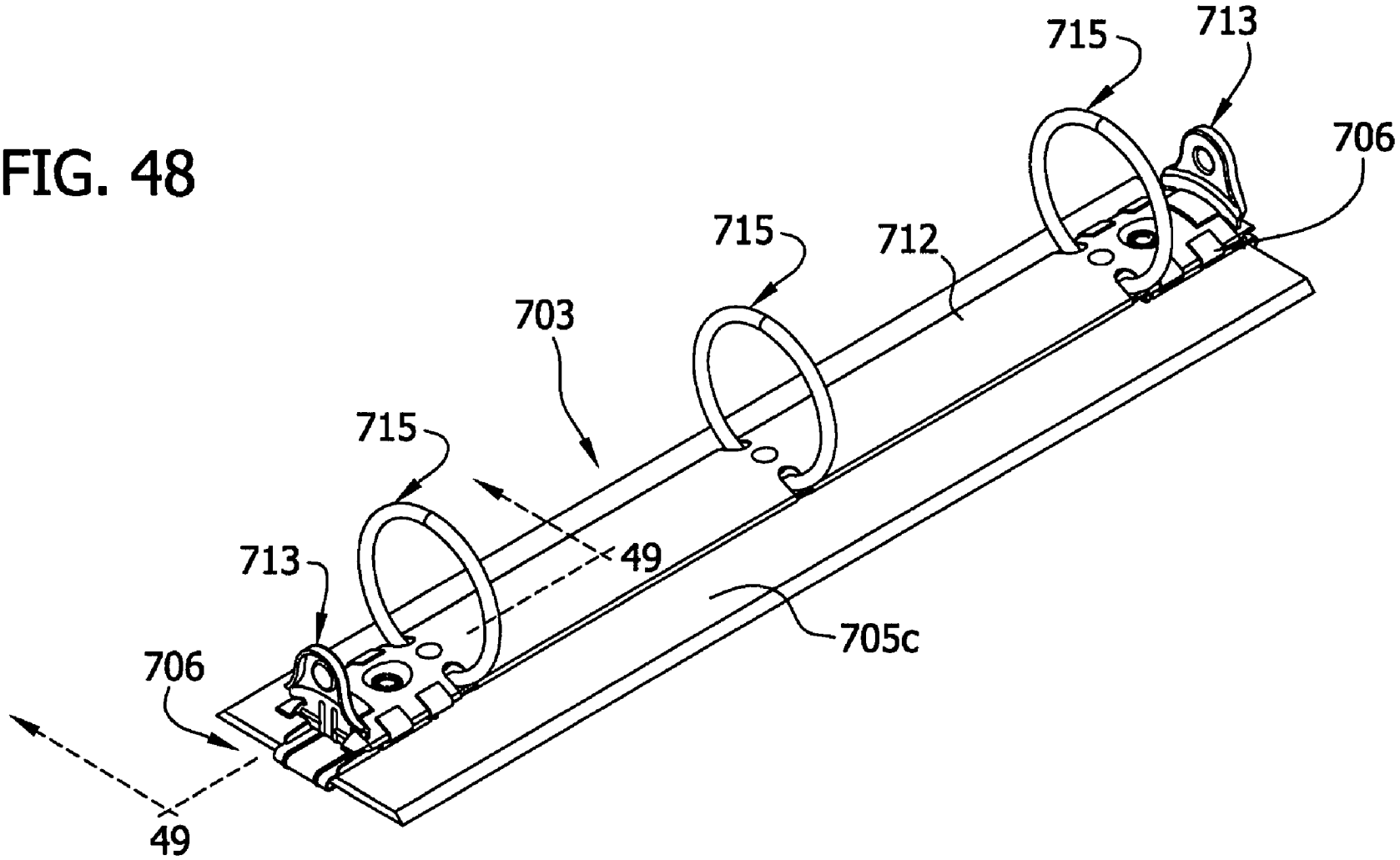
FIG. 48 is a perspective similar to FIG. 47 except the clips are securing the ring binder mechanism to the cover.

FIGS. 39-44 show a configuration of a clip 606 substantially similar to the previous described clip 506 except that a first portion 661 of the clip has a slot 669, and the second portion 663 includes a protuberance 666. The slot 669 in the first portion 661 allows the first portion to receive a mounting post 627 connected to the housing 612 of the ring binder mechanism 603. A recess 607 is located in the cover 605 and is sized and shaped for cooperating with the part of the first portion 661 surrounding the slot 669 to secure a flange 627*b* of the mounting post 627 in the recess. The protuberance 666 of the second portion 663 of the clip 606 extends into an opening 608 in the cover 605 to inhibit movement of the clip with respect to the cover. In this configuration, the first portion 661 has a length that is about twice the length of the second portion 663 but it is understood that the first and second portions can have different lengths than those illustrated (FIGS. 39 and 40). Corresponding parts are indicated by the same reference numbers used in FIGS. 27-38 plus "100".

Figure 49:
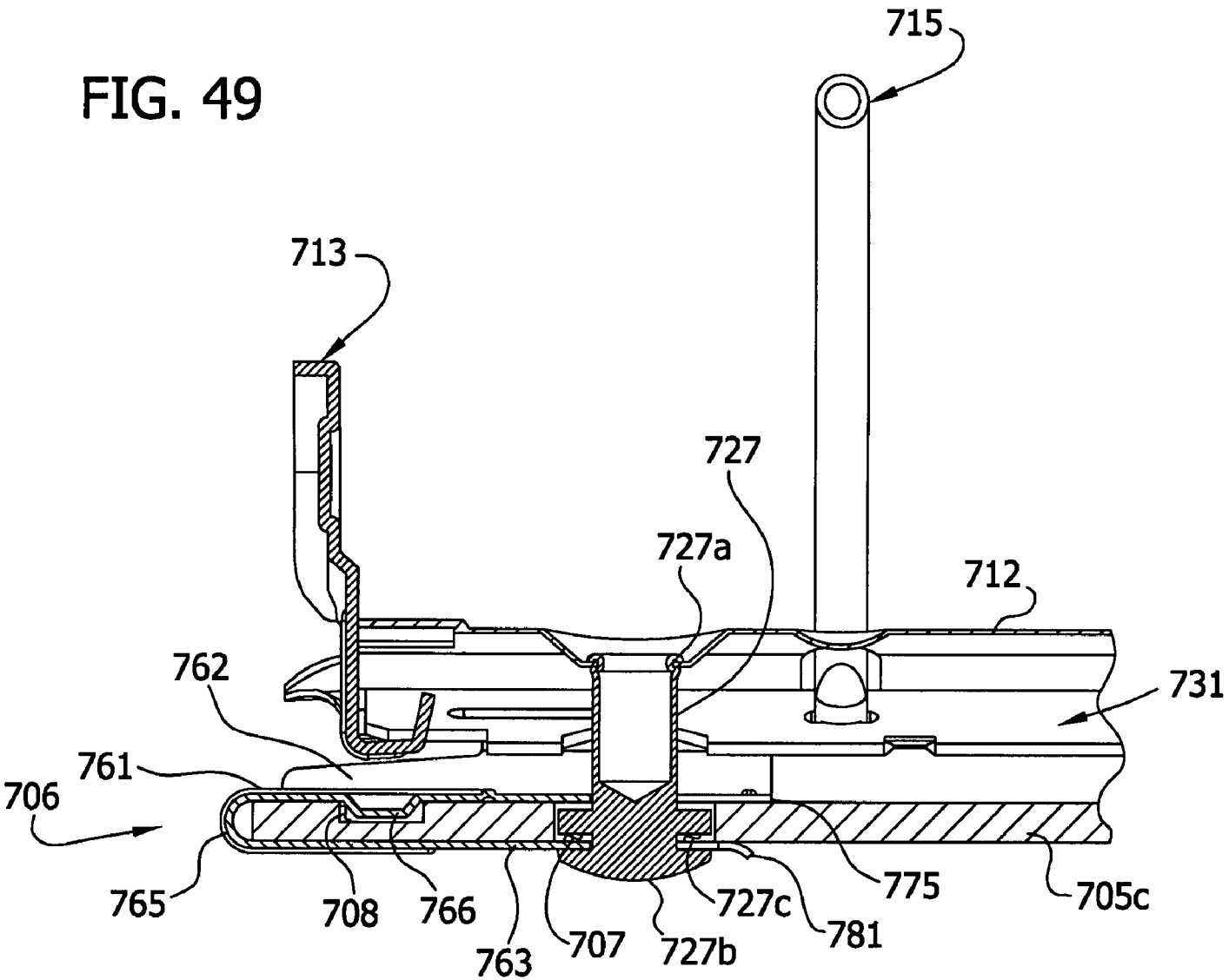
FIG. 49 is a section taken along line 49-49 of FIG. 48.

FIGS. 45-49 show a ring binder mechanism 703 and another configuration of a clip 706 similar to the clip 606 of FIGS. 39-44. In this configuration, a second portion 763 of the clip 706 has a length that is approximately the same as a length of a first portion 761 of the clip. Both the first and second portions 761, 763 of the clip 706 include slots 769, 797, respectively. As shown in FIG. 49, a housing 712 of a ring binder mechanism 703 includes a mounting post 727 having a flange 727*b*. The flange 727*b* includes an annular recess 727*c*. In use, the slot 769 in the first portion 761 of the clip 706 receives a portion of the mounting post 727 above the flange, and the slot 797 in the second portion 763 aligns with the recess 727*c* in the mounting post. A portion of the flange 727*b* above the recess 727*c* is disposed in an opening 707 in the cover 705 and thus, locates the mounting post 727 as well as the rest of the ring binder mechanism 703 with respect to the cover. In this configuration, the first portion 761 also includes a protuberance 766 for extending into a recess 708 in the cover 705 to inhibit movement of the clip 706 with respect to the cover. Parts corresponding to those in FIGS. 27-38 are indicated by the same reference numbers plus "200".

Figure 50:
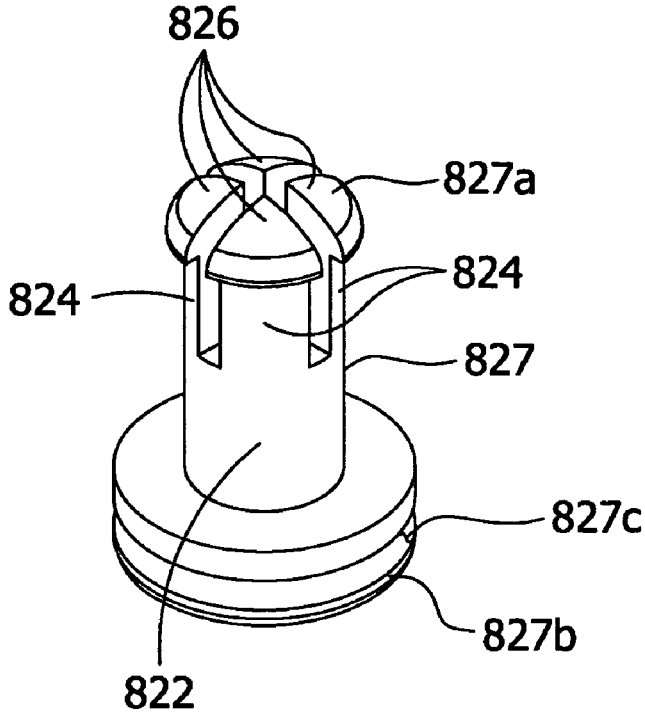
FIG. 50 is a perspective of a mounting post having another configuration.
Figure 51:
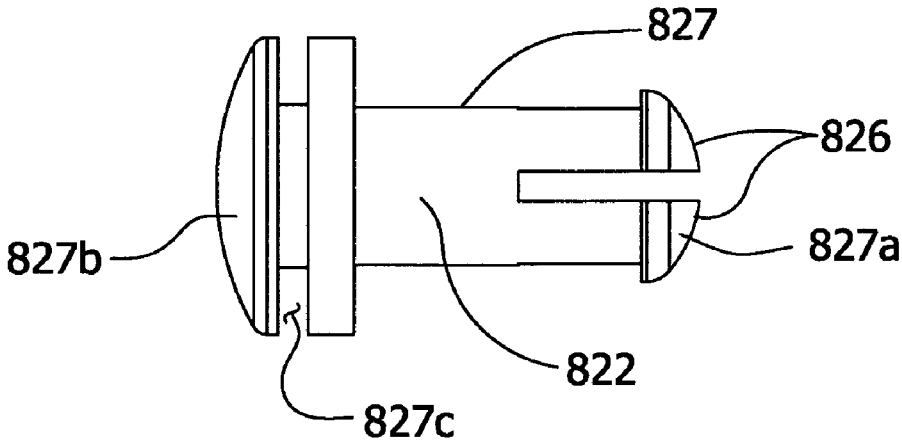
FIG. 51 is a side elevation of the mounting post.
Figure 52:
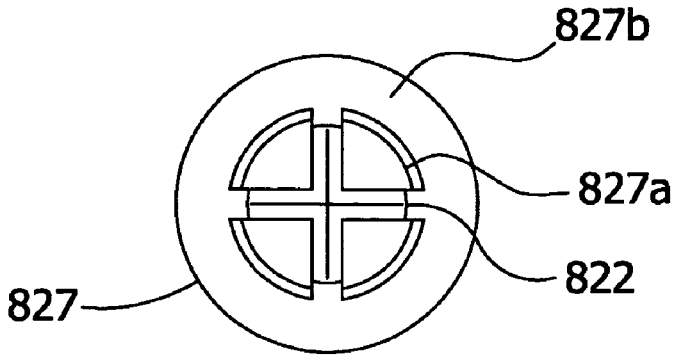
FIG. 52 is a top plan view of the mounting post.
Figure 53:
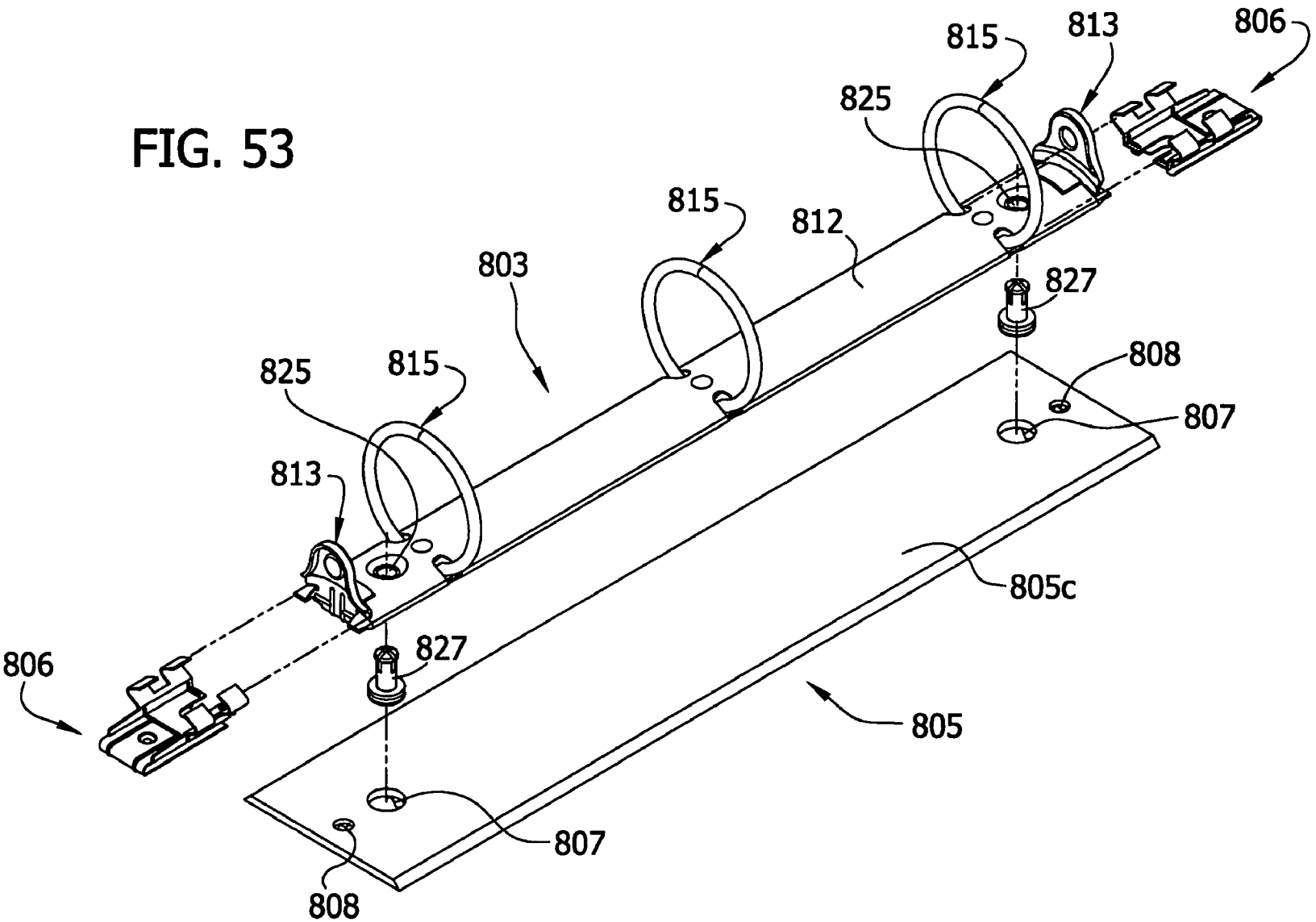
FIG. 53 is an exploded perspective showing two mounting posts, a spine of a cover, a ring binder mechanism, and two clips.
Figure 54:
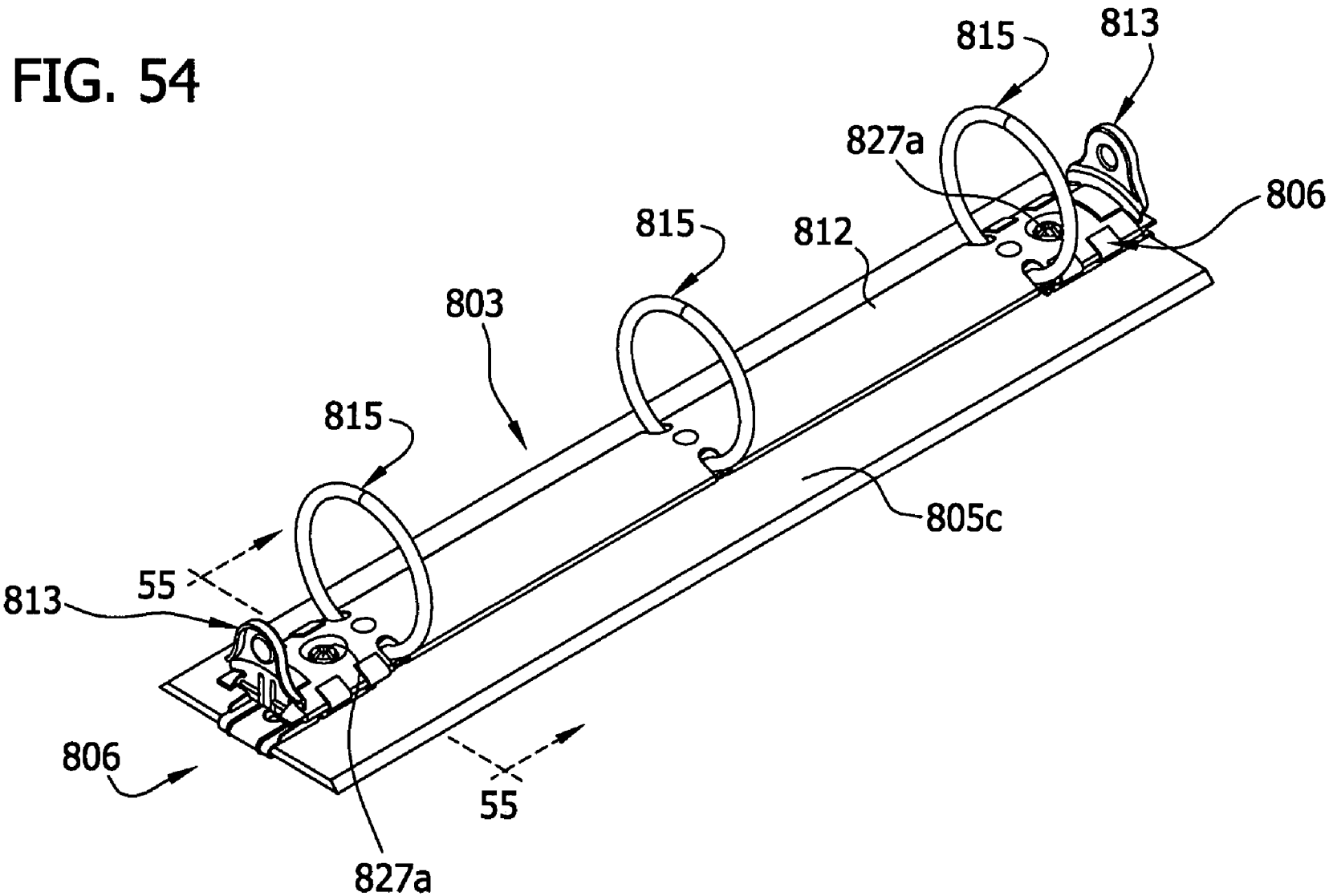
FIG. 54 is a perspective showing the mounting posts, cover, ring binder mechanism, and clips assembled.
Figure 55:
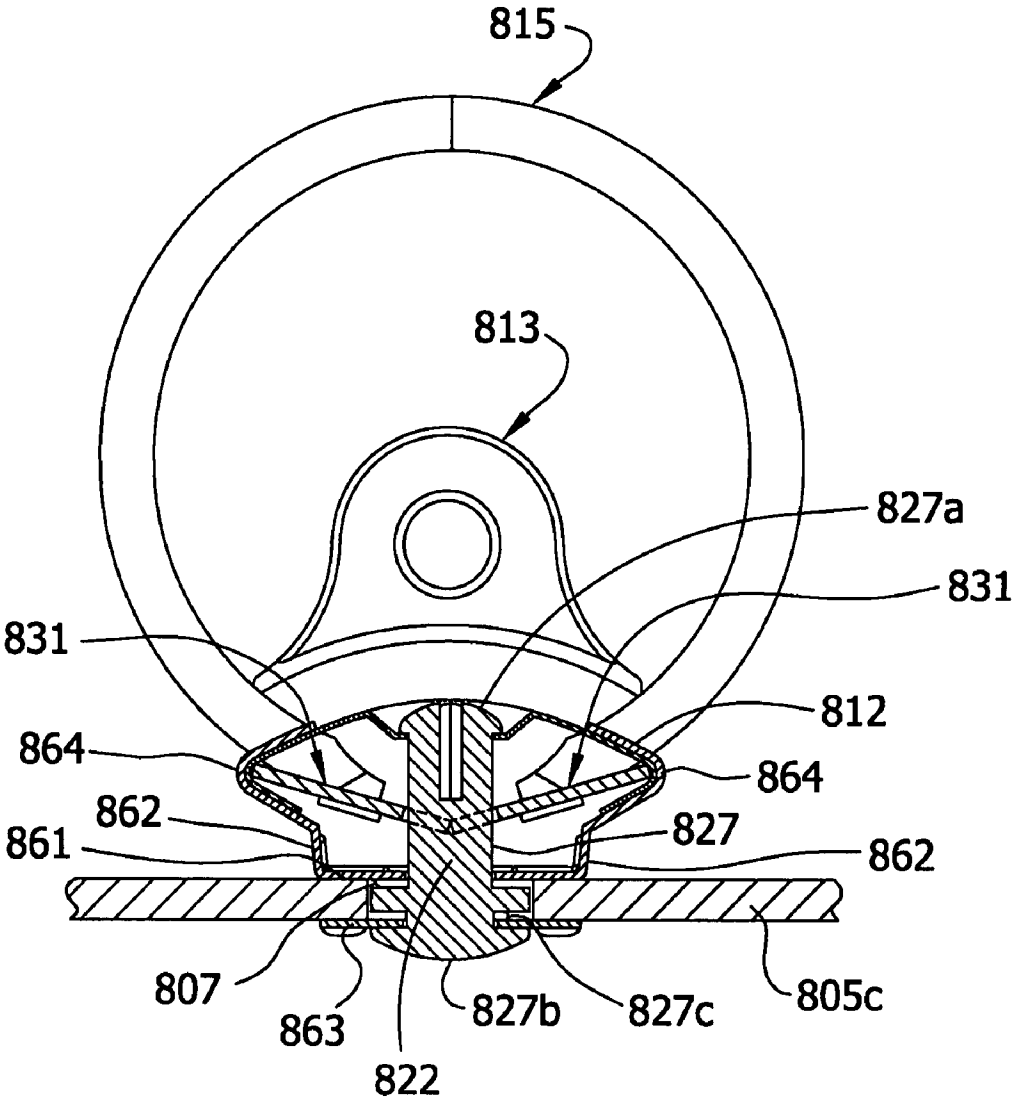
FIG. 55 is a section taken along line 55-55 of FIG. 54.
Figure 56:
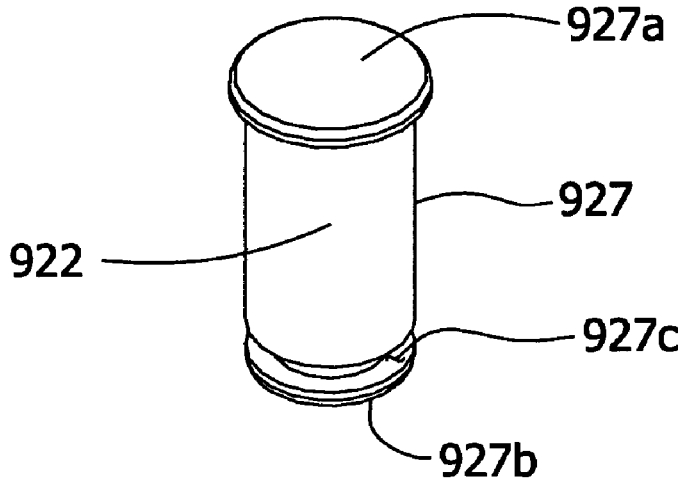
FIG. 56 is a perspective of a mounting post having yet another configuration.
Figure 57:
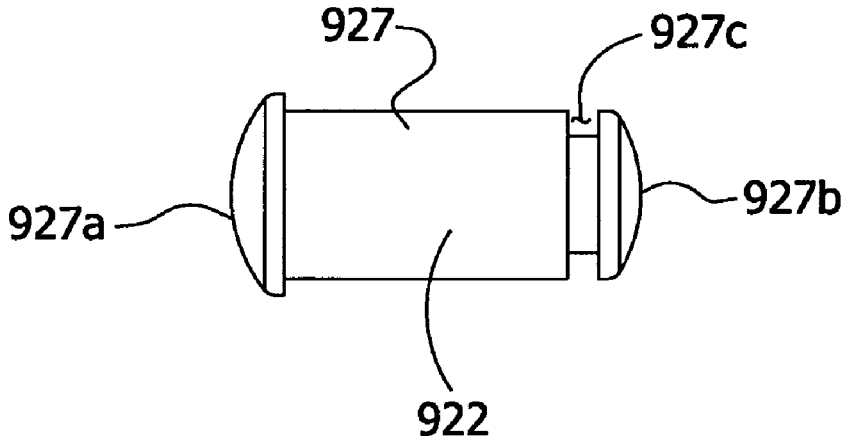
FIG. 57 is a side elevation of the mounting post of FIG. 56.

FIGS. 50-55 shows a ring binder mechanism 803 including a mounting post 827 having a different configuration than the mounting post 727 shown in FIGS. 45-49. A clip 806, however, is substantially the same as the clip 706 shown in FIGS. 45-49. The mounting post 827 includes a tubular body 822 having a snap connector 827*a* at one end and a flange 827*b* at the end opposite the connector. The snap connector 827*a* is adapted for snap connection with an opening 825 in a housing 812 of the ring binder mechanism 803 (FIGS. 53-55). The snap connector 827*a* comprises four prongs extending outwardly from the tubular body the mounting post 827 (FIGS. 50-52). Each of the prongs has a stem 824 with a generally triangle shaped cross-section and a triangular head 826 disposed on the top of each of the stems. As a result, the heads 826 of the stems 824 cooperate to have an effective diameter greater than the diameter of the tubular body 822 of the mounting post 827. In use, the heads 826 of the snap connector prongs are inserted into the opening 825 in the housing 812. As the prongs are being inserted through the opening 825, the heads 826 of the stems 824 deflect toward each other allowing them to pass through the opening. Once the heads 826 are through, the heads return to approximately their original shape so that the heads partially overlie the housing and thereby secure the mounting post 827 to the housing 812. The flange 827*b* includes an annular recess 827*c*. In use, a slot in the first portion 861 of the clip 806 receives a portion of the mounting post 827 above the flange, and a slot in the second portion 863 aligns with the recess 827*c* in the mounting post (FIG. 55). A portion of the flange 827*b* above the recess 827*c* is disposed in an opening 807 in the cover 805, and thus locates the mounting post 827 as well as the rest of the ring binder mechanism 803 with respect to the cover. Parts corresponding to those in FIGS. 27-38 are indicated by the same reference numbers plus "300".

Figure 58:
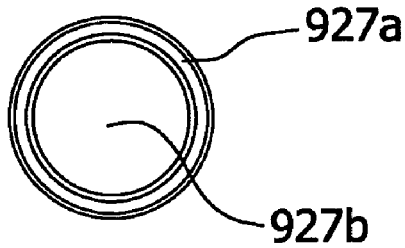
FIG. 58 is a top plan view of the mounting post.
Figure 59:
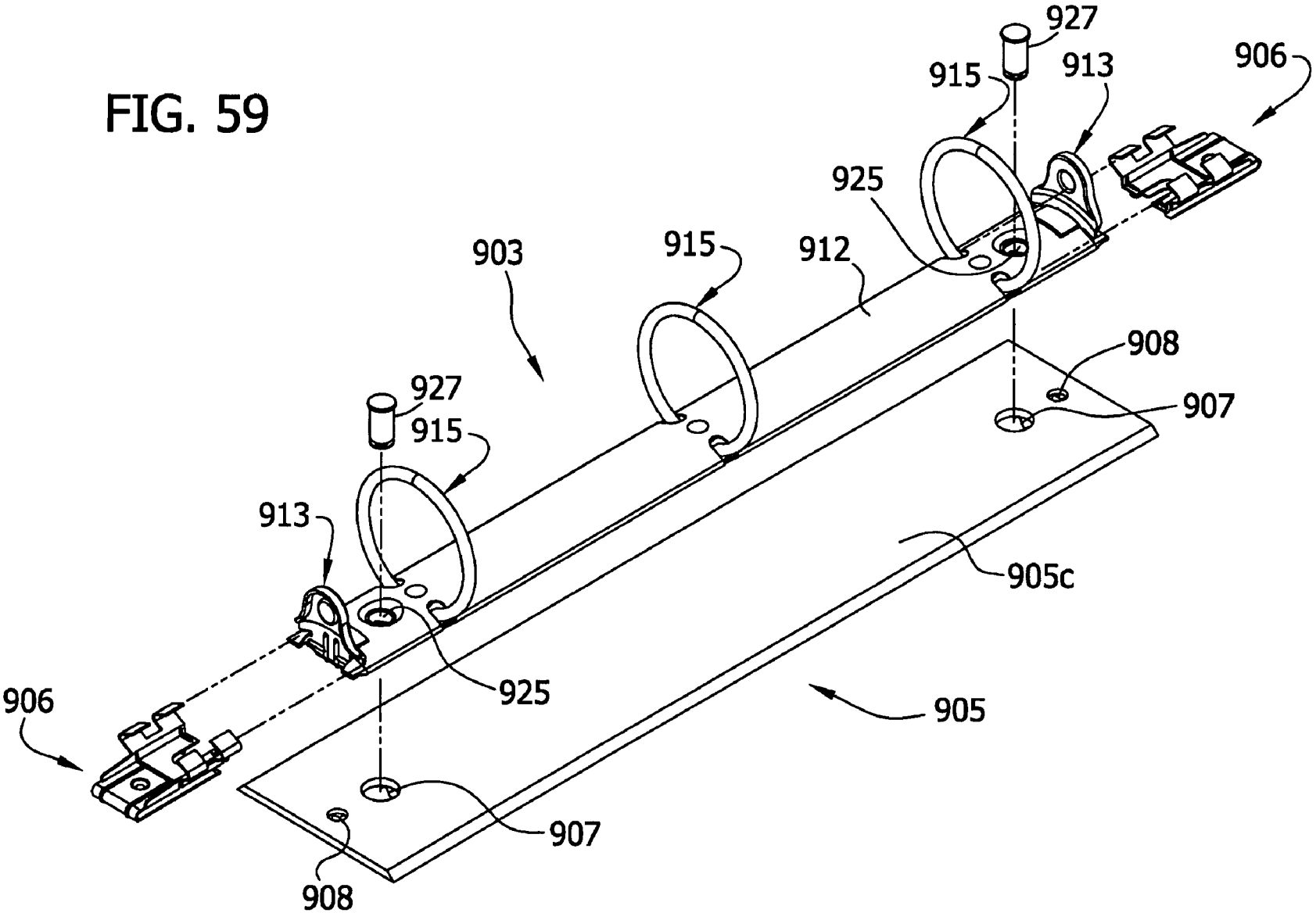
FIG. 59 is an exploded perspective showing two mounting posts, a spine of a cover, a ring binder mechanism, and two clips.
Figure 60:
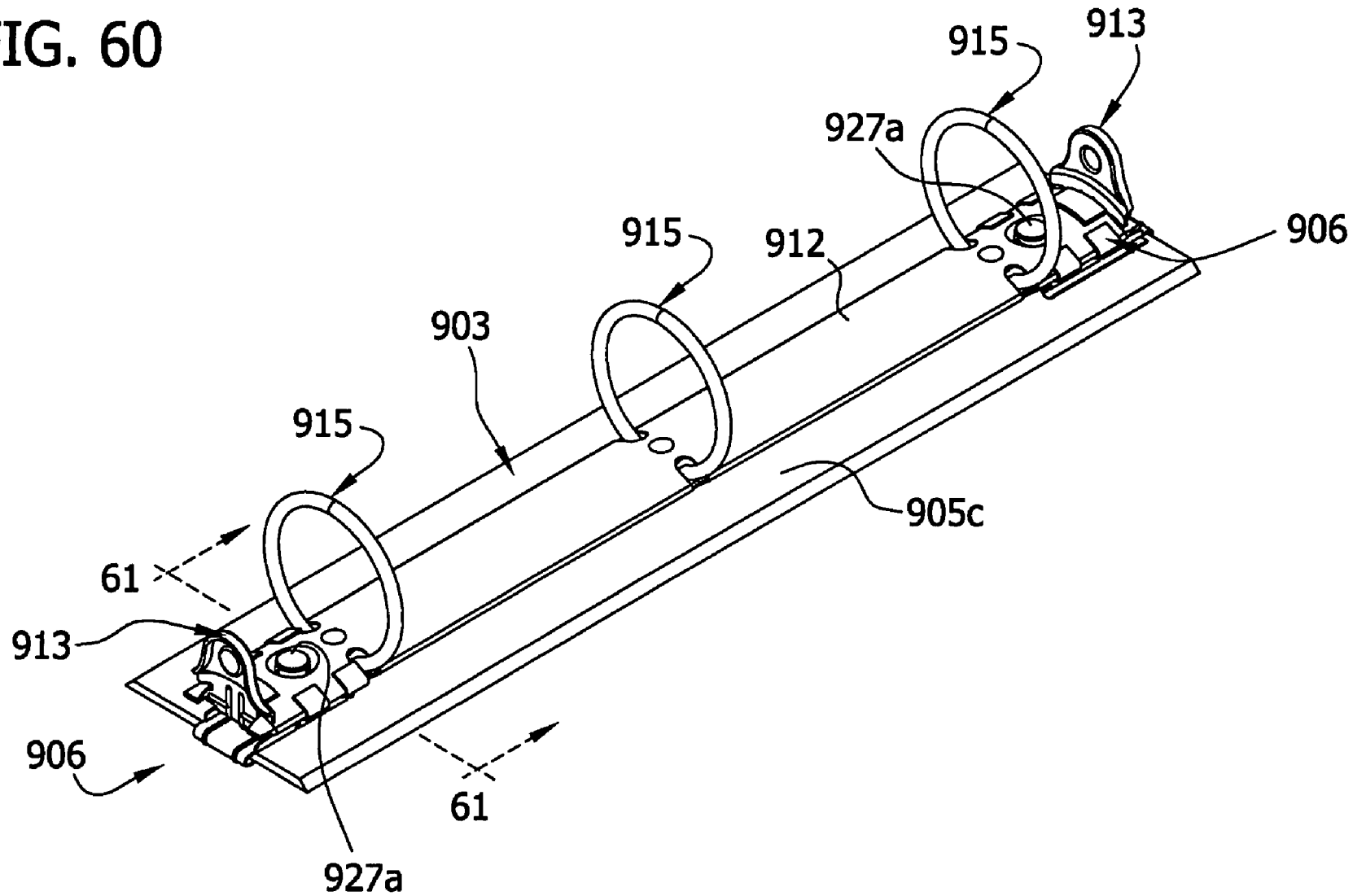
FIG. 60 is a perspective showing the mounting posts, cover, ring binder mechanism, and clips assembled.
Figure 61:
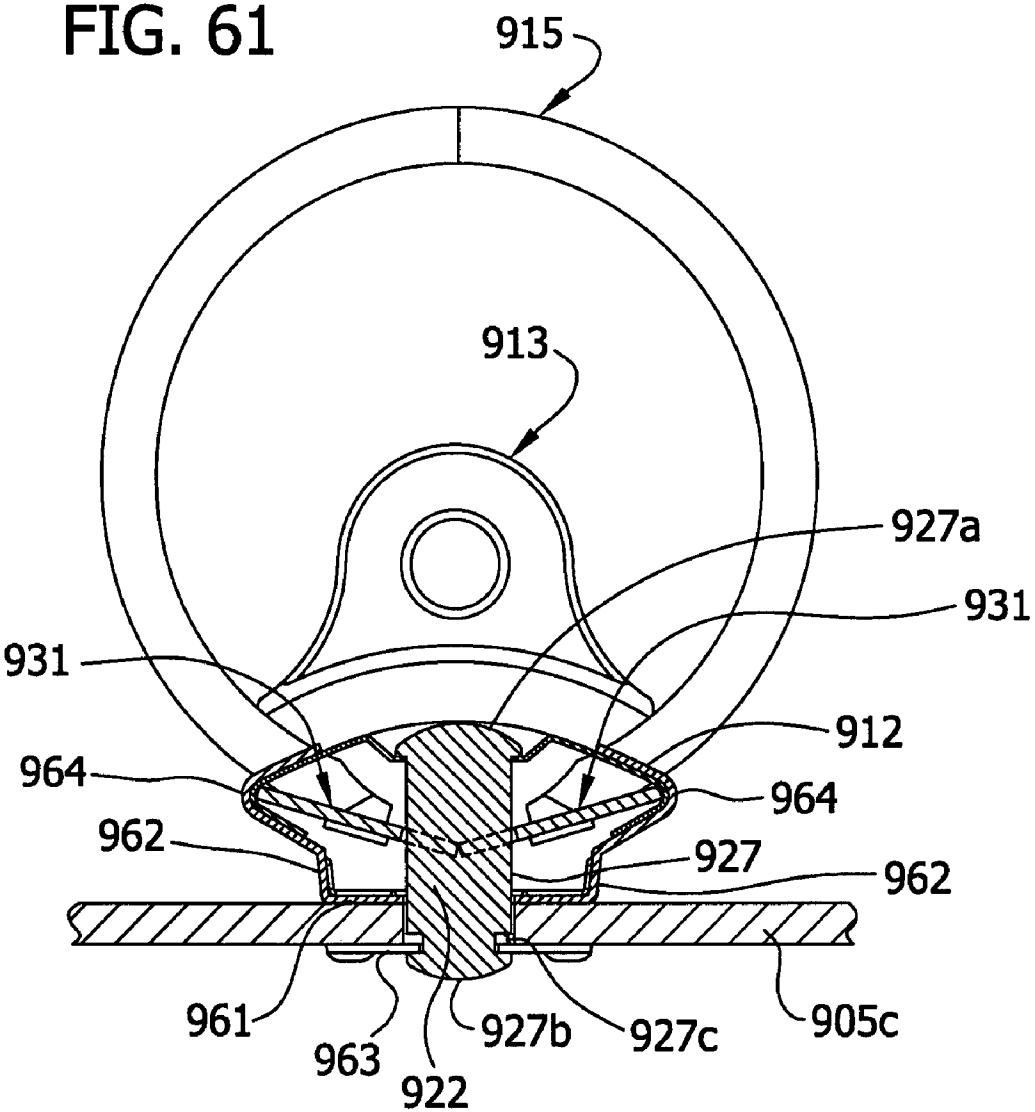
FIG. 61 is a section take along line 61-61 of FIG. 60.
Figure 62:
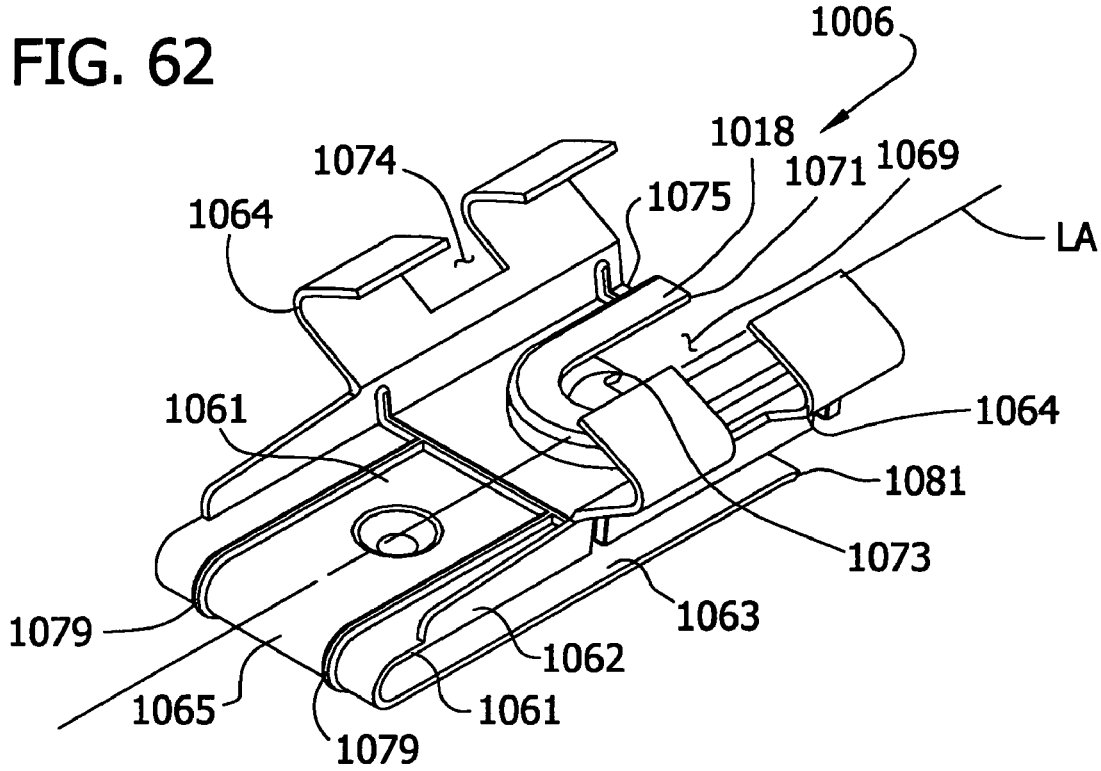
FIG. 62 is a perspective of a clip having another configuration.
Figure 63:
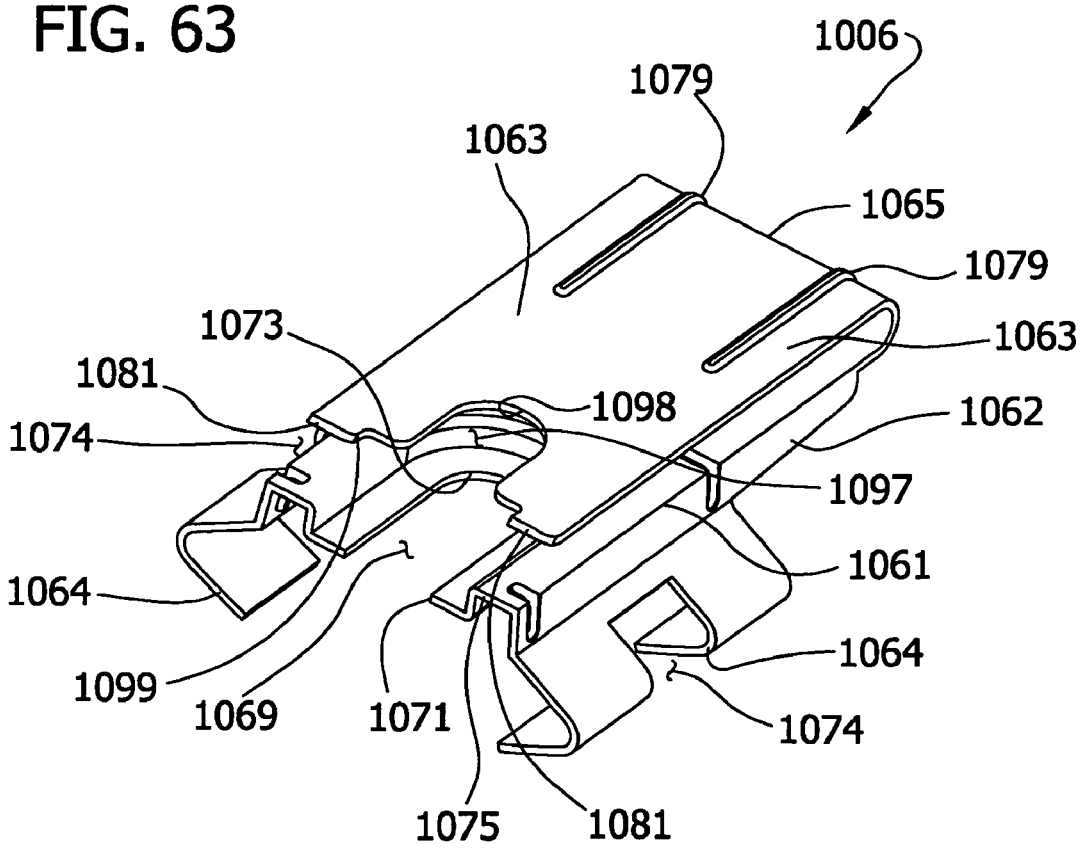
FIG. 63 is a bottom side perspective of the clip of FIG. 62.
Figure 64:
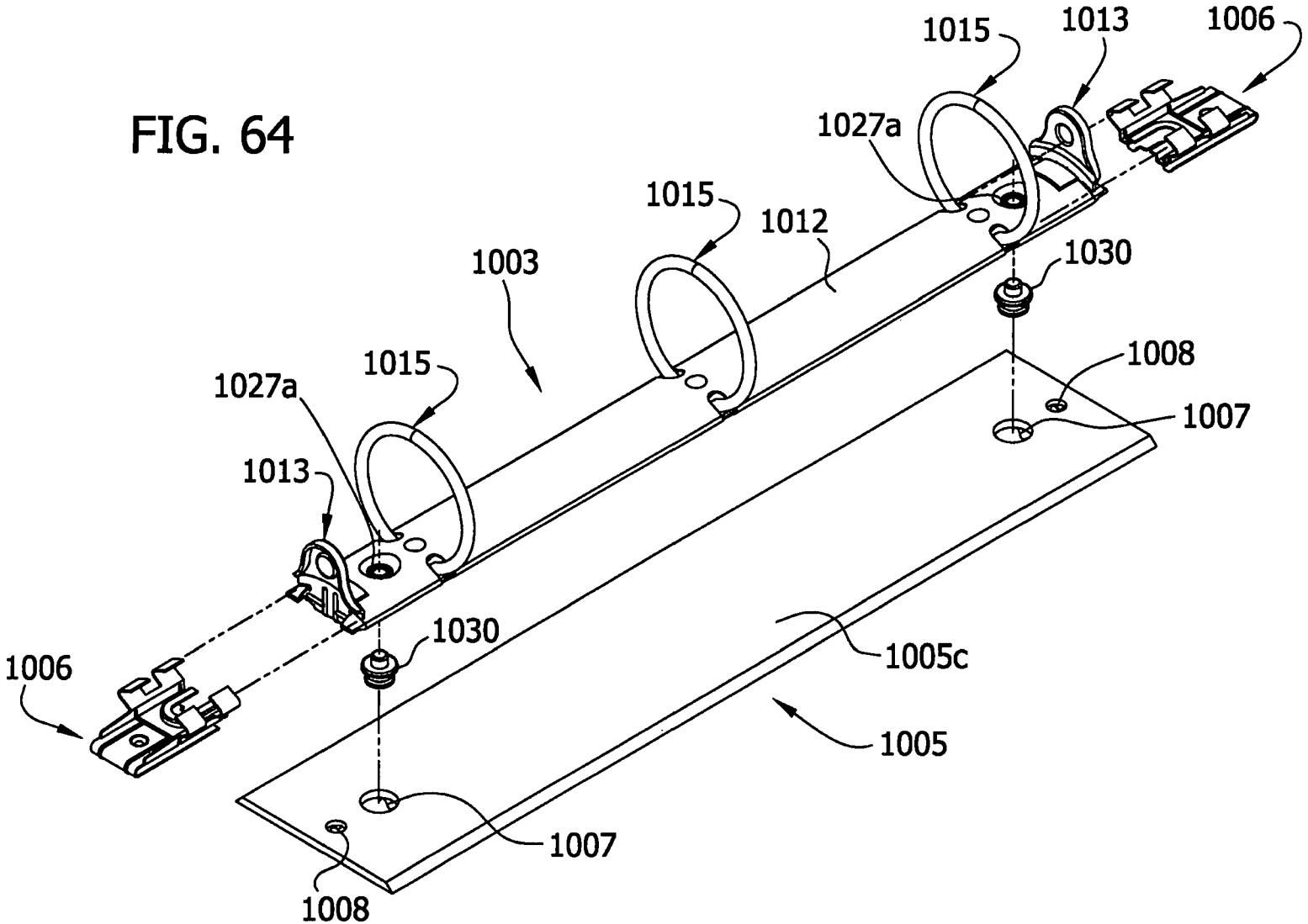
FIG. 64 is an exploded perspective showing two clips, a ring binder mechanism, a spine of a cover, and two mounting post, the mounting posts having still yet another configuration.
Figure 65:
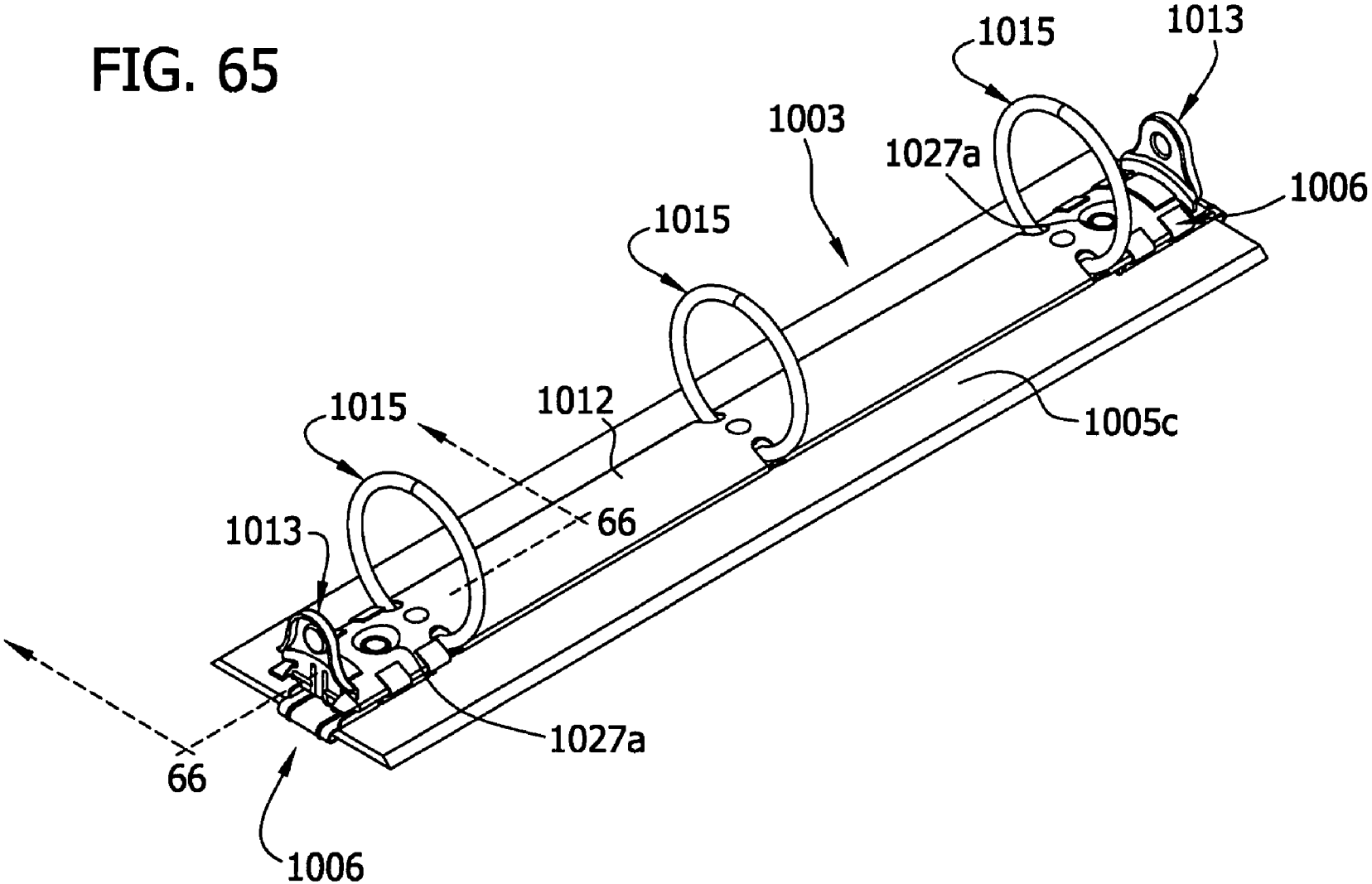
FIG. 65 is a perspective similar to FIG. 64 except the clips are securing the ring binder mechanism to the cover.

FIGS. 56-61 show a ring binder mechanism 903 having a mounting post 927 of another configuration. A clip 906, however, is substantially the same as the clip 706 shown in FIGS. 45-49 and the clip 806 shown in FIGS. 50-55. In this configuration, the mounting post 927 includes a tubular body 922 having a large head 927*a* at one end and a small head 927*b* (broadly, a snap connector) at the opposite end. Between the body 922 and the small head 927*b* is an annular recess 927*c*. As illustrated in FIG. 58, the mounting post 927 is inserted into an opening 925 in a housing 912 of the ring binder mechanism 903. The large head 927*a* has a diameter greater than the opening 925 in the housing 912 and engages the housing adjacent the opening (FIG. 60). In use, the tubular body 922 of the mounting post 927 is received in a slot (not shown) of a first portion 961 of a clip 906. The portion of the tubular body 922 disposed between the slot and the annular recess 927*c* of the mounting post 927 is positioned within an opening 907 in a spine 905*c* of a cover 905. A slot (not shown) in a second portion 963 of the clip 906 receives the portion of the mounting post 927 within the recess 927*c* and the portion of the clip adjacent the slot is engage by the smaller head 927*b* of the mounting post. As a result, the housing 912 of the ring binder mechanism 903 is mounted on the cover 905. Parts corresponding to those in FIGS. 27-37 are indicated by the same reference numbers plus "400".

Figure 66:
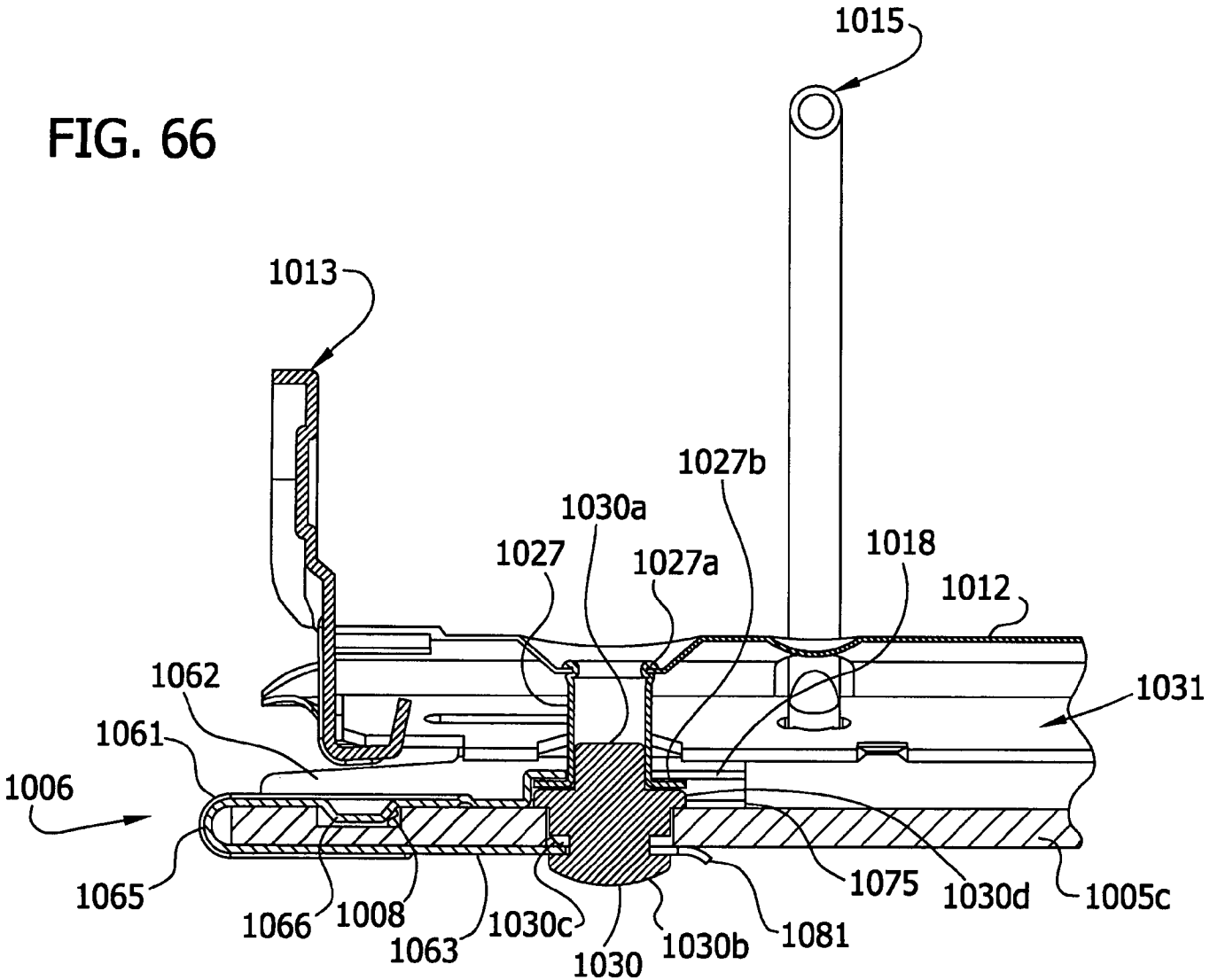
FIG. 66 is a section taken along line 66-66 of FIG. 65.

FIGS. 62-66 show a ring binder mechanism 1003 having a clip 1006 of yet another configuration. The clip 1006 in this configuration is similar to the clip shown in FIGS. 45-49. However, the clip 1006 in this configuration includes a raised part 1018 having a generally U-shape surrounding a slot 1069 in a first portion 1061 of the clip. As shown in FIG. 66, a mounting post 1027 includes a tubular body defining an interior space and two open longitudinal ends. A first end includes a deformable lip 1027*a* for attaching the mounting post to one of the openings in the housing 1012. A second end of the mounting post 1027 includes a flange 1027*b* that extends outwardly from the mounting post. A spacer 1030 has a generally cylindrical body with a rounded end 1030*b*. Adjacent the rounded end 1030*b* is an annular recess 1030*c* for receiving a slot 1097 of a second portion 1063 of the clip 1006. Opposite the rounded end 1030*b* of the space 1030 is a cylindrical nub 1030*a* adapted for insertion into tubular body of the mounting post 1027. Adjacent the nub 1030*a* is a flange 1030*d* adapted for face-to-face engagement with the flange 1027*b* of the mounting post 1027.

In use, the slot 1069 in the first portion 1061 of the clip 1006 receives a portion of the mounting post 1027 above the flange 1027*b*. As shown in FIG. 66, the flange 1030*d* of the spacer 1030 is sandwiched between the flange 1027*b* of the mounting post 1027 and the cover 1005. The raised portion 1018 of the clip 1006 adjacent the slot 1069 is sized and shaped to accommodate both the flange 1027*b* of the mounting post 1027 and the flange 1030*d* of the spacer 1030. The slot 1097 in the second portion 1063 of the clip 1006 aligns with the recess 1030*c* in the spacer 1030. A portion of the spacer 1030 above the recess 1030*c* and below the flange 1030*d* is disposed in an opening 1007 in the cover 1005. In this configuration, the first portion 1061 also includes a protuberance 1066 for extending into a recess 1008 in the cover 1005 to inhibit movement of the clip 1006 with respect to the cover. As a result, the clip 1006 securely attaches the housing 1012 of the ring binder mechanism 1003 to the cover 1005. Parts corresponding to those in FIGS. 27-38 are indicated by the same reference numbers plus "500".

Figure 68:
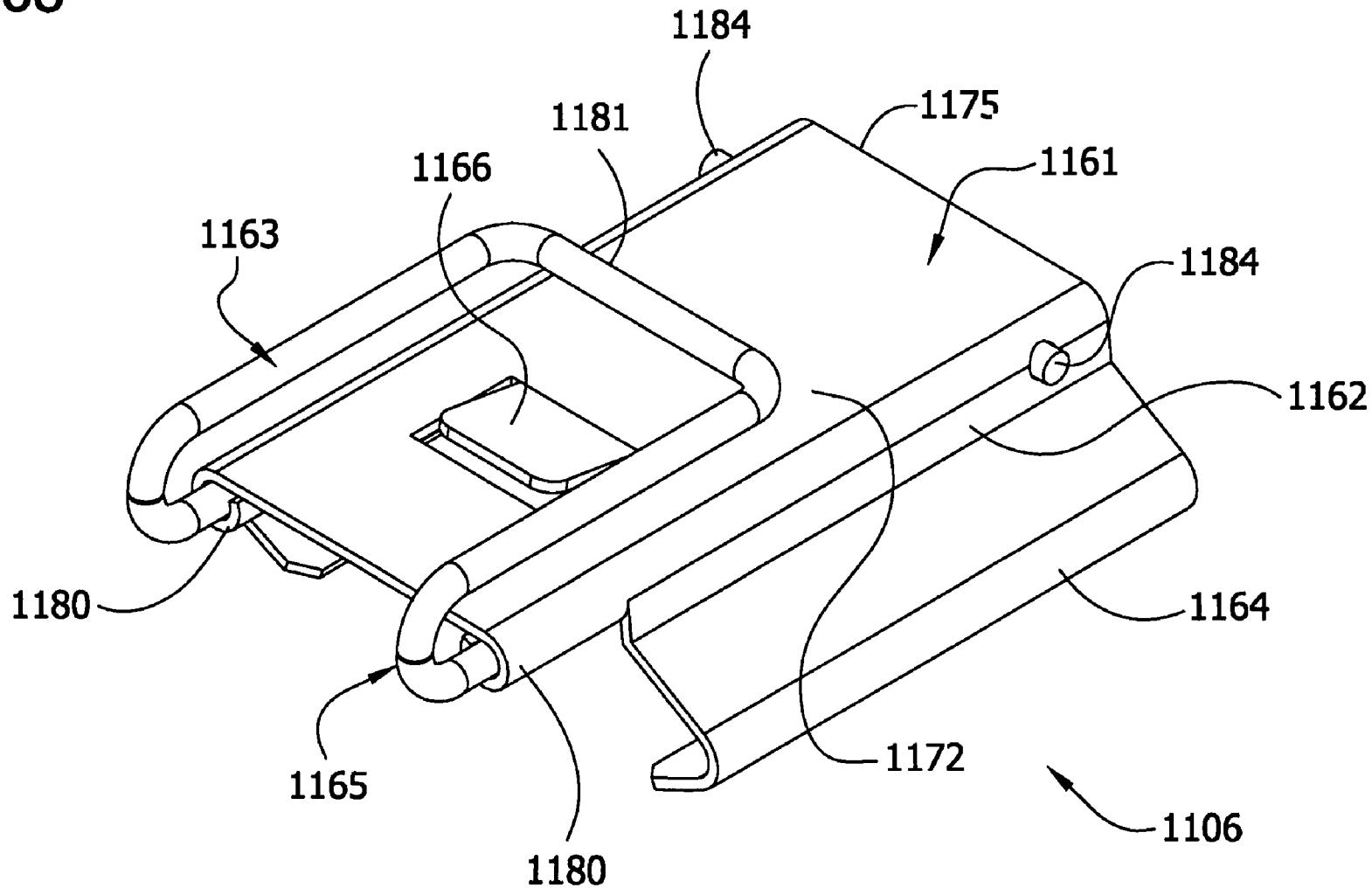
FIG. 68 is a bottom side perspective of the clip of FIG. 67.
Figure 69:
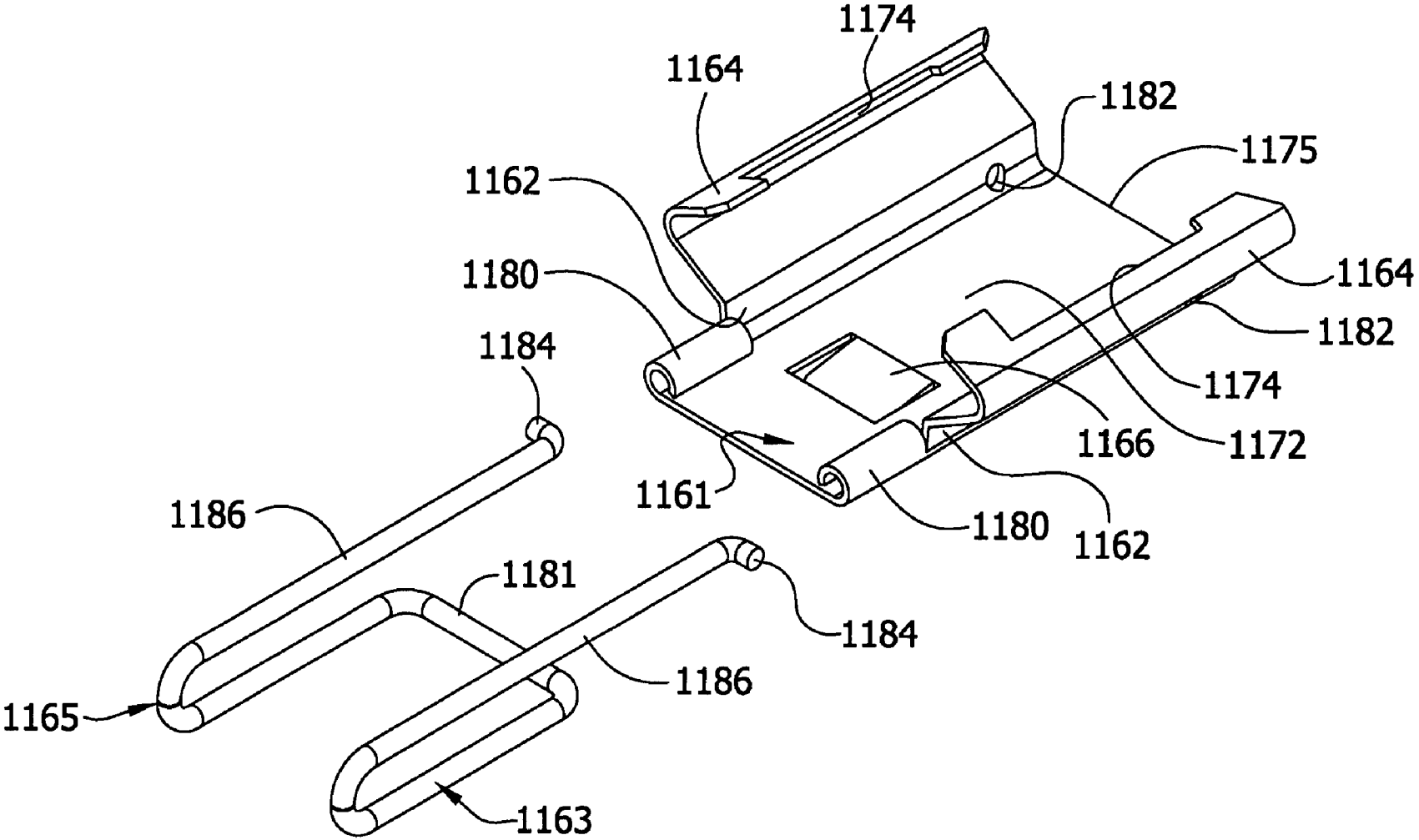
FIG. 69 is an exploded perspective of the clip.
Figure 70:
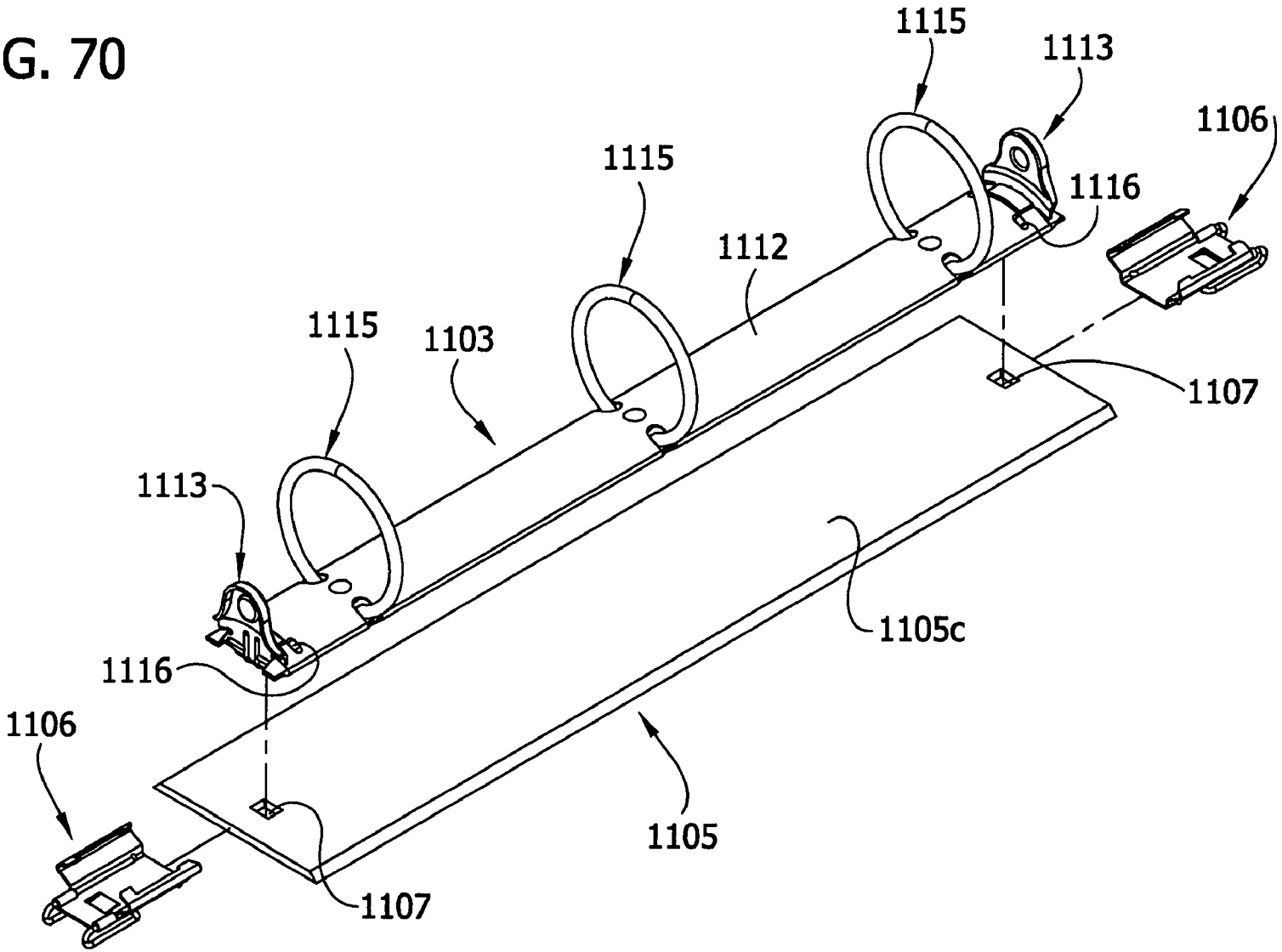
FIG. 70 is an exploded perspective showing two clips removed from a ring binder mechanism and a spine of a cover.
Figure 71:
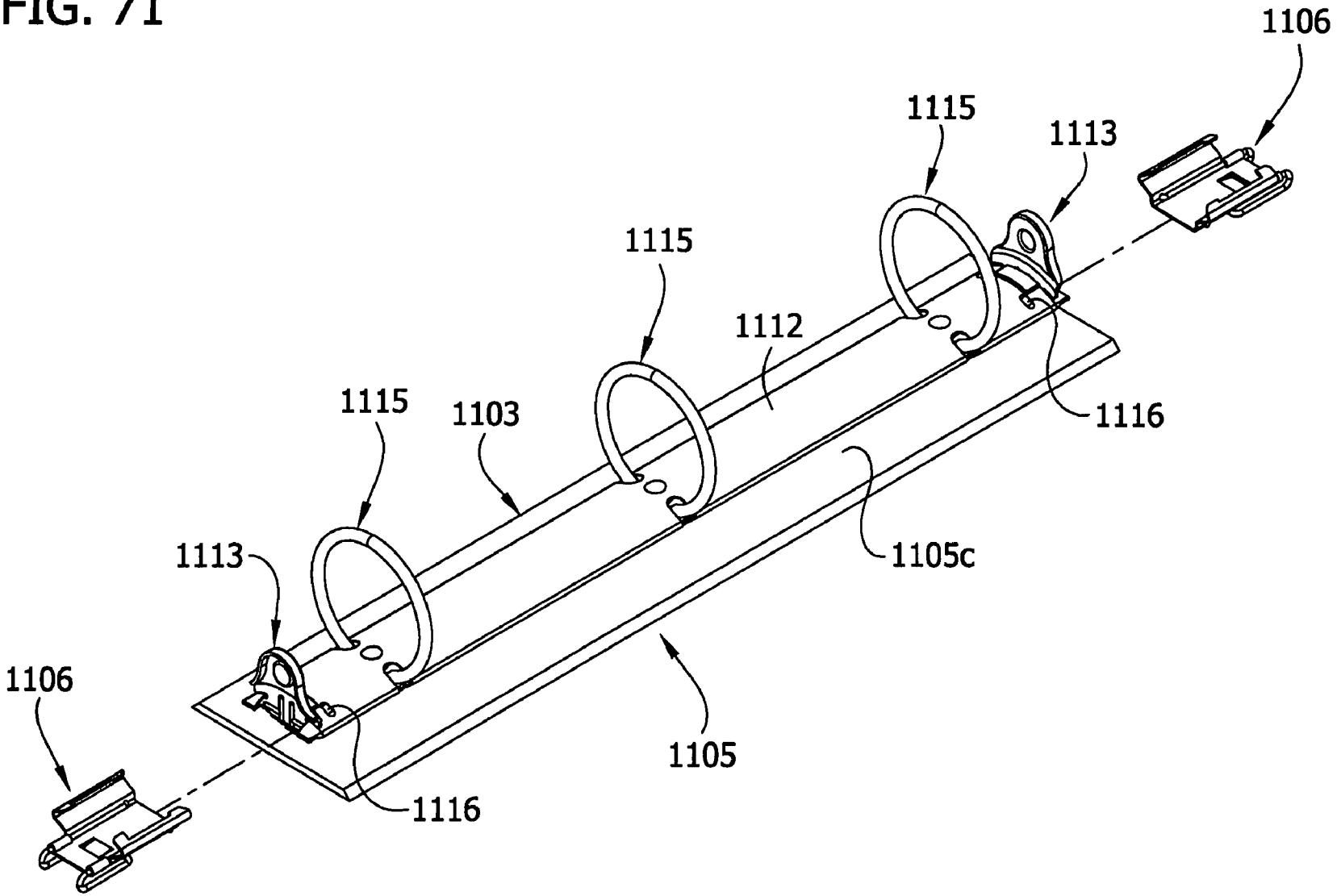
FIG. 71 is an exploded perspective similar to FIG. 70 except the ring binder mechanism is shown engaging the cover.
Figure 72:
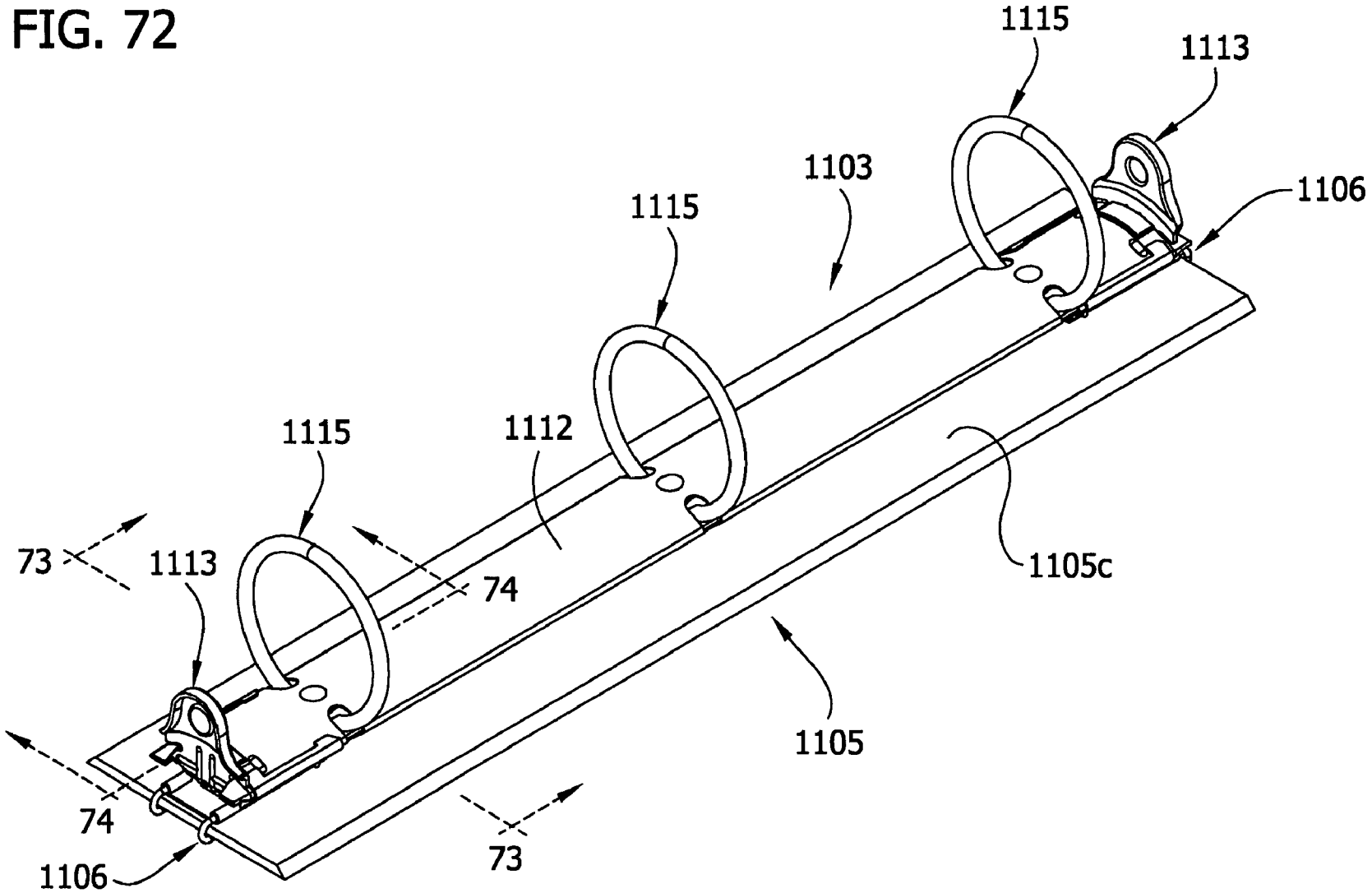
FIG. 72 is a perspective similar to FIGS. 70 and 71 except the clips are securing the ring binder mechanism to the cover.

FIGS. 67-74 show still another configuration of a clip 1106. The clip in this configuration is sized and shaped for sliding onto a housing 1112 of a ring binder mechanism 1103 and adapted to secure the housing to a cover 1105 (FIGS. 70-72). The cover 1105 is substantially the same as the cover 5 shown and described with respect to FIGS. 1-12. Parts corresponding to those in FIGS. 1-12 are indicated by the same reference numbers plus "1100".

As shown in FIGS. 70-74, the ring binder mechanism 1103 is similar to the ring binder mechanism shown in FIGS. 1-12. However, the ring binder mechanism 1103 of this configuration does not have mounting posts or circular openings in the housing for receiving and attaching the mounting posts. It is understood, however, that the ring binder mechanism may include mounting posts and circular openings without departing from the scope of this invention. In addition, four ribs 1116 are located on the outer surface of the housing 1112. More specifically, two of the ribs 1116 are located adjacent one end of the housing 1112 and the other two ribs are located adjacent the other end of the housing. The ribs 1116 are described in more detail below.

Figure 67:
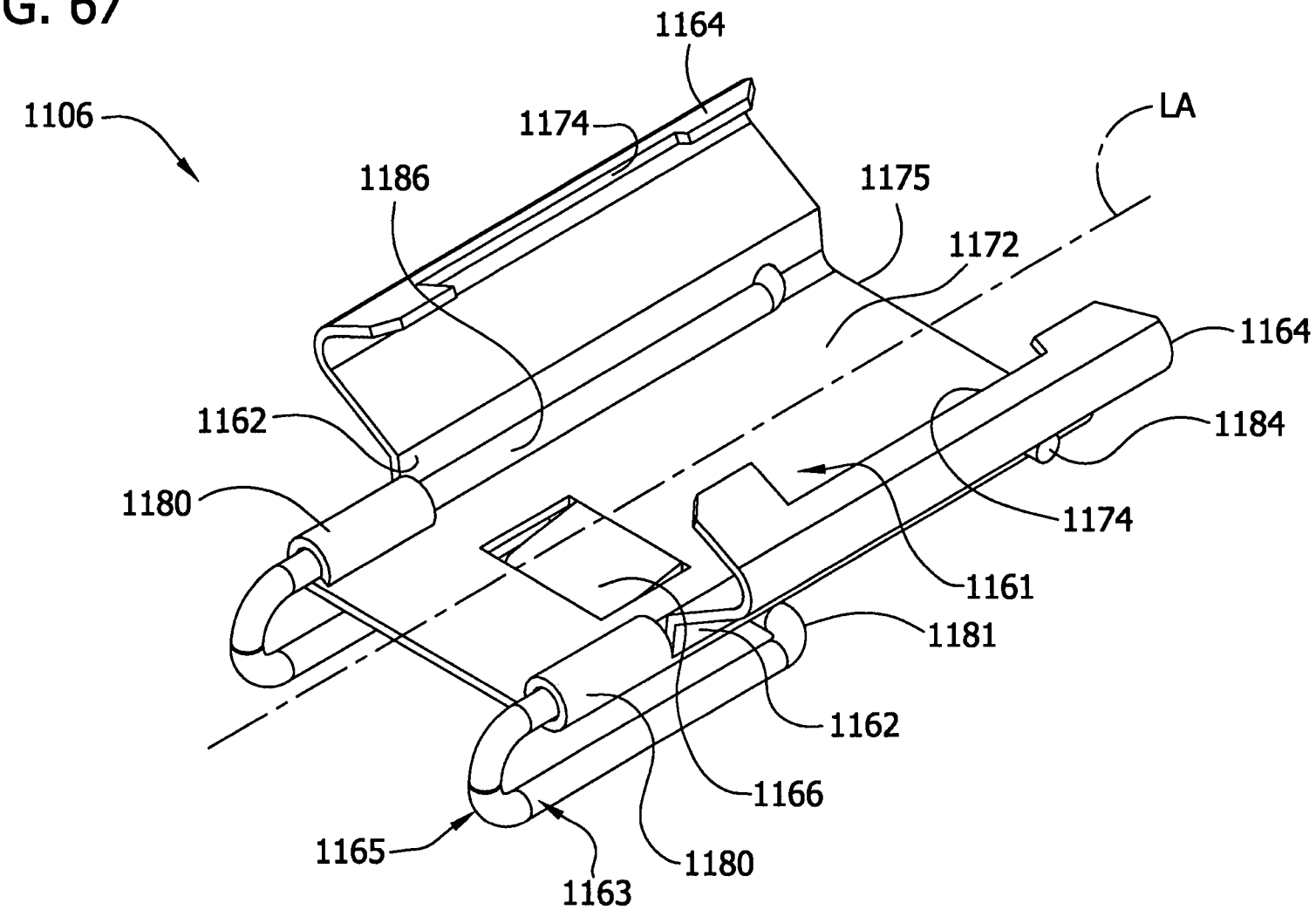
FIG. 67 is a perspective of a clip having another configuration.

As shown in FIGS. 67-69, the clip 1106 comprises a first portion 1161, a second portion 1163, and an intermediate portion 1165 connecting the first and second portions. The first portion 1161 of the clip 1106 is formed from a single-piece of generally flat sheet metal. But it is understood that first portion 1161 the clip 1106 can be made from more than one piece of metal and/or other material without departing from the scope of this invention. The second portion 1163 and intermediate portions 1165 are formed from a single-piece of bent wire that is connected to the first portion 1161. It is also understood that the second portion 1163 and intermediate portions 1165 can be made from more than one piece of metal and/or materials other than wire.

The first portion 1161 includes a base 1172 and a pair of side walls 1162 extending upwardly from the base. Each of the side walls 1162 includes an opening 1182 (FIG. 69). Extending further upwardly from the side walls 1162 and away from the base 1172 are two arms 1164 (broadly, "attachment members") adapted to engage the sides of the housing 1112 of the ring binder mechanism 1103. Each of the arms 1164 is roughly C-shaped in cross-section to match the shape of the sides of the ring binder mechanism housing 1112. The spacing between the opposed arms 1164 is slightly smaller than the width of the housing 1112 of the ring binder mechanism 1103. As the clip 1106 is slid onto the housing 1112, the arms 1164 are flexed outwardly away from a longitudinal axis of the ring binder mechanism 1103. The resiliency of the arms 1164 causes the arms to tightly grip the sides of the housing 1112 of the ring binder mechanism 1103, which attaches the housing to the clip. Each of the arms 1164 of the clips 1106 has a generally rectangular cutout 1174.

The first portion 1161 also includes a pair of knuckles 1180. Each of the knuckles is located between one of the arms 1164 of the first portion 1161 and the intermediate portion 1165. The knuckles are sized and shaped for capturing a connecting portion 1186 of the bent wire that forms the intermediate 1165 and second portion 1163 of the clip 1106. The connecting portion 1186 of the bent wire has two turned-out portions 1184 for extending into respective openings 1182 in the side walls 1162 of the clip 1106. The resiliency of the wire holds the turned-out portion 1184 in the openings 1182. The engagement of the connecting portion 1186 with the first portion 1161 via the knuckles 1180 and the openings 1182 secures the intermediate portion 1165 and the second portion 1163 to the first portion 1161. The knuckles 1180 and/or openings 1182 are broadly referred to as joining members.

Figure 73:
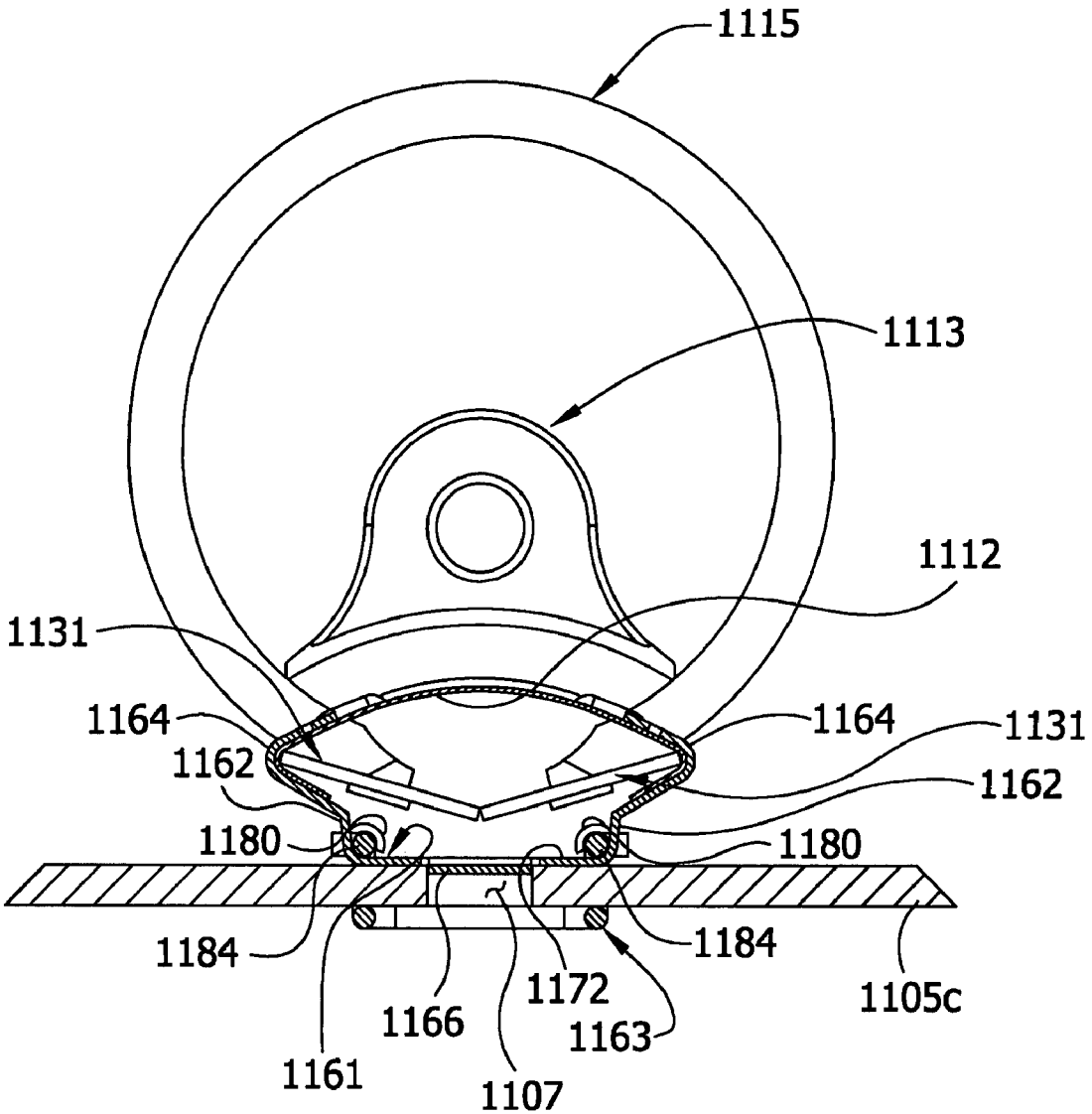
FIG. 73 is a section taken along line 73-73 of FIG. 72.
Figure 74:
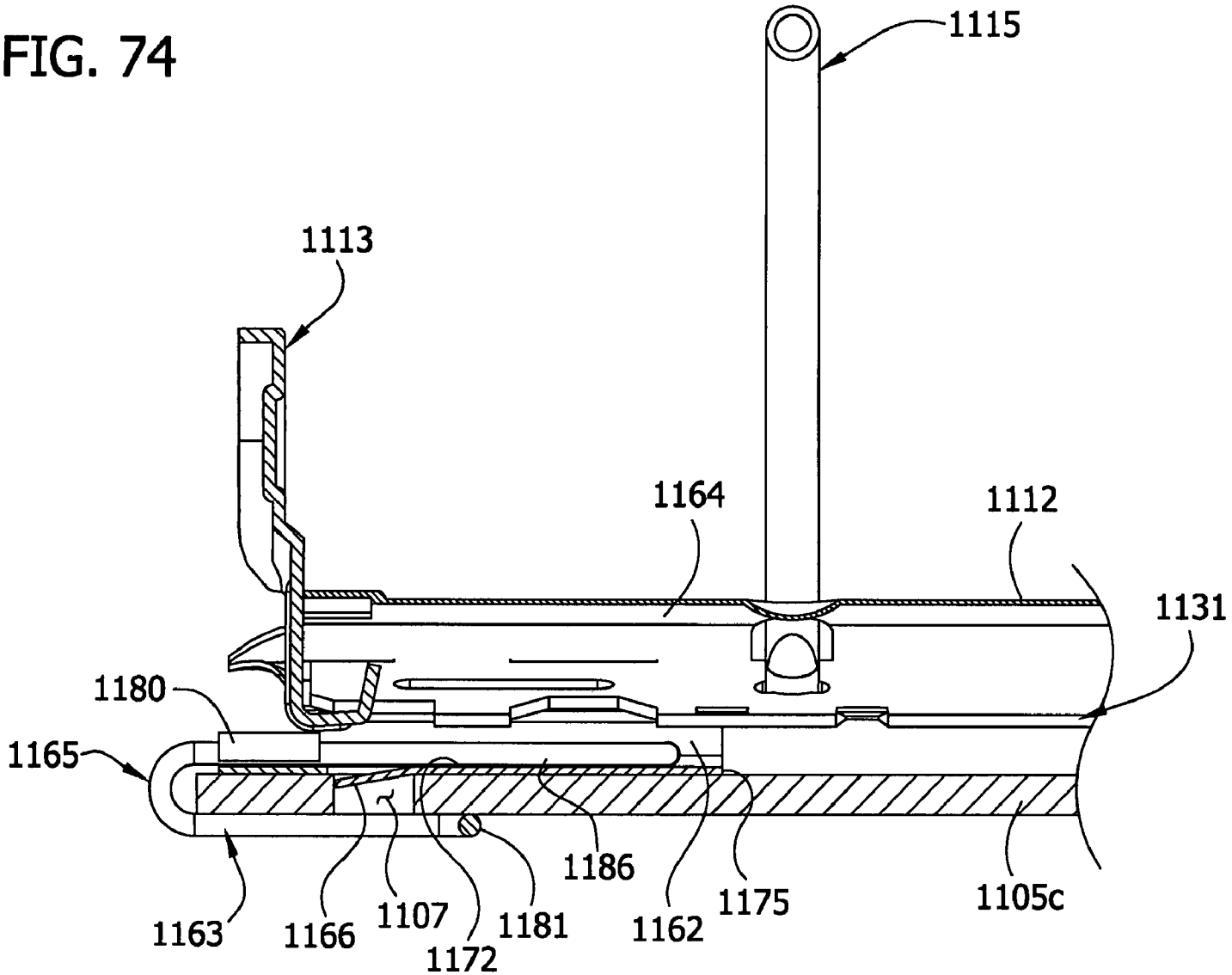
FIG. 74 is a fragmentary section taken along line 74-74 of FIG. 72.
Figure 75:
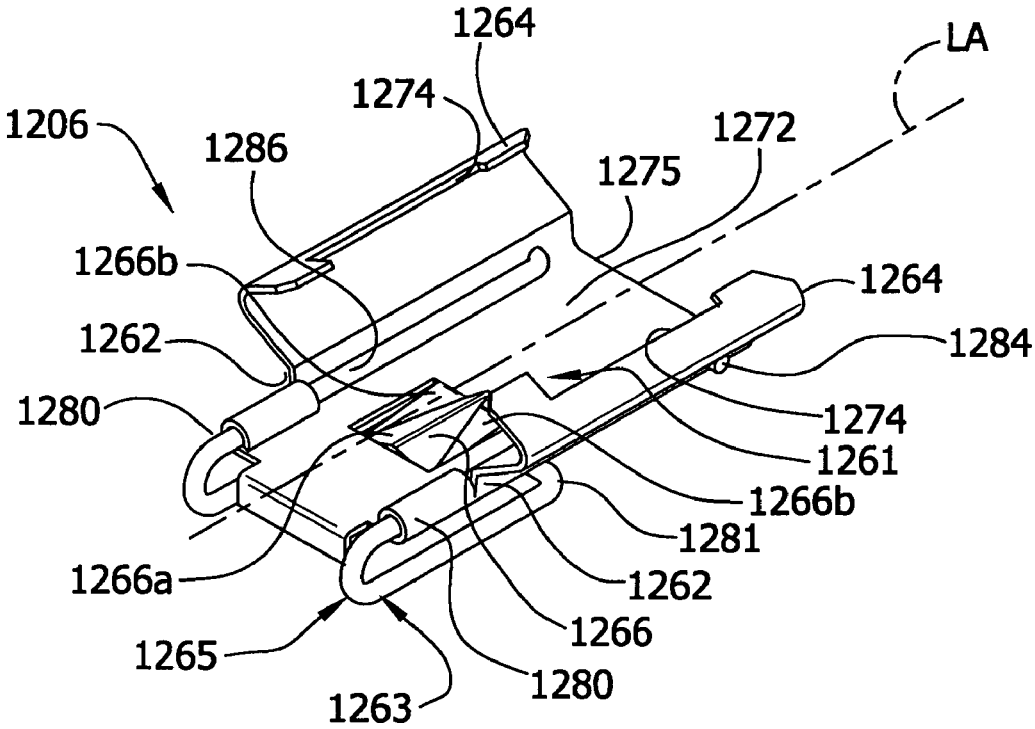
FIG. 75 is a perspective of a clip having yet another configuration.
Figure 76:
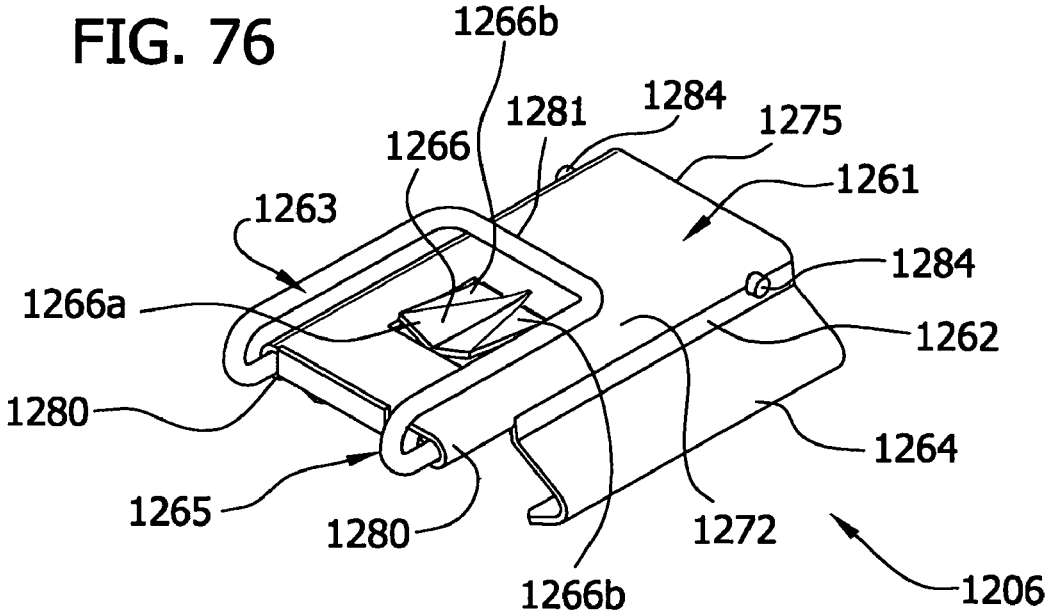
FIG. 76 is a bottom side perspective of the clip of FIG. 75.
Figure 77:
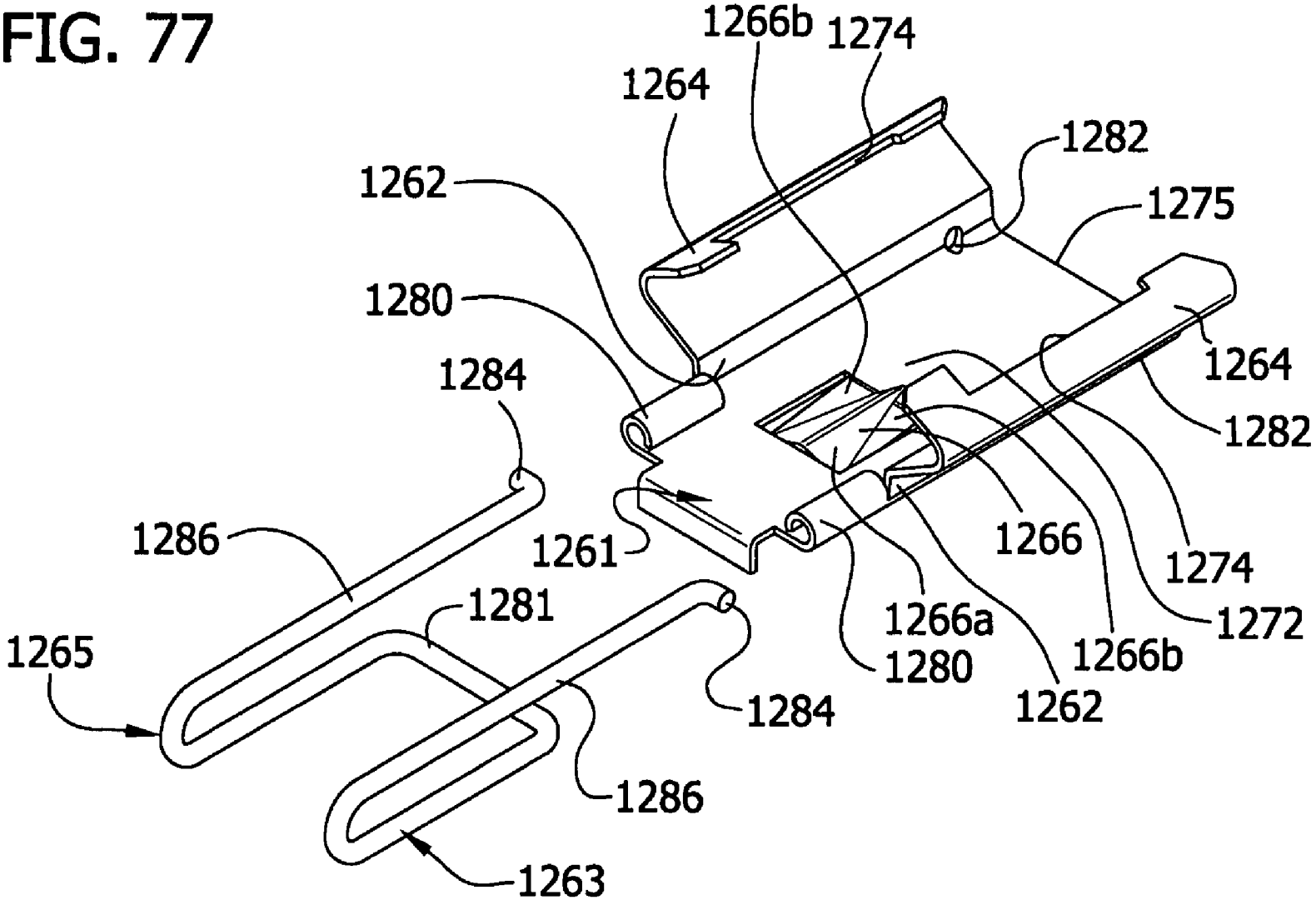
FIG. 77 is an exploded perspective of the clip.

The first portion 1161 also has a generally rectangular tab 1166 extending outwardly from the base 1172 in a direction away from the arms 1164. The tab 1166 is positioned on the first portion 1161 between the arms 1164. The tab 1166 can have other shapes and sizes than those illustrated and can be positioned at different locations on the clip 1106. When the clip is positioned on the cover 1105, the lower surface of the first portion 1161 is in face-to-face relationship with an interior surface of the cover 1105 and the tab 1166 extends into an aperture 1107 in the cover to inhibit axial movement of the clip 1106 with respect to the cover (FIGS. 73 and 74).

Referring again to FIGS. 67-69, the intermediate portion 1165 yieldably and resiliently resists movement of the first and second portions 1161, 1163 with respect to one another to prevent the clip 1106 from inadvertently disengaging the cover 1105. The intermediate portion 1165 is generally arcuate and connects the first portion to the second portion 1161, 1163. When the clip 1106 is attached to the cover 1105, the intermediate portion 1165 extends around a portion of an edge of the cover (FIGS. 72 and 74) so that the clip 1106 is clipped onto the cover.

The second portion 1163 of the clip 1106 is generally opposed to the first portion 1161. However, the length of the second portion 1163 is significantly less than the length of the first portion 1161. It is to be understood, however, that the second portion 1163 can have lengths other than those illustrated including lengths longer or equal to the length of the first portion 1161. When the clip 1106 is attached to the cover 1105, the second portion 1163 is generally in face-to-face relationship with an exterior surface of the cover (FIG. 74).

As illustrated in FIGS. 70-72, a ring binder 1101 can be assembled by placing the housing 1112 of the ring binder mechanism 1103 against a spine 1105*c* of the cover 1105. Front and back panels of the cover 1105 are not shown in FIGS. 70-72 but are the same as the front and back covers 5*a*, 5*b* shown in FIG. 1. The clips 1106 are slid onto the cover 1105 and ring binder mechanism 1103 one at a time, although a simultaneous connection would not depart from the scope of the present invention. Since both clips 1106 are attached in the same way, only one is described herein. A free outer edge 1175 of the first portion 1161 of the clip 1106 is placed against an upper edge margin of the cover 1105. The clip 1106 is pushed toward the ring binder mechanism 1103 so that the first portion 1161 slides over the interior surface of the cover 1105 and the arms 1164 engage and slide along the housing 1112. Once the tab 1166 moves into registration with the aperture 1107, the resiliency of the tab 1166 causes the tab to snap into the aperture 1107 in the spine 1105*c* (FIGS. 73 and 74). The tab 1166 inhibits the clip 1106 from being disengaged from the spine 1105*c*. Specifically, the tab 1166 is angled so that it is received in the aperture 1107 and resists forces that would otherwise disengage the clip 1106 from the spine.

While the clip 1106 is sliding on the cover 1105, the arms 1164 of the clip engage and slidingly receive the housing 1112 of the ring binder mechanism 1103. As mentioned, each of the arms 1164 are roughly C-shaped to match the shape of the sides of the ring binder mechanism housing 1112 and the spacing between the opposed arms 1164 is slightly smaller than the width of the housing 1112 of the ring binder mechanism 1103. Therefore, as the clip 1106 is slid onto the housing 1112, the arms 1164 flex outwardly away from a longitudinal axis of the ring binder mechanism 1103. The resiliency of the arms 1164 causes the arms to tightly grip the sides of the housing 1112 of the ring binder mechanism 1103, which attaches the housing to the clip. The ring binder 1101 in the illustrate configuration has ribs 1116 that act as stops for stopping the clip 1106 from being pushed too far onto the housing 1112. The ribs 1116 are positioned on the housing so that they engage a portion of the arms 1164 adjacent the cutouts 1174 in the arms 1164 (FIG. 72). Once in place, the clips 1106 secure the ring binder mechanism 1103 to the cover 1105 (FIGS. 72-74). With both clips 1106 in place, the ribs 1116 on the clips 1106 limit axial movement of the ring binder mechanism 1103. In other words, the ribs 1116 help prevent the ring binder mechanism 1103 from sliding free of the clips 1106.

Figure 78:
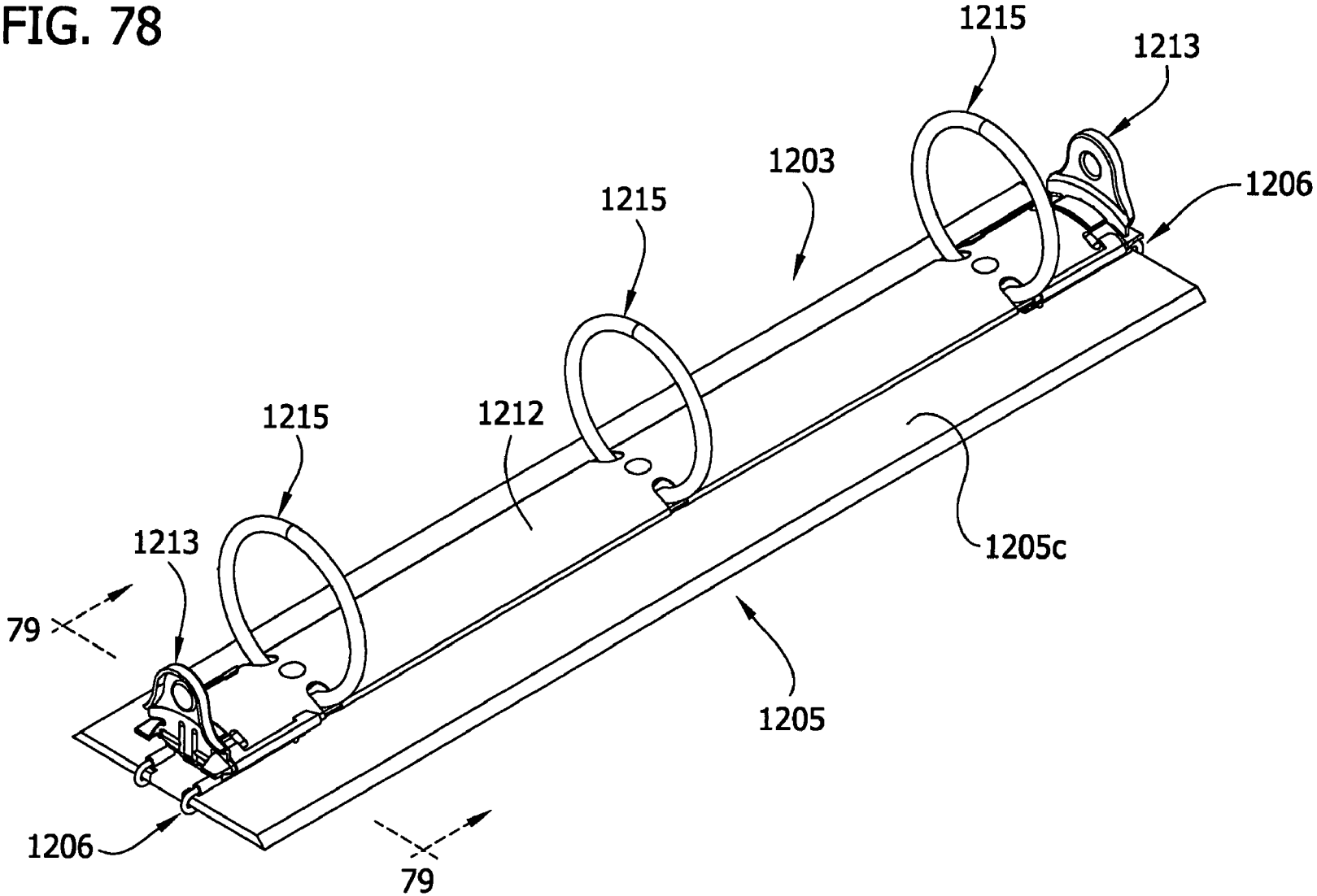
FIG. 78 is a perspective showing the clips securing a ring binder mechanism to a spine of a cover.
Figure 79:
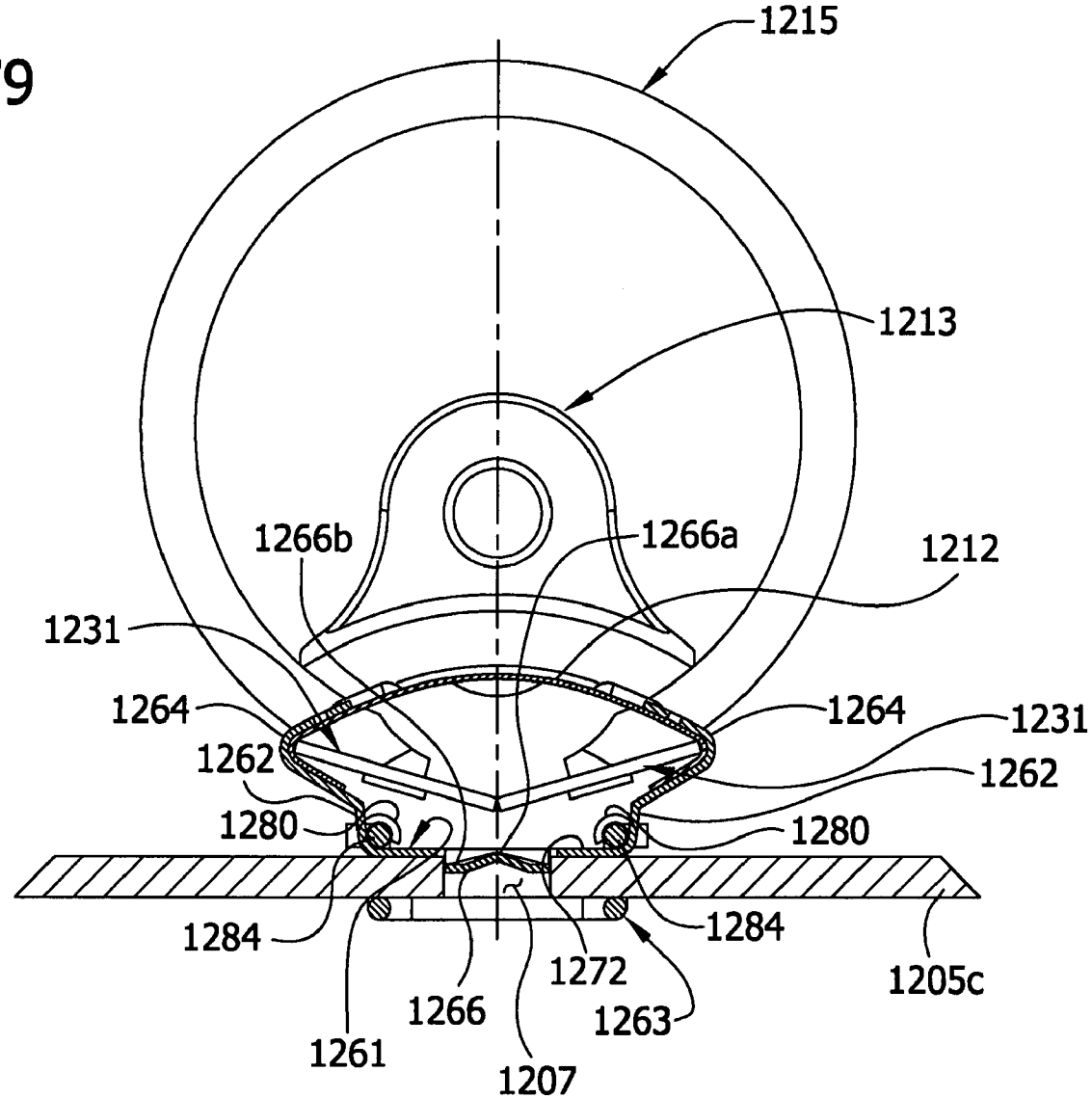
FIG. 79 is a section taken along line 79-79 of FIG. 78.

FIGS. 75-81 show a clip 1206 having a configuration substantially similar to the clip 1106 of FIGS. 67-74 except that a tab 1266 has a central portion 1266*a* with a tapering, generally V-shaped cross section and two generally triangular portions 1266*b*. The clip 1206, as in the previously described embodiments, is used to mount a ring binder mechanism 1203 on a cover 1205 (FIGS. 78 and 79). The ring binder mechanism 1203 and cover 1205 are substantially the same as the ring binder mechanism 1103 and cover 1106 shown in FIGS. 70-75.

Figure 80:
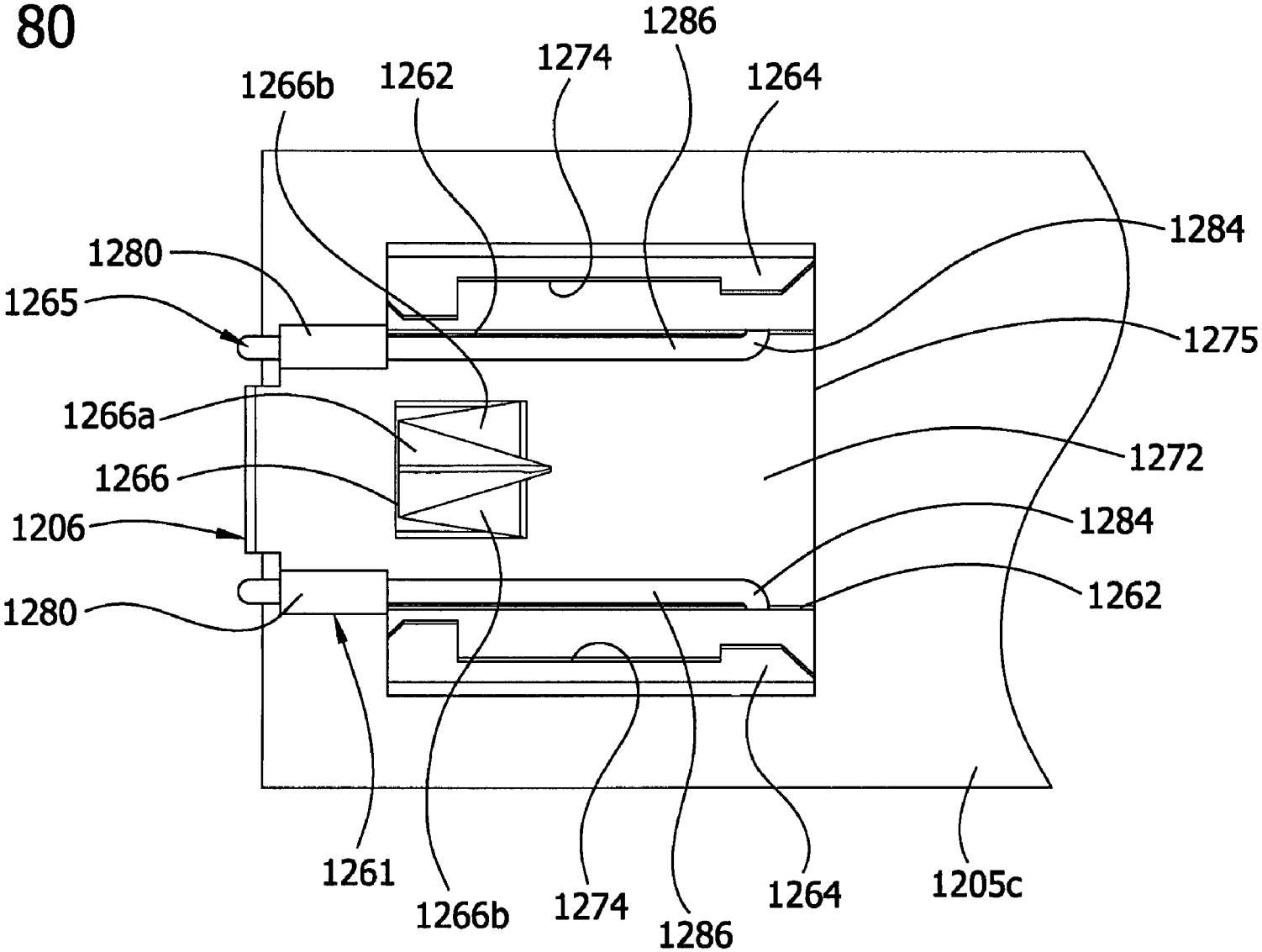
FIG. 80 is a fragmentary top plan showing one of the clips attached to the cover with the ring binder mechanism removed.
Figure 81:
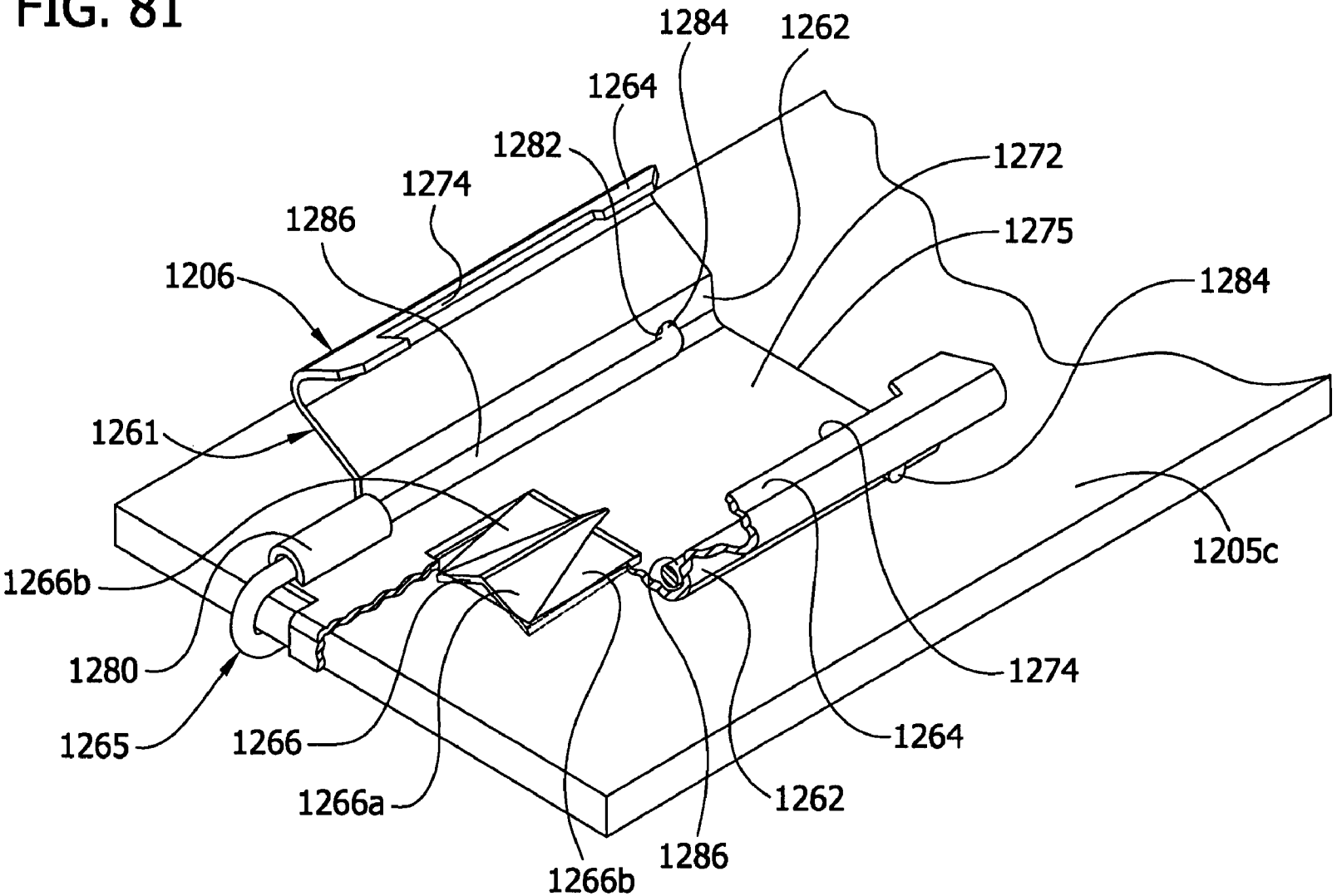
FIG. 81 is a fragmentary perspective similar to FIG. 80 but with a portion of the clip attached to the cover broken away.

The central portion 1266*a* of the tab 1266 has a bend at its apex that extends the length of the tab and back into a base 1272 of the clip 1206. One of the triangular portions 1266*b* is located on each side of the central portion 1266*a*. As shown in FIG. 80, the width of the tab 1266 tapers toward its fixed end such that it is narrower at its free end than at its end affixed to the base 1272 of the clip 1206. Moreover, the free end of the tab 1266 is narrower than an aperture 1207 in the cover 1205 while the end affixed to the base 1272 is wider than the aperture. As a result, when the clip 1206 is engaged with the cover 1205, the free end of the clip 1206 easily moves down into the aperture 1207 of the cover. But as the clip 1206 continues to be slid onto the cover 1205, the side edges of the tab 1266 engage and grip the edges of the cover 1205 defining the aperture 1207 (FIG. 81). Thus, the central portion 1266*a* of the tab 1266 is positioned to engage the longitudinal outer edge of the aperture 1207 in the cover 1205 to inhibit withdrawal of the clip 1206 from the cover. The engagement of the tab 1266 with the cover 1205 also inhibits movement of the ring binder mechanism 1203 with respect to the cover 1205. Parts corresponding to those shown in FIGS. 67-74 are indicated by the same reference numbers plus "100".

Additional clip configurations are shown and described in U.S. patent application Ser. No. 11/316,511, entitled RING BINDER HAVING CLIP filed Dec. 22, 2005, which is incorporated herein by reference in its entirety.

Components of the mechanism of the present invention are made of a suitable material, such as metal (e.g., steel). But mechanisms made of a non-metallic material, specifically including plastic, do not depart from the scope of this invention.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Moreover, the use of "up" and "down" and other orientational terms is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring binder comprising:

a substrate having an edge;

a ring binder mechanism including a housing and at least one ring supported by the housing for mounting loose leaf paper; and at least one clip adapted to secure the ring binder mechanism to the substrate and thereby mount the ring binder mechanism on the substrate, the clip having a first portion, a second portion spaced from the first portion, and an intermediate portion connecting the first and second portions, the first portion having an attachment member for attaching the clip to the housing, wherein the intermediate portion and second portion comprise a single bent wire sized and shaped to extend around the edge of the substrate to secure the clip to the substrate, and the first portion comprises a joining member for attaching the bent wire to the first portion.

2. The ring binder as set forth in claim 1 wherein the joining member comprises at least one knuckle sized and shaped for capturing the bent wire.

3. The ring binder as set forth in claim 2 wherein the joining member includes at least one opening sized and shaped for receiving the bent wire.

4. The ring binder as set forth in claim 1 wherein the attachment member comprises two opposing arms adapted to engage longitudinal sides of the ring binder mechanism housing.

5. The ring binder as set forth in claim 4 wherein the arms of the attachment member are resiliently deformable for gripping opposing sides of the ring binder mechanism housing.

6. The ring binder as set forth in claim 1 wherein the housing comprises a rib protruding from the housing for inhibiting longitudinal movement of the housing with respect to the clip.

7. The ring binder as set forth in claim 1 wherein the intermediate portion and second portion of the clip are formed as one piece of material, and wherein the clip further comprises a tab operable to inhibit movement of the clip with respect to the substrate.

8. The ring binder as set forth in claim 7 wherein the substrate includes an opening for receiving the tab of the clip.

9. The ring binder as set forth in claim 8 wherein the tab of the clip and the opening in the substrate have substantially the same width.

10. The ring binder as set forth in claim 9 wherein the tab includes a portion having a generally V-shaped cross section.

11. The ring binder as set forth in claim 1 in combination with a cover defining the substrate.

12. The combination as set forth in claim 11 wherein the cover comprises a front panel, a back panel, and a spine, the front and back panels being hingedly attached to the spine so that the panels are movable to selectively cover or expose loose leaf pages retained by the ring binder mechanism.

13. A ring binder comprising:

a ring binder mechanism including a housing having at least one ring for mounting loose leaf paper;

a cover including a front panel, a back panel, and a spine, the front and back panels being hingedly attached to the spine so that the panels are movable to selectively cover or expose loose leaf pages retained by the ring binder mechanism; and a clip having a first attachment portion adapted to attach the clip to the housing and a second attachment portion adapted to attach the clip to the cover to thereby mount the ring binder mechanism on the cover, the second attachment portion comprising a bent wire, wherein the bent wire comprises a generally U-shaped section in generally spaced, opposed relation to the first attachment portion, and wherein the bent wire further comprises arms received by and secured to the first attachment portion.

14. The ring binder as set forth in claim 13 further comprising a joining member joining the first attachment portion and the second attachment portion.

15. The ring binder as set forth in claim 13 wherein the joining member comprises at least one knuckle for capturing a portion of the second attachment portion.

16. The ring binder as set forth in claim 13 wherein the joining member comprises at least one opening for receiving a portion of the second attachment portion.

17. The ring binder as set forth in claim 13 wherein the first attachment portion comprises opposing arms adapted to engage longitudinal sides of the ring binder mechanism housing.

18. The ring binder as set forth claim 17 wherein the arms of the first attachment portion are resiliently deformable for gripping the longitudinal sides of the ring binder mechanism housing.

19. A ring binder comprising:

a ring binder mechanism including a housing having at least one ring for mounting loose leaf paper;

a cover including a front panel, a back panel, and a spine, the front and back panels being hingedly attached to the spine so that the panels are movable to selectively cover or expose loose leaf pages retained by the ring binder mechanism; and a clip having a first attachment portion adapted to attach the clip to the housing and a second attachment portion adapted to attach the clip to the cover to thereby mount the ring binder mechanism on the cover, the second attachment portion comprising a bent wire, the first attachment portion comprising opposing arms adapted to engage longitudinal sides of the ring binder mechanism housing, the arms of the first attachment portion are resiliently deformable for gripping the longitudinal sides of the ring binder mechanism housing, the clip further including a tab integrally formed with the clip for extending into an aperture in the cover.

20. The ring binder as set forth in claim 19 wherein the tab of the clip and the aperture in the cover have substantially the same width.

21. The ring binder as set forth in claim 20 wherein the tab includes a portion having a generally V-shaped cross section.

22. A clip for attaching a ring binder mechanism having a housing having at least one ring for mounting loose leaf paper to a cover, the clip comprising:

a first attachment portion adapted to attach the clip to the housing, the first attachment portion comprising opposing arms adapted to engage longitudinal sides of the ring binder mechanism housing, the arms of the first attachment portion are resiliently deformable for gripping the longitudinal sides of the ring binder mechanism housing;

a second attachment portion adapted to attach the clip to the cover to thereby mount the ring binder mechanism on the cover, the second attachment portion comprising a bent wire;

a tab integrally formed with the clip for extending into an aperture in the cover to locate the clip on the cover.

23. A ring binder comprising:

a ring binder mechanism including a housing having at least one ring for mounting loose leaf paper;

a cover including a front panel, a back panel, and a spine, the front and back panels being hingedly attached to the spine so that the panels are movable to selectively cover or expose loose leaf pages retained by the ring binder mechanism; and a clip having a first attachment portion adapted to attach the clip to the housing and a second attachment portion adapted to attach the clip to the cover to thereby mount the ring binder mechanism on the cover, the second attachment portion comprising a bent wire, wherein the joining member comprises at least one knuckle for capturing a portion of the second attachment portion.

24. A ring binder comprising:

a ring binder mechanism including a housing having at least one ring for mounting loose leaf paper;

a cover including a front panel, a back panel, and a spine, the front and back panels being hingedly attached to the spine so that the panels are movable to selectively cover or expose loose leaf pages retained by the ring binder mechanism; and a clip having a first attachment portion adapted to attach the clip to the housing and a second attachment portion adapted to attach the clip to the cover to thereby mount the ring binder mechanism on the cover, the second attachment portion comprising a bent wire, wherein the joining member comprises at least one opening for receiving a portion of the second attachment portion.

* * * * *

UNITED STATES PATENT AND TRADEMARK OFFICE

CERTIFICATE OF CORRECTION

PATENT NO. : 7,654,765 B2
APPLICATION NO. : 11/423077
DATED : February 2, 2010
INVENTOR(S) : Hung Yu Cheng It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 129 days.

Signed and Sealed this

Twenty-third Day of November, 2010

David J. Kappos

David J. Kappos
*Director of the United States Patent and Trademark Office*